US009463970B2

(12) United States Patent
Orcutt et al.

(10) Patent No.: US 9,463,970 B2
(45) Date of Patent: Oct. 11, 2016

(54) SYSTEM AND METHOD FOR COMPLIANCE MANAGEMENT OF FLUIDS IN AND ABOUT DRILLING SITES

(71) Applicant: Summit Liability Solutions Inc., Calgary (CA)

(72) Inventors: Russel Lloyd Orcutt, Calgary (CA); Jason Pecht, Lethbridge (CA); Kyle Laturnus, Coaldale (CA); Corey Kenneth McAllister, Calgary (CA)

(73) Assignee: Summit Liability Solutions Inc., Calgary (CA)

( * ) Notice: Subject to any disclaimer, the term of this patent is extended or adjusted under 35 U.S.C. 154(b) by 603 days.

(21) Appl. No.: 13/870,915

(22) Filed: Apr. 25, 2013

(65) Prior Publication Data

US 2013/0291999 A1 Nov. 7, 2013

Related U.S. Application Data

(63) Continuation-in-part of application No. 12/958,294, filed on Dec. 1, 2010.

(60) Provisional application No. 61/638,751, filed on Apr. 26, 2012, provisional application No. 61/330,236, filed on Apr. 30, 2010.

(51) Int. Cl.

| | |
|---|---|
| ***B67D 7/32*** | (2010.01) |
| ***B67D 7/14*** | (2010.01) |
| ***B67D 7/02*** | (2010.01) |

(52) U.S. Cl.

CPC ..... *B67D 7/3272* (2013.01); *B67D 7/02* (2013.01); *B67D 7/145* (2013.01); *B67D 7/32* (2013.01)

(58) Field of Classification Search

CPC ..... B67D 7/145; B67D 7/02; B67D 7/32; B67D 7/348; B67D 7/3272

USPC ..... 141/2, 5, 18, 94, 98, 231; 701/50, 468, 701/482

See application file for complete search history.

(56) References Cited

U.S. PATENT DOCUMENTS

| | | | | |
|---|---|---|---|---|
| 7,503,510 | B2 * | 3/2009 | Vickers | A01M 7/0014 141/18 |
| 7,673,661 | B2 * | 3/2010 | Chase | B67D 1/0858 141/360 |
| 8,907,775 | B2 * | 12/2014 | Tyler | G08G 1/207 340/425.5 |
| 2007/0102060 | A1 * | 5/2007 | Palmer | F04B 49/22 141/231 |
| 2007/0198186 | A1 * | 8/2007 | Realini | B67D 7/348 701/469 |

* cited by examiner

*Primary Examiner* — Mark A Laurenzi
*Assistant Examiner* — Timothy P Kelly
(74) *Attorney, Agent, or Firm* — Parlee McLaws LLP (CGY); Sean Goodwin

(57) ABSTRACT

A system and method are provided for automated intake and discharge of fluids to and from specified inclusion zones at a drilling site and related sites. A surface map is annotated with shapes designating at least inclusion zones for managed control of permitted intake and discharge of fluids tt and from permitted zones. For specified water sources, the inclusion zone is a loading zone associated with specified conditions and another inclusion zone is an unloading zone also having specified conditions. A control system in a vehicle uses the annotated map and GPS to assist the operator of the vehicle avoid restricted intake from and discharge to restricted zones and limit volumes and rates based on monitored parameters. Records are maintained to confirm the fluid, fluid location and volumes.

19 Claims, 30 Drawing Sheets

| N Latitude | W Longitude |
|---|---|
| XX.MMM 6725 | -YYY.MMM 7132 |
| XX.MMM 6732 | -YYY.MMM 7235 |
| XX.MMM 6733 | -YYY.MMM 7471 |
| XX.MMM 6737 | -YYY.MMM 7883 |
| XX.MMM 6736 | -YYY.MMM 9103 |
| XX.MMM 6741 | -YYY.MM 10230 |
| XX.MMM 6744 | -YYY.MM 11309 |
| XX.MMM 7958 | -YYY.MM 11299 |
| XX.MMM 7955 | -YYY.MM 10222 |
| XX.MMM 7950 | -YYY.MMM 9091 |
| XX.MMM 7951 | -YYY.MMM 7879 |
| XX.MMM 7947 | -YYY.MMM 7463 |
| XX.MMM 7946 | -YYY.MMM 7227 |
| XX.MMM 7939 | -YYY.MMM 7112 |
| XX.MMM 6725 | -YYY.MMM 7132 |

Disposal of Waste

| Waste Information | | Land Information | |
|---|---|---|---|
| Licensee: | | Disposal Location: | SE NE |
| Unique ID: | | Ground Conditions: | Summer Operations |
| Surface Location: | | Land Use Description: | Stubble |
| Well License: | | Landowner Name: | B |
| MSL: | | Phone Number: | (403) |
| Sump Location: | | Consent Date: | , 2010 |
| | | Occupant Informed: | No |
| Technician Name: | | Incorporation Within 2 Weeks: | No |

| Disposal Entire Well | |
|---|---|
| Volume ($m^3$): | 195 |
| Solids Loading Rate (t/ha): | 2.37 |
| Area Used (ha): | 6.6 |
| Incorporation Depth (cm): | 0 |
| Application Rate ($m^3$/h): | 29.48 |
| Application Thickness (CM): | 0.29 |

| Water Information | |
|---|---|
| Source Location: | W4 |
| Source Type: | Dugout |
| Landowner Name: | |
| Phone Number: | (403) |
| Consent Date: | , 2010 |
| Volume Used ($m^3$): | 389 |

| Water Analysis | | | |
|---|---|---|---|
| pH: | 7.4 | Mg (mg/L): | 0.00 |
| Cl (mg/L): | 70.00 | EC (dS/m): | 0.82 |
| N (mg/L): | 0.00 | SAR: | 1.07 |
| Ca (mg/L): | 60.00 | | |
| Na (mg/L): | 30.00 | | |
| S04 (m/L): | 0.00 | | |

Cuttings Landsprayed with Drilling Fluids: ✓ ○ D.S.T. Analysis: ○ ✓

Sprayfield Map

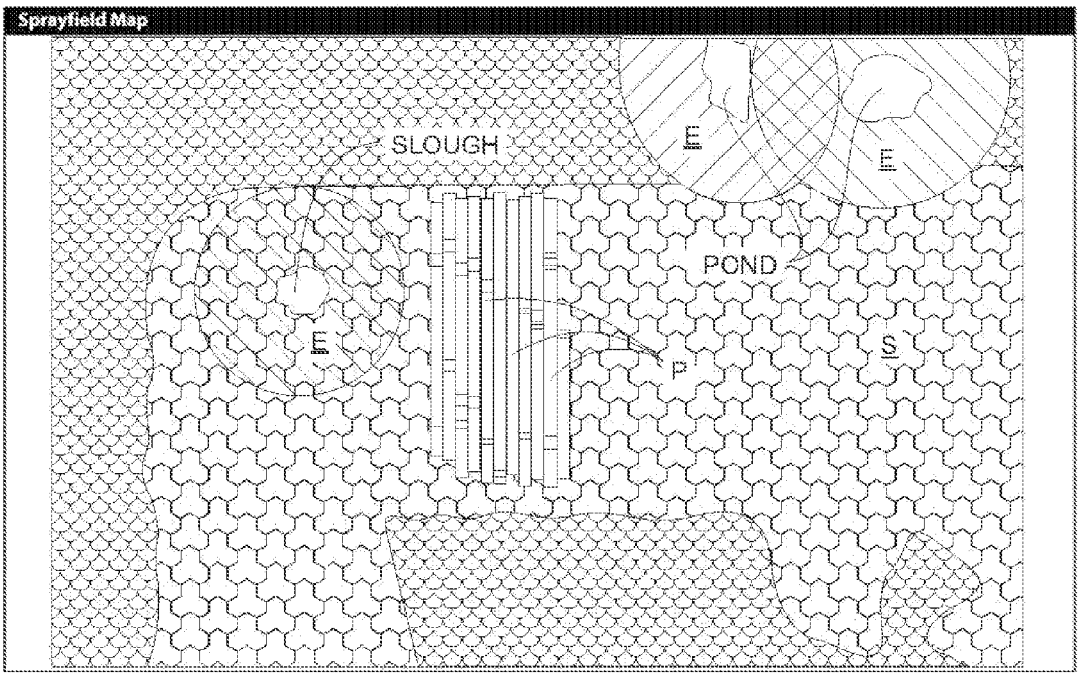

Soil Sample Information

| Sample ID | Texture | Latitude | Longitude | pH | EC (ds/m) | TDS (mg/L) | Na (mg/L) | Cl (mg/L) | Ca (mg/L) | Mg (mg/L) | S04 (mg/L) | K (mg/L) | SAR |
|---|---|---|---|---|---|---|---|---|---|---|---|---|---|
| Soil A | Sandy Clay Loam | .2682 | .6868 | 7.1 | 0.42 | 294.00 | 16.00 | 40.00 | 22.00 | 18.00 | 0.00 | 0.00 | 0.61 |

*Fig. 8B*

| Manage Jobs | | | | |
|---|---|---|---|---|
| Job name | Well | Disposal Location | Area | Last Updated |
| .log (file no.) | UWI | Cement – LSD | n/a | Date |
| .log (file no.) | UWI | Sump 1 – LSD | n/a | Date |
| .log (file no.) | UWI | Sump 2 – LSD | n/a | Date |
| .log (file no.) | UWI | Sump 3 – LSD | n/a | Date |
| .log (file no.) | UWI | Sump 4 – LSD | n/a | Date |

*Fig. 11*

Water Truck

Wiring Diagram

Fig. 14A - Oil flow for GPS shut off
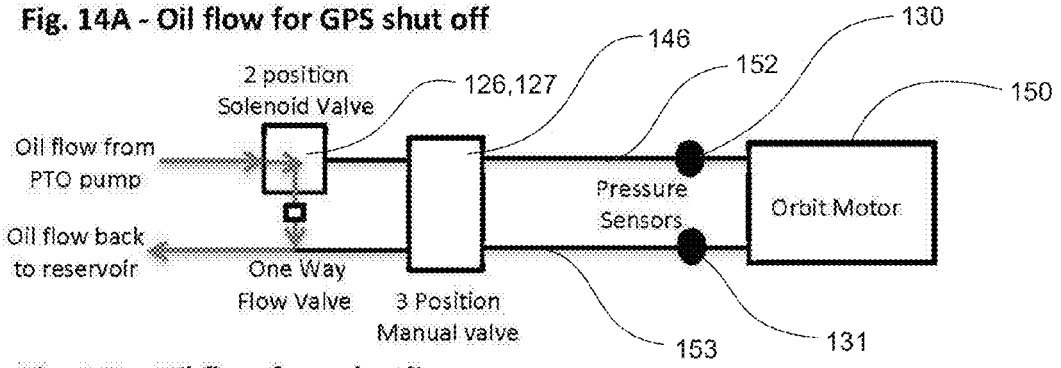
Fig. 14B - Oil flow for unloading
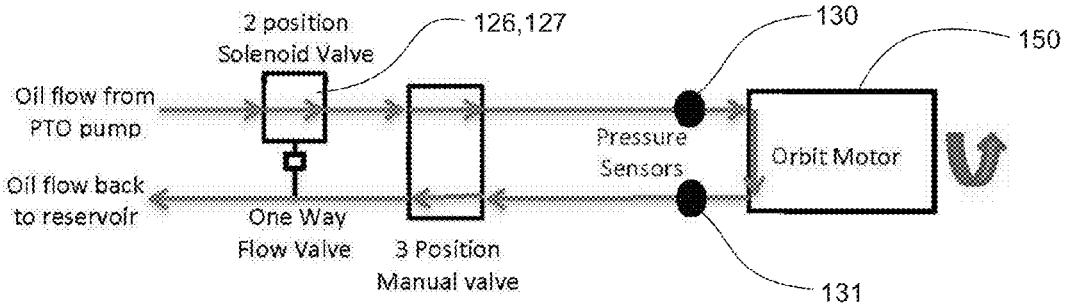
Fig. 14C - Oil flow for loading
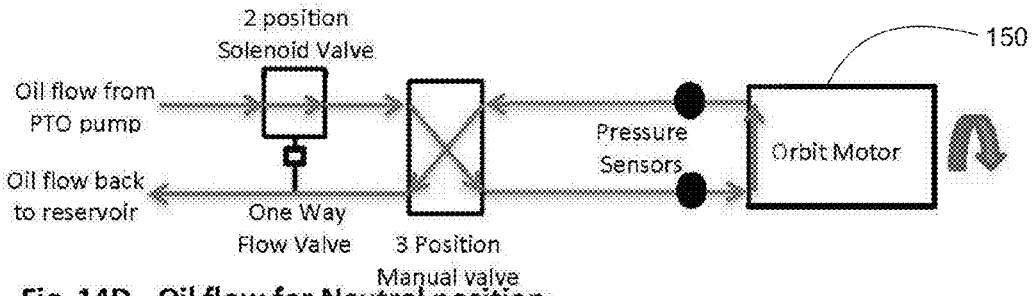
Fig. 14D - Oil flow for Neutral position
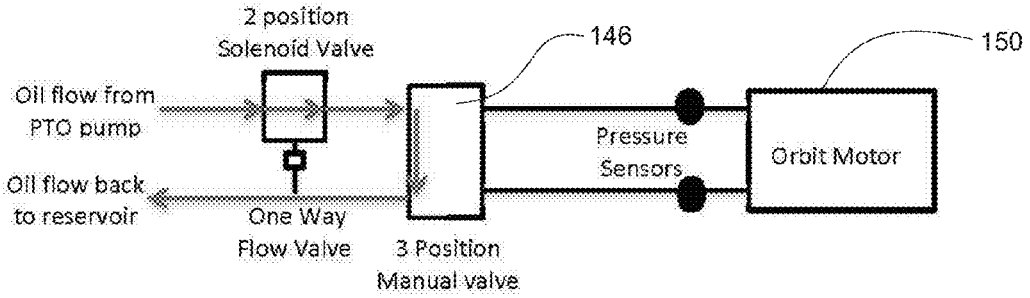

SYSTEM AND METHOD FOR COMPLIANCE MANAGEMENT OF FLUIDS IN AND ABOUT DRILLING SITES

CROSS REFERENCE TO RELATED APPLICATIONS

This application claims the benefit of U.S. Provisional Application 61/638,751, filed Apr. 26, 2012 and is a continuation-in-part application of U.S. Ser. No. 12/958,294, filed Dec. 1, 2010, which claims priority of U.S. 61/330,236, filed Apr. 30, 2010, the entirety of each being incorporated fully herein by reference.

FIELD OF THE INVENTION

The present invention relates to a compliance management system for the control of specified liquid transfer from and to designated zones, and more particularly to monitoring and recording water diversion to comply with applicable government regulations, including for used in road construction and oil and gas drilling operations.

BACKGROUND OF THE INVENTION

Oil field exploration and the drilling industry access and impact water resources. In Canada, ownership of surface and ground water resources are vesting the Province. Hence, provincial legislation is typically in place to manage and protect water resources. Under growing water demand and changing climate requires adaptation and preparedness to effectively address future water resource challenges. Water is taken from rivers, lakes, and aquifers for a variety of human purposes. It is essential to agriculture, hydroelectric and non-hydro power generation, oil and gas production, as well as drinking supply. Such water uses or diversions are typically managed through licenses issued under provincial Water Acts, which specify restrictions.

Water is a critical component in the recovery and processing of petroleum and natural gas reserves. Drilling rigs are used to reach the oil and gas. Rigs extensively use water to make a special fluid called "mud." The mud helps bring drilled rock chips to the surface and keeps the drill cool from friction against the rock. An average in situ project uses roughly half a barrel (80 liters) of freshwater to produce a barrel of oil. It is reported that an average oil sands surface mine uses between two and five barrels of freshwater to produce a barrel of oil.

Proper regulatory oversight is intended to ensure water sourcing, transportation, recycling, storage, and disposal are managed effectively to mitigate risks to surface water and non-saline groundwater sources.

Licenses to divert water define terms and conditions appurtenant to the legal land location of a point of diversion that must be followed once issued. These terms and conditions are meant to control the potential for adverse effects to the source of water. Typical terms and conditions are maximum volume limits, percent flow restrictions and maximum diversion rates appurtenant to points of diversion and points of use; as well as monitoring, recording and reporting requirements. These terms and conditions are imposed by provincial governments and determined through data and research.

Applicant is aware of several water management data collection systems. These are typically mobile units which are placed at diversion points of water sources which monitor and record the water diverted from that point. Some of these "pump houses" or "pump stations" contain data transmission devices which remotely provide real-time information from each event at that water source.

However, such systems do not efficiently monitor and record water diverted by water hauling vehicles on drilling operations and particularly in situation in which water sources are changed once or twice a week. In such cases, current water monitoring practices within drilling operations rely on human estimations and produce extremely inaccurate data collection. In turn, these inaccuracies generate unreliable analysis and reporting thus negatively affecting all other strategies developed to safeguard our water resources.

Applicant is not aware of safeguards preventing a water hauler operator from diverting water from an unlicensed water source, nor of any safeguards preventing that water hauler operator from depositing the water in a location other than the licensed point of use.

Maximum water volume and diversion rates pursuant to the license are estimated by the water hauling operator. The operator estimates the water volume diverted and estimates the time it took to divert that volume then calculates a diversion rate based on those estimates; furthermore, there is no monitoring that the diversion limit or diversion rate pursuant to the license was actually followed. Neither environmental technicians nor government enforcement agents able to be present throughout all water diversion events.

Accordingly, to date, the onus is completely on the water hauler operator to perform water diversion in a legally compliant manner. Water hauler operators are often among the least trained persons with regards to regulatory compliance requirements and reliance on the operator entails a high risk of non-compliance as a result of human error.

Accordingly, a system and method is needed to overcome the deficiencies of conventional water diversion for drilling operations namely to better manage the terms and conditions of licenses with regards to controlled removal and placement of water as well as well as monitoring, recording and reporting requirements.

SUMMARY OF THE INVENTION

Water is becoming a more valuable resource than ever and the management of that resource is becoming more scrutinized. As government regulations tighten and the public becomes more concerned with water management there is a need for new solutions to maintain compliance. Current practices are not reliable or very accurate in tracking the necessary information to monitor this important resource. Fines for not following government regulations are increasing and companies are looking for a proactive and preventative system. Embodiments of the water management system disclosed herein are tools that companies can rely on to ensure compliancy with all water diversion regulations. Further, general fluid intake and discharge monitoring encourages best commercial practice, error reduction and improved economics.

Apparatus and method are provided for controlled intake and distribution of fluids in and around specified zones, for example, such as zones about a drilling site. Intake and discharged distribution is controlled, such as by volumes or rate, and limited geographically to inclusion zones, such as licensed water sources, specified sumps and loading areas. Access to such inclusion or loading zones can be delimited and controlled to those defined by geo-perimeters associated with such zones, such as vehicle tolerant access points or otherwise restricted access points. Other areas are expressly avoided such as hazards, environmentally sensitive areas, and incompatible fluid storage or sumps. A vehicle, such as a water truck specific for water, or a vacuum truck for generic liquids, supports and transports a container for receiving, transporting and discharging fluids. Transfers to and from the container are controlled using pre-determined conditions. Intake for water from water resources for specified uses is also referred to herein as water diversion.

A navigation unit, including global positioning determines a current position of the vehicle. A control unit determines spatial coordinates of the surface including boundary coordinates or geo-perimeters defining one or more of these inclusion zones on the surface which are approved for delivering up fluid or receiving discharged fluids. The control unit determines a current position of the vehicle and other parameters for comparison against pre-determined conditions including whether the current position is inside the inclusion zone, and if so, whether the liquid is transferred or transferable to or from the container at all, or in compliance with other of the pre-determined conditions. If the conditions are satisfied, the appropriate action is authorized including transferring liquid from a first liquid source inclusion or loading zone. The liquid can be transported for unloading or discharging to a second fluid discharge inclusion or unloading zone.

As stated above, in an embodiment related to water usage, the collection and dispersing of a water resource is also known as water diversion. Typically one can draw from specified sources, but cannot ever discharge back to a source, especially for water diversion. Further, the type of vehicle may be restricted from handing specified fluids; vacuum trucks typically being prohibited from drawing water from most water sources, many of which may be potable or destined for potable uses. Containers other than water truck containers could be contaminated and therefore are prohibited for water diversion scenarios.

One water management system is a web-based Geographic Information System (GIS) combined with a Global Positioning System (GPS) designed for the compliant management and reporting of water diversion. Embodiments of a water management system comprise desktop reporting software which maintains records that demonstrate compliance and a "Navigator" which controls the equipment used for water hauling (i.e.; water truck). Together the software and Navigator monitor diversion rates, volumes, and application of water for specified uses and ensure water quality and sources are preserved and guidelines are followed. Further, the GPS system monitors and stores real time data regarding water truck fleet operations for reporting and compliance purposes.

Embodiments of water and other fluid compliance systems overlap somewhat with Applicant's co-pending drilling waste disposal technology, as set forth in US application US 2011-0266357-A1, published Nov. 3, 2011. Overlap includes the navigation, controls over liquid handling in compliance with monitored parameters and pre-determined conditions.

Herein, embodiments of this fluid-management technology solves many of the short comings of current water diversion and management. The water management system is more automated that in the prior art and minimizes human error. The GPS system on the water truck monitors the trucks location, and sensors monitor other operational parameters and the likelihood of a non-compliant event is drastically reduced or eliminated. For example, the Navigator system monitors water flow using a flow meter preventing diversion rates and volumes from being exceeded. Water is drawn from a source using a pump such as a water pump. The Navigator, retrofit to water trucks, physically prevents the water pump from being working if certain minimum conditions are not met or exceeded. Real-time or near real-time communication of data to and from a central database ensures that multiple vehicles acting on the same site or fluid sources are considered and cumulative or aggregate data is within the threshold parameters.

The data collected from each vehicle's Navigator can be downloaded in real time via a satellite modem to a Spatial Data Infrastructure (SDI), identifying cumulative volumes and geographic areas where water was used or applied. This SDI displays all data on a digital map. A database stores information about each scenario, job or load of water for each truck in operation. Parameters such as dates, times, locations, volumes, rates, and driving routes are some of the elements available through the infrastructure. An interested user can also query data to find specific information.

While entire systems can be provided, vehicles can be retrofitted for diversion and unloading management including provision of a kit to supply that which is not already on such a vehicle. A kit might include pump flow direction sensors, lock-out switches or solenoids on pump operation, a GPS navigation unit, and a control unit comprising: a processor in communication with memory, a control unit comprising a processor in communication with the navigation unit, satellite communications, the sensors and pump controls; and memory storing processor-executable instructions adapting the control unit to assess monitored parameters for comparisons with pre-determined conditions and management loading and unloading accordingly.

Use of various of the embodiments disclosed herein better effect compliance and costs associated therewith including minimizing risk to water sources through accidental discharge or over use. The disclosed embodiments control liquid transfer in accordance with assessed rules that ensure the above risks are eliminated.

BRIEF DESCRIPTION OF THE DRAWINGS

FIGS. 1 through 8B relate to Applicants' co-pending application for landspraying management.

FIG. 1 is a schematic diagram of an embodiment of Applicant's co-pending system for landspraying, depicting a vehicle with a control unit for operating a container mounted thereon;

FIG. 2 is a schematic block diagram of one embodiment of a relay board forming part of the interface circuit in the control unit of FIG. 1;

FIG. 4 is a flowchart depicting steps to operate the valve depicted in FIG. 1;

FIG. 5 is a flowchart diagram depicting a set of criteria evaluated within step S404 of FIG. 4;

FIG. 6 is a diagram of a screenshot of the display in FIG. 1, when the system of FIG. 1 is in operation;

FIG. 8B is a graphical representation of mapping data and sprayed areas on a color photograph of a land surface incorporated into a report illustrating land characteristics and recorded landspraying data; and Turning to the present embodiment such as that suitable for managing fluid transfers between locations.

FIG. 11 is a simplified form of report for illustrating scenario or job and disposal locations;

FIGS. 14A-14D, illustrate the management system interlock integrated into a water truck's hydraulic system for the operation of a bi-directional pump (not shown) of FIGS. 12 and 13, illustrating FIG. 14A controls actuated to stop loading/unloading in an inappropriate area/perimeter (outside the inclusion zone or geo-perimeter), FIG. 14B illustrates operation for unloading to an appropriate inclusion zone, FIG. 14C, illustrates operation for loading from an appropriate inclusion zone or source, FIG. 14D illustrates placing the pump in a neutral or inoperative state for neither loading or unloading;

FIG. 15A is a water truck fit with a bi-directional pump and interlock system of FIGS. 14A-14D, FIG. 15B illustrates some detail of a heated cabinet of the trusk of FIG. 15A containing said water pump and compliance interlocks;

DETAILED DESCRIPTION OF EMBODIMENTS

Figure 1:
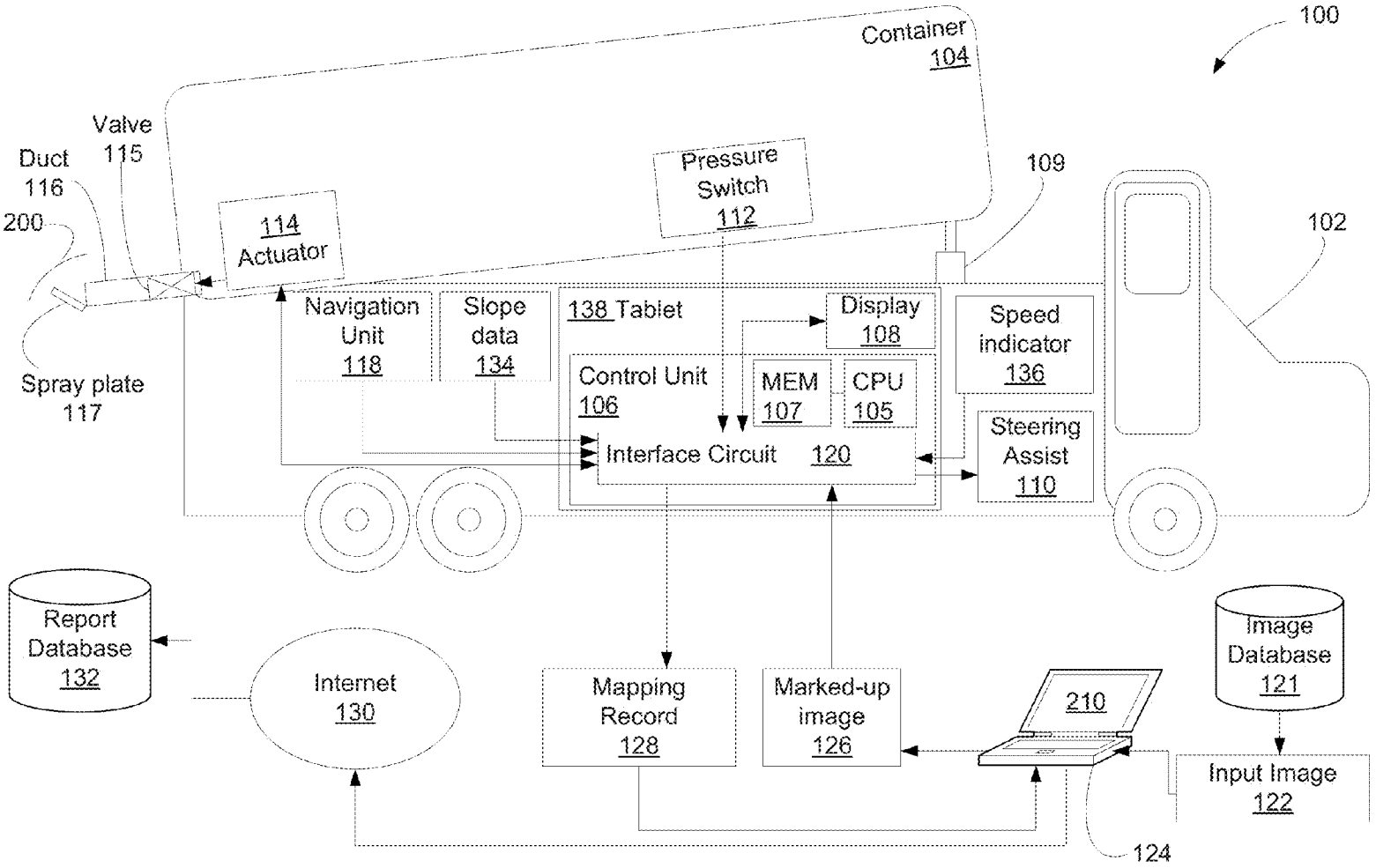

A system and control unit provide automated control and monitoring system for maximizing regulatory compliance in various operations including various land, liquid and water resource-related operations, for example, control of landspraying operations and fluid transfer between locations and, in one specific case of fluid transfer, water diversion.

Landspraying operations are also subject of Applicants' a co-pending application and a substantial part reproduced herein and illustrated in FIGS. 1 through 8B. Liquid transfer between designated inclusion zones and water diversion embodiments are introduced herein and illustrated in FIGS. 9A through 19C.

While much of the specifics of Geographic Information System (GIS) combined with a Global Positioning System (GPS) and control of liquid intake and discharge are described herein in the context of the control of landspraying of waste fluids such as drilling fluid and control of water diversion, the apparatus and methods herein can be applied to the controlled deposition of other materials and fluids.

A system control unit is typically installed in a vehicle having a fluid container mounted thereon. The container has a valve, operable by the control unit, to regulate intake and discharge of fluid. Discharged fluid can contain solid particle debris which is a challenge to dispense.

The control unit obtains geo-coordinate data for controlled perimeters and boundaries of exclusion zones and inclusion zones. For example, one application is that the exclusion zones define an area that should not be sprayed during landspraying operations. An inclusion zone can define an authorized source for acquiring fluids, and a permitted draw—such as volume.

The control unit then employs a navigation system and fluid intake and discharge control, including valves for managing intake and discharge including to avoid discharge within the exclusion zones (outside inclusions zones) and to limit intake from a regulated inclusion zone. In a landspraying embodiment, the system avoids overspraying in approved inclusion zones. In a controlled perimeter, sump or source management scenario, the system manages where fluids are drawn, discharged and volumetric totals. The navigation system captures the exact mapping of drawn, discharged and deposited material, and related volumes, for all related vehicles, for analysis and reporting.

Landspraying Criteria

As set forth in Applicant's copending US application published as US US2011266357A1 on Nov. 3, 2011, the entirely of which is incorporated herein by reference, in landspraying embodiments, the control unit operates a discharge valve to spray waste fluid based on safety and environmental regulatory criteria. The control unit makes use of various parameters to evaluate if compliance criteria are met before initiating spraying of the waste fluid. The criteria are selected to avoid spraying on sensitive zones such as bodies of water and, when spraying in approved zones, to limit areal spray rate, i.e., the volume of fluid sprayed per unit area of surface. The system assists the operator of the vehicle by providing automated spraying control, and can further provide visual guides, and automated steering for the vehicle as needed. The system and automated control is also reflective of the water fluid characteristics.

Water Criteria

In the case of water resources, and depending on the location and nature of the operation, water can be taken or harvested from either surface water or groundwater (underground) sources as long as pre-determined conditions are met, typically set for in a license by the appropriate regulatory authority. For groundwater sources, both saline (brackish) and fresh (non-saline) water is used. In the Province of Alberta, Canada, the ownership of all relevant surface and groundwater is vested in the province. The Water Act provides a system for licensing both surface water and groundwater diversion and use. Approvals are required for drilling and constructing water wells by drilling contractors and for the exploration of groundwater. Licenses may need to be required, approval based in part on the location of the well, source of water, total quantity of water and a time frame over which the water is drawn including season. The collection and dispersing of a water resource is also known as water diversion. Typically one can draw from specified sources, but cannot ever discharge back to a source. Further, water diversion can only be performed by water trucks, the presumption being vacuum trucks are excluded as being waste carriers unless re-certified for potable water. The water management system is a web-based Geographic Information System (GIS) combined with a Global Positioning System (GPS) designed for the compliant management and reporting of water diversion.

The control unit operates the intake and discharge control to manage locations for drawing water, volumes and permitted discharge locations based on safety and environmental regulatory criteria. The control unit makes use of various parameters to evaluate if compliance criteria are met before and during water handling. The system assists the operator of the vehicle by providing automated control, and can further provide visual guides (such as locations and running volumes), and automated steering for the vehicle as needed. The GPS system on the water truck monitors the trucks activities and the likelihood of a non-compliant event is drastically reduced. The GPS monitors water flow using a flow meter preventing diversion rates and volumes from being exceeded. Water is drawn from a source using a pump such as a water pump. The Navigator, installed on water trucks, physically prevents the water pump from working if certain parameters are not met or exceeded. The data collected from each truck's Navigator can be downloaded in real time via a satellite modem to a Spatial Data Infrastructure (SDI) identifying cumulative volumes and geographic areas where water was drawn and applied. This SDI displays all data on a digital map. A database stores information about each scenario, job or load of water. Parameters such as dates, times, locations, volumes, rates, and driving routes are some of the elements available through the infrastructure. An interested user can also query data to find specific information.

Embodiments of the water management system comprise desktop reporting software which maintains records that demonstrate compliance and a "Navigator" which controls the equipment used for water hauling (i.e.; water trucks). Together the software and Navigator monitor diversion rates, volumes, and application of water and ensure water quality and sources are preserved and guidelines are followed. Further, the GPS system monitors and stores real time data regarding water truck fleet operations.

Sump Criteria

Drilling waste is typically stored temporarily on-site in pits or sumps. Sumps are earthen excavations on the well site (FIGS. 9A-9D) or at a remote site (off-lease—see FIGS. 10A-10D) and are subject to various restrictions. Restrictions include limiting content to non-hydrocarbon-based drilling wastes, drilling wastes that originate only from that site, sump construction requirements and limitations on reuse. Alberta regulations impose reporting obligation which can include post-disposal information identifying the drilling waste volumes generated, storage systems used, disposal methods used, and locations of disposals. On site operations are also concerned with fluid contamination, such as disposal of used mud into a clean mud pit.

In sump management, similar to water management embodiments, the control unit operates the intake and discharge control to manage locations for loading and unloading fluids, such locations being based on safety, environmental regulatory criteria and proper site control to avoid contamination. The control unit makes use of various parameters to evaluate if compliance criteria are met before and during sump fluid control. The system assists the operator of the vehicle by providing automated control, and can further provide visual guides (such as locations), and automated steering for the vehicle as needed.

Management System

A management system, including application software, may be used to assist applying criteria including identifying geo-perimeters or boundaries for zones within the land surface, being those that can be used under specified conditions, and those that should not, such as those should not be discharged to, sprayed or overdrawn. The application software may be used to select a map of the land surface from a database of maps or photographic/satellite images containing coordinate data. Application software may then be used to annotate the selected map with polygons or other shapes distinguishing geo-perimeters or boundaries of exclusion zones not to be used and inclusion zones which can be used. The zones can be assigned additional characteristics including permitted rates and volumes. The management system is a web-based Geographic Information System (GIS) combined with a Global Positioning System (GPS) designed for the compliant management and reporting. The data collected from each truck's Navigator can be downloaded in real time via a satellite modem to a Spatial Data Infrastructure (SDI) identifying accumulative volumes and geographic areas where fluid has been drawn and discharged or applied. The SDI displays all data on a digital map. A database stores information about each scenario or job from each vehicle employed. Parameters such as dates, times, locations, volumes, rates, and driving routes are some of the elements available through the infrastructure. An interested user can also query data to find specific information.

With reference to FIGS. 9A-10D, as different inclusions zones can have different restrictions and characteristics, one or more of the target inclusion zones are matched with one or more scenarios. A scenario, or job, is related to one or more specified intakes, or discharges or both. An often applied scenario is a transfer scenario such as for disposal of fluids obtained from one area for discharge to another; however this can also apply as the context dictates to water diversion jobs. In an example, one can ensure that contaminated mud is only discharged to the specified contaminated mud sump or sumps and not to another sump such as a clean mud sump.

A transfer scenario may also include those related to mere distribution which is not strictly a "disposal', including surface water distributed about specified portions on or off site for building ice roads or for dust suppression. The type of container may also be specified. A sump-tasked vacuum truck would not be permitted to draw from licensed water sources as the truck's pump systems could be contaminated are therefore interlocked by the management system so as not to function.

Simply, each transfer scenario matches a fluid transfer or disposal to a specified sump or specified use. While not all cases would be directly restricted under regulations, contamination of a normally unrestricted sump could place the sump under other regulations or otherwise result in an economic penalty for such an error in disposal. Further, a transfer scenario might dictate strict usage between specified zones, including intake of surface water from one inclusion zone being limited for application or discharge or one or more specified zones, while surface water from some other inclusion zone might be more broadly applied for discharge to other specified inclusion zones.

Landspraying Embodiment

Illustrative of aspects of a navigational system are described in Applicant's co-pending US application published as US 2011266357A1 on Nov. 3, 2011, the entirely of which is incorporated herein by reference. In such cases, an annotated map is provided to the control unit for setting forth inclusion zones, exclusion zones and other geo-perimeters including sub-zones within other such zones. For example, an inclusion zone, subject to specific conditions, may als have a geo-perimeter identifying a vehicle approach to the inclusion zone, that approach being suitable for vehicle traffic, or accommodating landowner wishes.

Some details of Applicants' landspraying example are described herein so as to demonstrate the general components and operation of the system for controlled spraying as they are applied according to criteria limited to spraying or not spraying. In this context, spray rates and boundaries are managed.

In a sump or water diversion context, permitted source and discharge boundaries are managed and for the water case, additional conditions including total volume and rates.

For a description of the capability of the control unit, the following is a reproduction of operation as it relates to the landspraying context and as described in the co-pending application US 2011266357A1. The application to sump and water diversion follows thereafter.

In the landspraying context, the overall area of the land surface to be sprayed, less the exclusion zones, provides a rough net area available for spraying.

Accordingly, and with reference to FIG. 1, one embodiment of a land spraying system 100 is provided for use in drill waste fluid disposal. The land spraying system 100 comprises a vehicle 102, a fluid container 104 mounted thereon, a control unit 106 and peripherals described later which support operations. An onsite or offsite surface pre-spray and post-spray management system 210 enables surface selection, zone determination and post-spraying reporting functions.

The fluid-handling apparatus comprises the vehicle 102, container 104, and fluid discharge equipment including discharge valve 115, valve actuator 114 and nozzle 200. The container 104 can be a standard tank suitable for transporting liquids. The container 104 is fit with a fluid discharge or duct 116 adjacent its base. The container 104 is filled with the waste fluid and may be pressurized with an air pad to aid in the discharge of the waste fluid through duct 116. As the fluid level in the container 104 drops, the hydrostatic head also drops and the flow rate diminishes. Due to variable hydraulic head of the waste fluid, the flow rate or discharge rate can vary, being maximum when the container 104 is full and the fluid hydrostatic head is additive in the container pressure. The variability in hydrostatic head is somewhat lessened by the use of the air padding over the waste liquid.

A hydraulic mechanism 109 in the vehicle 102 may be used to tilt the container 104 for maximal discharge of fluid though duct 116. A relief valve may be present in the container 104 to protect against excessive pressure build up. In one specific embodiment, a Kunkle relief valve supplied by Tyco International Ltd of Princeton, N.J., USA may be used.

Figure 7A:
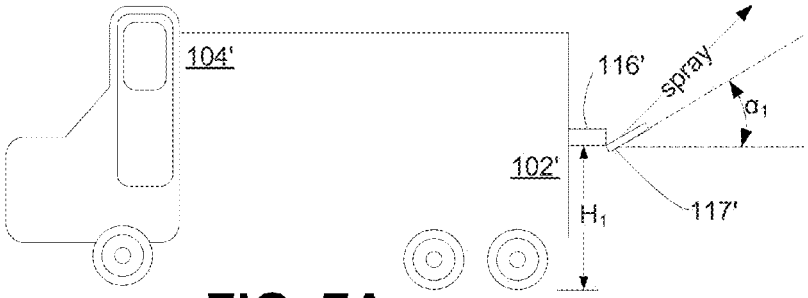
FIGS. 7A-7D are schematic side views of a vehicle, depicting possible orientations for its container and spray plate used for landspraying.
Figure 7E:
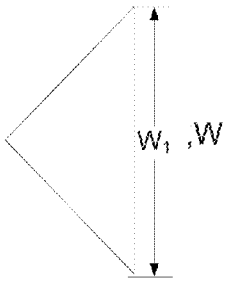
FIGS. 7E-7H are schematic plan views of the spray corresponding to the container and spray plate orientations depicted in FIGS. 7A-7D respectively.

Nozzle 200 is formed by the discharge opening of the duct 116 and a spray plate 117 to disperse the fluid in a fan pattern (See also FIGS. 7A and 7E). A typical discharge opening of the duct 116 for a vacuum truck is about 4 inches in diameter. The sprayed fluid thus lands onto the surface below having a spray width W. As the vehicle 102 traverses the land surface, the spray width W and a traversed distance over the surface establishes the sprayed area over time.

An on-off discharge valve 115 in the duct 114 controls the flow of fluid from the container 104 to the nozzle 200. Waste fluids have characteristics which interfere with fine variable flow control. Thus, on-off valves are used as they mitigate intermittent blockages in the duct 116 that can occur with variable flow control valves. Periodic blockages are undesirable as they can lead to unpredictable drought and flood discharge. While crude, the controlled discharge of a on/off valve is predictable and step-wise controllable. The valve 115 can have a fail-safe, closed mode.

An actuator 114 may be used to actuate the on-off valve 115. The actuator 114 may include one or more pneumatic/hydraulic actuators and cylinders controlled by a solenoid, as detailed later. The actuator 114 may be triggered by a control signal to the solenoid.

A pressure switch 112 may be used to monitor air pressure in the container 104 and to provide a signal when the container 104 is empty or very nearly empty. Alternatively, a pressure switch might be used to measure liquid pressure with corresponding changes in setpoints for assessing liquid conditions. In one specific embodiment, the pressure switch 112 may be an Ashcroft B-Series general purpose pressure switch provided by Ashcroft Inc, of Stratford, Conn., USA. Pressure switches are more suitable than alternatives such as load sensors, due to reduced costs and relative immunity to sediment build-up in the container 104. Further, the pressure switch 112 can be used to monitor pressure variations to ensure rate compliance, as variations in pressure, or without applied air pressure, the pattern is poor and over-spraying could occur.

The vehicle 102 further includes position and automation controls comprising a human interface device or tablet 138, and inputs including a navigation unit 118, a speed indicator 136, pressure switch 12 and a slope measurement unit 134. The tablet 138 includes a control unit 106 for managing inputs and controlling landspraying operations including actuation of the valve 115 and even steering assist 110.

The navigation unit 118 may be a global positioning system (GPS) device, a differential GPS (DGPS) device, a precision GPS (PGPS) device or a similar navigation unit having a corresponding antenna. The speed indicator 136 may be part of the navigation unit 118 or a separate dedicated speedometer with a digital input-output (I/O) interface.

The slope measurement unit 134 may be an inertial measurement device that provides independent measurements of both the roll and the pitch for vehicles. Accordingly, the slope measurement unit 134 may include accelerometers and gyroscopes coupled to a digital signal processor with appropriate I/O interfaces. Digital signal processing algorithms may be used to identify and smooth out minor bumps and depressions from genuine underlying slopes of land surfaces using digital filtering and the like. In other embodiments, measurement unit 134 may alternately be implemented as a modified steering-assist unit, as will be detailed later.

The tablet 138 comprises the control unit 106 and a display 108. The control unit 106 provides automated control of the spraying operation. The control unit 106 may include a general purpose processor 105 interconnected to a block of memory 107 and an interface circuit 120. The memory 107 may include volatile and non-volatile parts that store processor-executable instructions for execution by the processor 105. The stored instructions may, in some embodiments, include instructions for implementing parts of the navigation unit 118. The display 108 is interconnected with the control unit 106. The display 118 may be a touch screen that allows touch based user inputs in addition to its visual display functions. Alternately, a separate keyboard or keypad (not shown) interconnected to control unit 106 may be used for data entry. The tablet 138 can be a hardware unit such as a computer, handheld device, a laptop computer. The tablet may also physically house both the display 108 and components of the control unit 106.

The control unit 106 may further interconnect the steering-assist unit 110, the navigation unit 118, the slope measurement unit 134, the speed indicator 136, and the actuator 114. The control unit 106 interconnects to the solenoid in actuator 114. The control unit 106 can thus automatically open and close valve 115 via actuator 114 by transmitting an electrical signal to the solenoid.

The interface circuit 120 of the control unit 106 may include various specific hardware interfaces for receiving and outputting digital and analog signals. The interfaces may provide specific interconnections to the display 108, the steering-assist unit 110, the navigation unit 118, the actuator 114, the pressure switch 112, the speed indicator 136 and the like. The interface circuit 120 may further include USB interfaces, a wireless interface (such as WiFi or Bluetooth) and other input-output (I/O) interfaces.

The control unit 106 is able to receive data from and send data to the various components of the land spraying system 100 interconnected with it. This allows the control unit 106 to perform various monitoring and control functions. For example, the control unit 106 can determine if the container 104 is empty such as by comparing pressure data from the pressure switch 112 with a predefined minimum pressure. The control unit 106 can determine the speed (or velocity) of the vehicle 102 by receiving data from the speed indicator 136 or navigation unit 118. The control unit 106 may determine its current location by receiving current location coordinates from the navigation unit 118, and may determine the slope at the current location using data from the slope measurement unit 134. Further, as will be detailed later, the control unit can open and close the valve 115 by signalling the solenoid in the actuator 114.

The system 100 further includes management system 210, which can comprise a computing device 124 which may be any one of the commonly available personal computers or workstations having a processor, volatile and non-volatile memory, and an interface circuit for interconnection to one or more peripheral devices for data input and output. Processor-executable instructions, in the form of application software, may be loaded into the memory in computing device 124 to adapt its processor to read an input map 122, to process the map including the overlaying of exclusion shapes and zones, and to output an annotated coordinate map 126. The input map 122 is typically a satellite image, an aerial photograph, a topographical map or the like. Exclusion shapes can be defined by vector graphics and the like, including simple geometric shapes like circles or polygonal representations.

A detailed record of spraying operation by vehicle 102 may be kept by the control unit 106 as a data file 128 for export to and processing by the computing device 124 of the management system 210 and subsequent transmission to a designated reporting database 132 by way of a wide area network 130 such as the Internet. The recorded mapping data can be used to avoid overlaps and may be used to compile formal reports for regulatory compliance and/or for custom internal record keeping.

Figure 2:
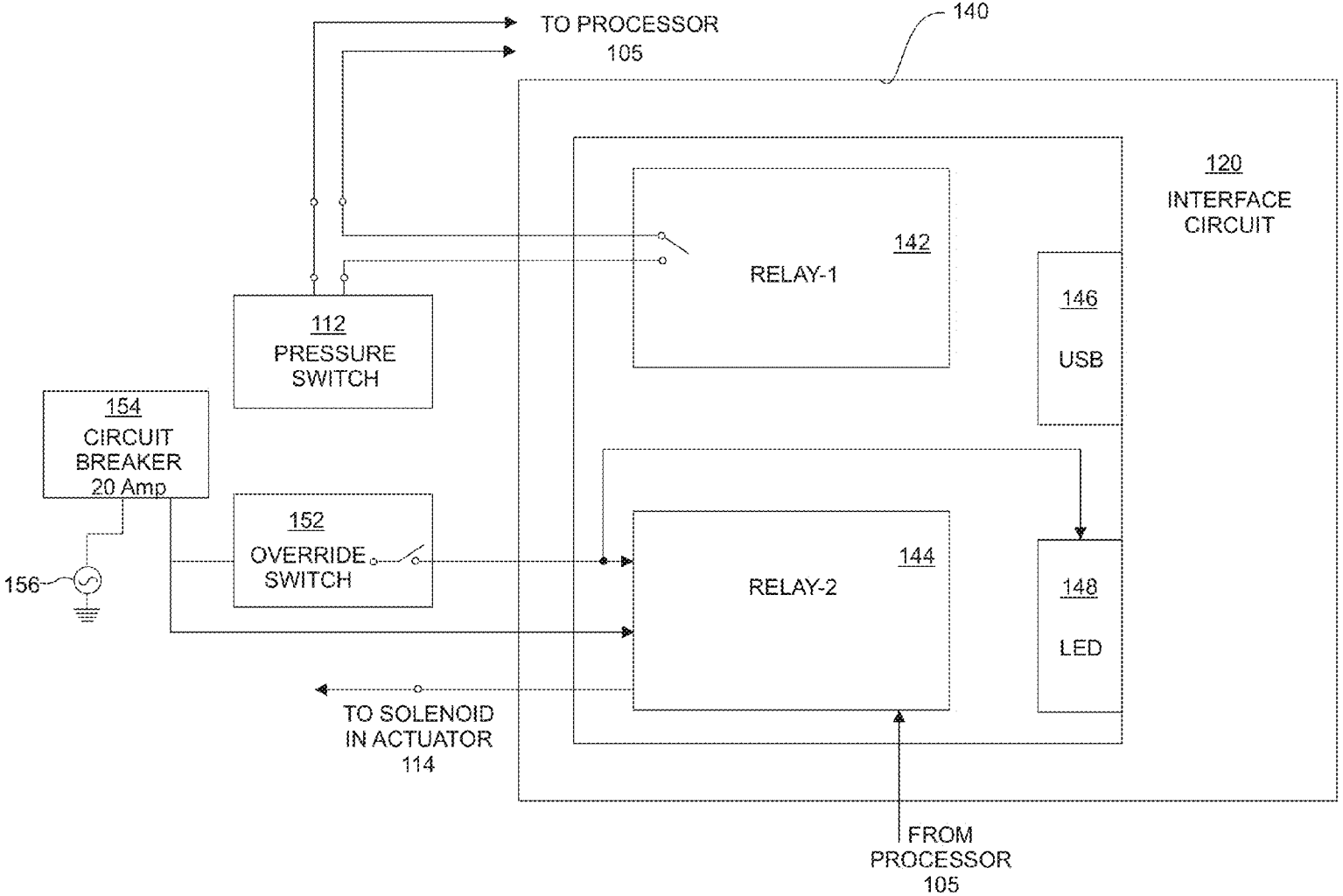

Turning to FIG. 2, an embodiment of an interface circuit 120 between the control unit 106 and the peripherals includes interconnections to one or more USB devices. The interface circuit 120 may include a relay board 140 similar to a JSB-252 USB relay board from J-Works Inc., of Granada Hills, Calif., USA. The relay board 140 may be housed in a separate enclosure. The relay board 140 may have a first relay 142 interconnecting the pressure switch 112 and the processor 105 of control unit 106; and a second relay 144 interconnecting the actuator 114 to an override switch 152. The override switch may be a two position, keyed switch.

A circuit breaker 154 may be used to limit current into relay 144 from a power supply 156. The relay board 140 may also include a USB port 146 to allow a host controller such as processor 105 to perform host control functions, via standard programming languages. The relay board 140 may further include one or more LED indicators 148 to provide status information.

In one embodiment, the first relay 142 relays an electrical signal from the pressure switch 112 to processor 105 whenever the pressure inside container 104 has fallen below a specified threshold, indicating that container 104 may be approaching empty. This allows processor 105 to determine that actual spraying has effectively stopped and thus close the valve 115.

A factor in determining the minimum velocity of the vehicle is based upon specific spray pattern expectations, those spray patterns being affected by the pressure in the tank. Thus, in another embodiment, the first relay 142 relays an electrical signal from the pressure switch 112 to processor 105 to keep valve 115 from opening until a suitable pressure has been created in the tank to ensure complaint spray patterns and prevent overspray.

The second relay 144 may be used to override the signal from processor 105 and to open or close the valve 115 via the solenoid in actuator 114. Of course many alternative implementations for overriding a control signals and for communicating status information will be known to those of ordinary skill in the art. With reference to FIGS. 3A through 3D, an otherwise conventional vacuum truck can be retrofitted for automated landspraying, yet convertible back to conventional uses thereafter. If convertibility is not employed, air and electrical controls would be simplified.

Simply, on/off control of the valve 115 is placed under automated control or manual control. In one mode, the actuator 114 enables the control unit 106 to open and close the valve 115 under automated control for use in landspraying. In a second mode, the control unit 106 is bypassed, such as via keyed bypass switch 152, and the valve 115 is actuated by some other means, such as by direct operator manual control, not related to landspraying use as contemplated herein.

In this landspraying embodiment, the spraying actuator, valves and fully open and fully closed operations are particular suited to waste materials and are merely examples of the types of control that can be managed to meet certain specified criteria and conditions.

Figure 3A:
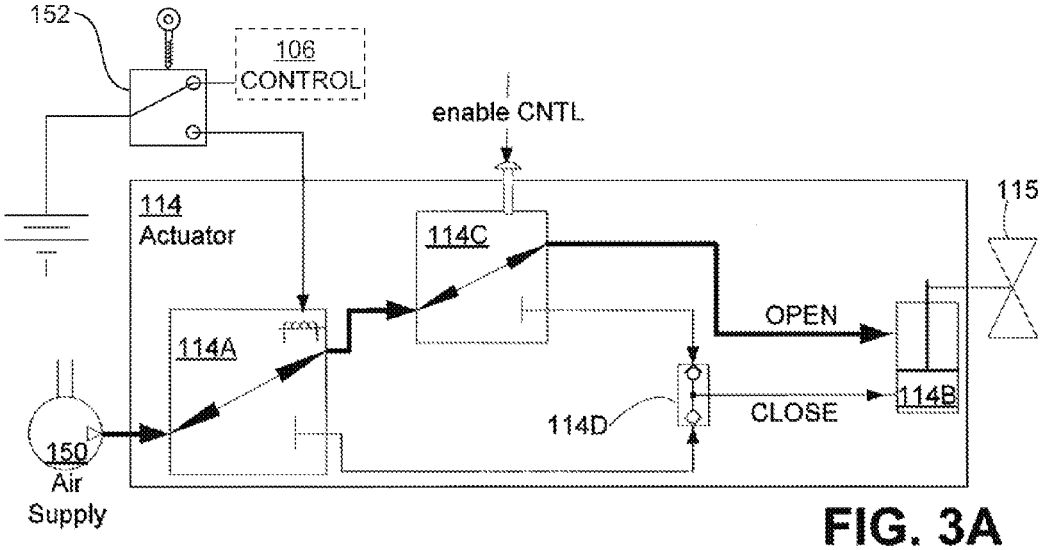
FIGS. 3A-3D are schematic block diagrams of one embodiment of the valve actuator of FIG. 1 illustrating controlled valve operation and operations with control bypassed for manual operation.
Figure 3B:
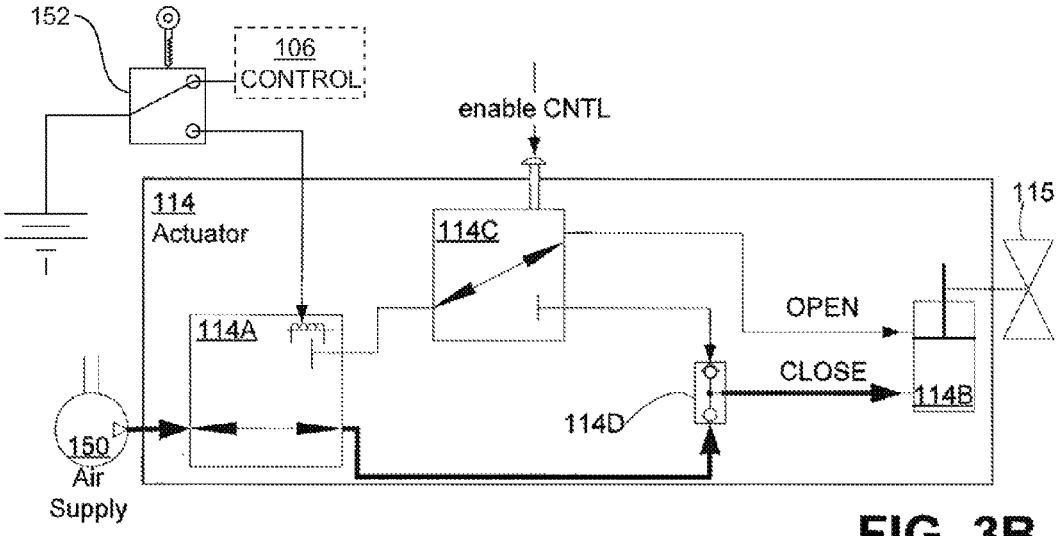

FIGS. 3A and 3B depict one such embodiment of the actuator 114. As shown, the actuator 114 may include a pneumatic-actuated, double-acting cylinder 114B, for manipulating the valve 115, and a spread valve such as an air toggle switch 114C. The switch 114C may be that already available as part of the unmodified vehicle 102, or provided anew as part of this embodiment. For automation, a solenoid-piloted actuator 114A and a shuttle valve 114D are incorporated with the switch 114C and cylinder 114B. An air supply unit 150 such as an air compressor provides compressed air for use by the actuator 114. The cylinder 114B is mechanically coupled to the discharge valve 115. Power is provided for operating electrical components including the solenoid-piloted actuator 114A. A suitable solenoid-piloted actuator 114A is model MAC series 800 by MAC valves Inc., Michigan, US.

With the bypass switch 152 off, the control unit 106 is in control of the solenoid-piloted actuator 114A. When the air toggle switch 114C is open, automated control is enabled. Simply, the control unit 106 controls solenoid-piloted actuator 114A to alternate between directing air through air toggle switch 114C to open the valve 115 (FIG. 3A) and directing air through a closing bypass line to bypass the air toggle switch 114C and close the valve 115 (FIG. 3B). A shuttle valve 114D isolates the air toggle switch 114C from the closing bypass line. In this convertible embodiment, the air toggle switch 114C is a manual spread valve which is always available to manually close the valve 115. In automated control mode, the air toggle switch 114C is left in the open position and control unit 106 can open and close the valve 115 with the air toggle switch 114C in the open position.

As shown in FIG. 3A, the control unit 106 can open and close the valve 115 by sending a signal to the solenoid-piloted actuator 114A. A first output of the air toggle switch 114C connects to a first port the cylinder 114B. A second output port of the air toggle switch 114C connects to the shuttle valve 114D. The shuttle valve 114D interconnects the switch 114C with a second port of the cylinder 114B. With the toggle switch 114C is one or open, air is directed from its input to its first output. Conversely, when the toggle switch 114C is off or closed, the first output is blocked and a second output is opened for manual closing of the valve 115. Toggle switch 114C can thus be used to override control unit 106 and close the valve 115.

The solenoid-piloted actuator 114A has at least one input and two output ports. The air supply unit 150 is connected to the input of actuator 114A and the first output of actuator 114A is connected to an input of the toggle switch 114C. The second output of actuator 114A is connected to another input of the shuttle valve 114D. Electrical input to the actuator 114A alternates directing air from the input port to the first output port to supply switch 114C, and from the input port to the second output connected to the shuttle valve 114D. Not shown in the general schematics of FIGS. 3A to 3D, the solenoid in actuator 114A may be electrically wired through relay board 140 of FIG. 2.

The cylinder 114B is typically a double-acting cylinder having a piston that moves between two positions, the piston being mechanically coupled to valve 115 which is fully open in a first position and fully closed in a second position. Air flow into the first input of cylinder 1148 moves the piston to an open position thereby opening the coupled valve 115. Conversely, air flow into the second input of cylinder 114B retracts the piston back to the closed position, thereby closing the coupled valve 115. In alternate embodiments, the cylinder 114B may be single-acting cylinder having a normally-closed position, spring-biased return. Venting of the opposing cylinder inputs is not detailed.

Figure 3C:
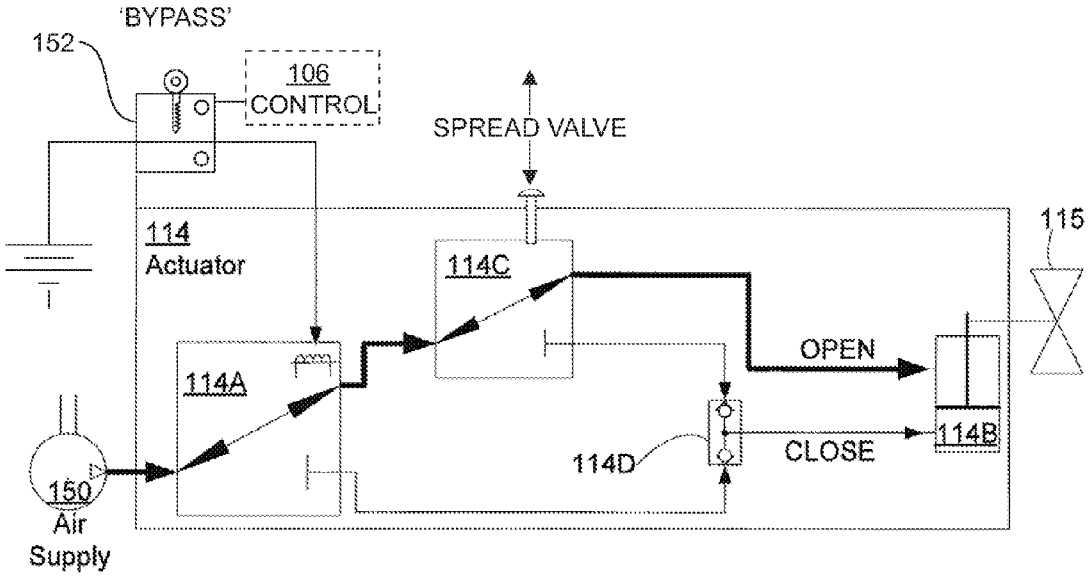

Actual air flow within the actuator 114 is depicted by the thick solid lines in FIGS. 3A-3C. The direction of air flow is indicated by arrows.

In FIG. 3A, the toggle switch 114C is switched on (set to an open or enable position) to enable the control unit 106 to operate valve 115. The control unit 106 signals the actuator 114A to open the valve 115. Accordingly air flows through the first output of the actuator 114A and moves the piston in the cylinder 114B to the open position, thereby opening valve 115. Piston extension and retraction functions may be reversed depending on the mechanical coupling of the valve 155 and cylinder 114B. Typical of double-acting cylinders, extension typically has greater actuating force than retraction and thus one might arrange the cylinder accordingly to advantage.

In FIG. 3B, while the toggle switch 114C remains on or open, the control unit 106 signals the solenoid-piloted actuator 114A to close the valve 115. Accordingly air now leaves from the second output of the actuator 114A, through the shuttle valve 114D, and moves the piston in the cylinder 114B to the closed position, thereby closing valve 115. It is clear from FIGS. 3A-3B, that while toggle switch 114C remains open, the control unit 106 is able to automatically operate the valve 115 via the solenoid-piloted actuator 114A and the cylinder 114B.

Figure 3D:
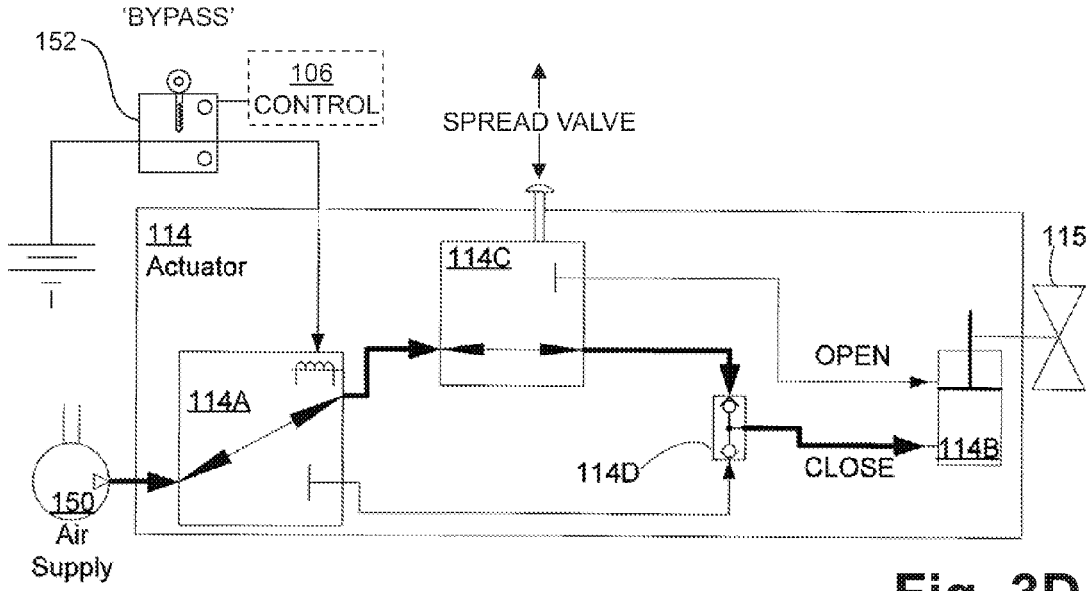

As discussed, the vehicle 102 can be converted to normal operation without having to remove the retrofit components. As shown in FIGS. 3C and 3D, the keyed bypass 152 can be set to disable control unit 106 communication with the solenoid-piloted actuator 114A and instead continuously powers actuator 114A. Accordingly air is continuously directed to toggle switch 114C.

As shown in FIG. 3C, with toggle switch 114C switched on or open, air is directed to open cylinder 114B. As shown in FIG. 3D however, with toggle switch 114C switched off or closed, air is directed through shuttle valve 114D to close cylinder 1148.

As discussed above, the actuator 114 can be used to selectively operate an appropriately equipped vacuum truck either normally via toggle switch 114C or using the control unit 106.

Availability of a bypass could result in inappropriate use. Thus a bypass lockout can be provided. Lockout tags also avoid the overhead associated with issuance and tracking of keys for a keyed bypass. While a keyed bypass can still be used with a lockout tag, a bypass switch also be provided without individual keys and instead lockout tags are used to irreversibly indicate actuation or use of the bypass. The lockout tag can further list appropriate contacts or phone numbers as well as additional contacts for the current technician applied thereon when installing the tag. When the technician arms the system for controlled spraying the lockout tag is installed in such a manner that to disarm would require breaking the tag. This allows for no interruption to a landspraying consultant, can be bypassed without keys, and forces the operator to break a seal to bypass which should encourage the operator to call the contact numbers before bypassing or at least afterwards. Further, regardless of contact, there is evidence the bypass was used.

A person of ordinary skill in the art will readily appreciate that numerous other alternative implementations for the actuator 114 may be used in alternate embodiments of the present invention.

Map Annotation

With reference to FIG. 1, in preparation, an input image or map 122, which corresponds to a land surface to be sprayed with drill waste fluid, may be chosen from an image database 121 of candidate maps. Application software forming part of computing device 124 may be used to retrieve the maps and select a suitable input map 122. The maps in the database 121 may be in the form of satellite images, topographic maps, aerial photographs, or other digital representations of geographical coordinate data.

Figure 6:
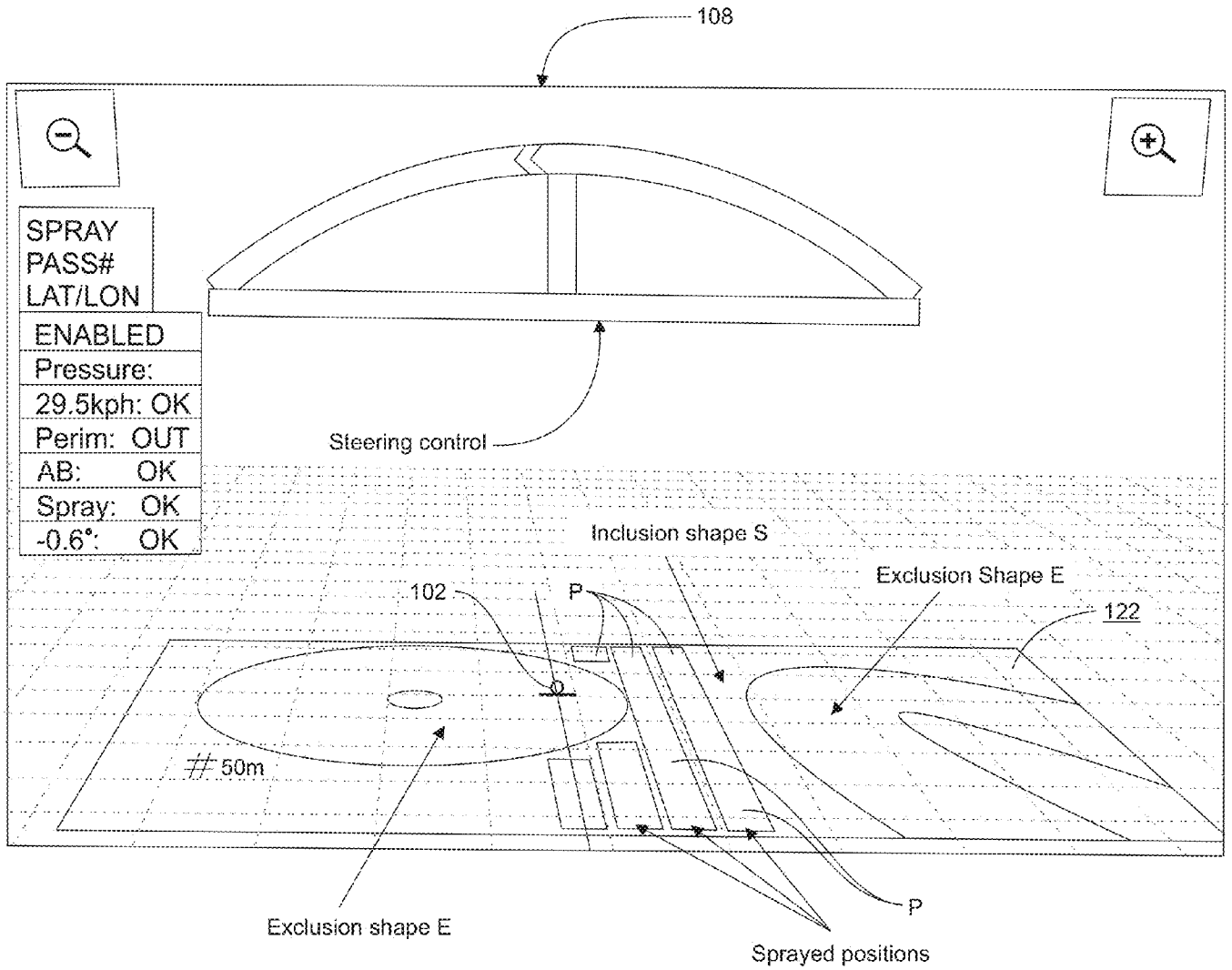
Figure 8A:
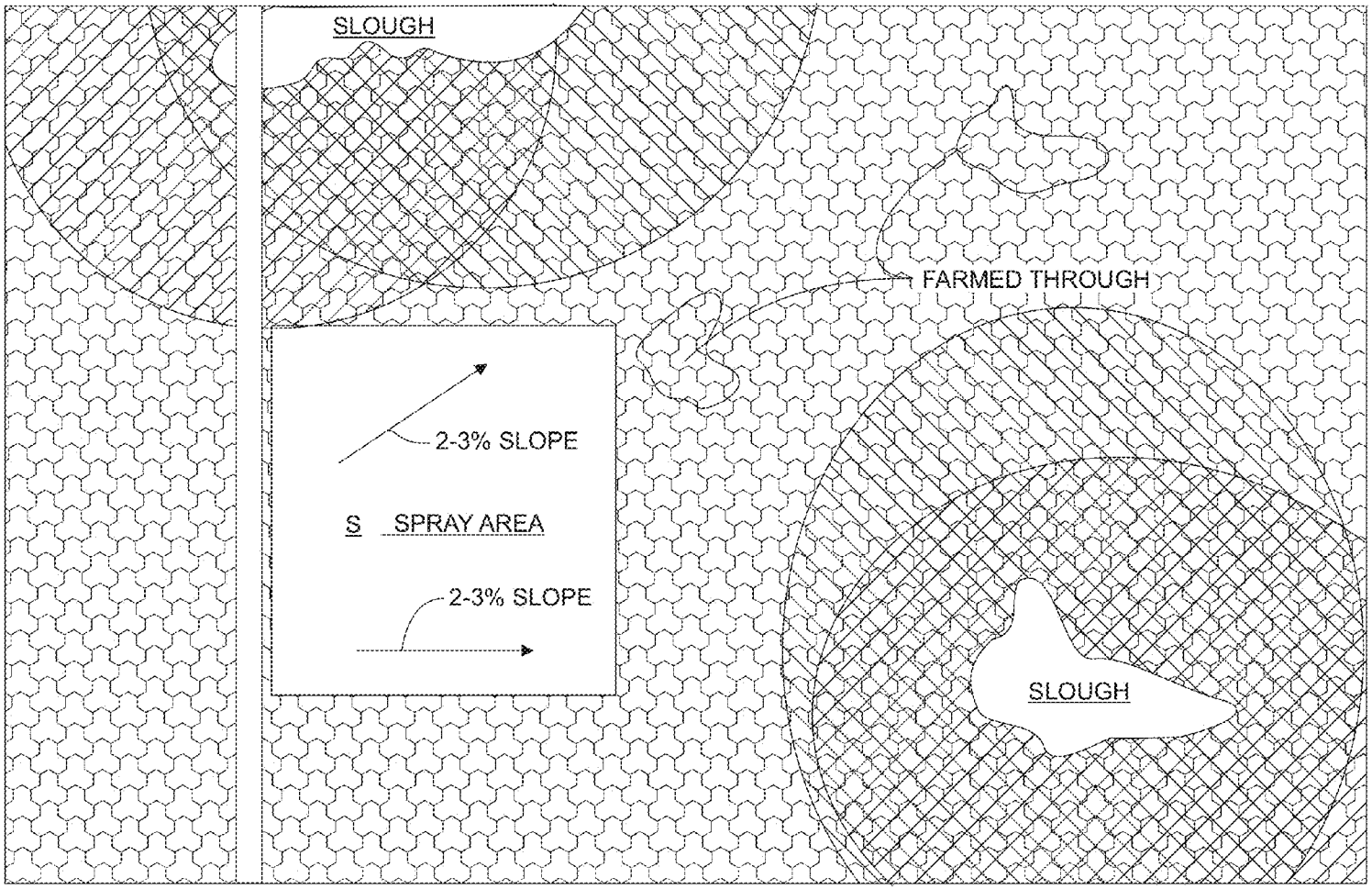
FIG. 8A is a graphical representation of inclusion and exclusion zones overlying a color photograph of a surface including mapping data.

FIG. 6 illustrates a schematic representation of an annotated image integrate with steering control overlaid thereon. FIG. 8A depicts a satellite image annotated with exclusion and inclusion zones. FIG. 8B depicts a report for an example sprayed land surface having a satellite image embedded in a report format annotated with the identified exclusion zones, sprayed paths, sprayed area and various land spraying data.

The selection of a suitable land surface may depend on the net area available for disposal, and proximity to the drill site. Land surfaces situated close to the drill site often result in reduced disposal costs. Accordingly, a search for suitable land may be conducted in an ever-increasing radius starting from the drill site, the source of the waste fluids. Determination of the net area may in turn depend on the volume of waste to be disposed, the maximum allowable spray rate (or maximum fluid application rate), waste fluid chemistry and soil chemistry.

The suitability of the selected land surface may be verified by onsite inspection performed by a technician. Soil samples may be taken for analysis (See FIG. 8B) of applicable spray rates, and physical measurements using laser range finders for example, may be made to confirm the location and perimeters of exclusion zones such as bodies of water.

Once a land surface corresponding to a selected map is verified to be suitable for landspraying, the selected map 122 identifies a plurality of spatial coordinates for the surface. The map 122 may be annotated using the application software executing in the computing device 124. Shapes (e.g., polygons, circles, ovals, etc) are superimposed or overlaid to define boundaries in map 122 that correspond to zones that should not be sprayed called exclusion zones E. The technician may use the software on device 124 to apply the exclusion zone shapes to the map or a separate data file can be used which linked by the geo-coordinates or other coordinate reference for use by the control unit 106.

Figures 6A, 6B:
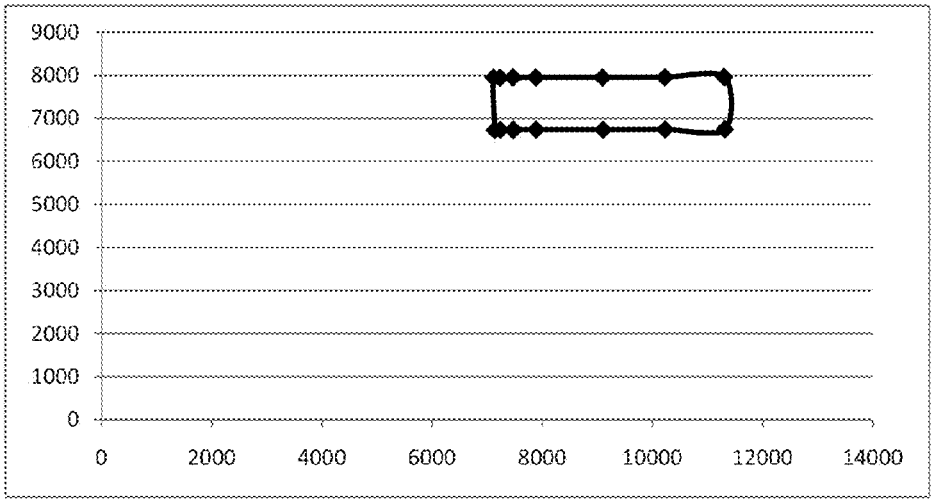
FIG. 6A is sample listing of latitude/longitude GPS coordinates provided as data defining a polygon boundary for an exclusion zone, the actual coordinates having being disguised.
FIG. 6B is a plot of the exclusion zone data of FIG. 6A.

As shown in FIG. 6A, one embodiment for a subset of data that can be provided to define a zone, being an exclusion zone E or inclusion zone S, for annotation of the mapping data is being to list latitude/longitude GPS coordinates which are then in the same coordinate system as the mapping data for accurate superposition thereover. One can see, from the plot of FIG. 6B, that the data of FIG. 6A defines a generally rectangular zone. Further, the data can include whether the zone is exclusion or inclusion, the nature of the zone such as water or obstacle, job and contact details. Besides exclusion and inclusion zone data, one can include projected start, end and path data.

The remaining area of the selected map (outside of the exclusion zones) may be considered allowable or inclusion zones S that may be sprayed. Alternately, inclusion zones S may be explicitly designated and annotated on map 122. Of course, inclusion and exclusion zones S,E may be marked differently, for easy identification by devices and human operators, for example by using different colors or patterns. As shown in the color photograph portion of FIG. 8A, inclusion zone(s) S may be indicated with a yellow or green overlay and exclusion zones E in a red overlay.

Exclusion zones E can simply be boundaries to an identified area including that within a leased or rented land area. Other exclusion zones E, which are typically regulated, can include bodies of water (such as sloughs, dugouts, and ponds shown in FIGS. 8A, 8B), steeply sloped areas that could funnel or concentrate the sprayed fluid to undesirable locations and appropriate safety buffer zones from such sensitive locations. The buffers can be obtained from appropriate regulations and may be dependent on seasonal conditions. For example, under current regulations in western Canada, spraying should not occur within 100 m of a body of water in summer. In winter, that margin doubles to 200 m in part to account for reduced absorption or permeability of the ground, and the potential presence of ice. As may be appreciated, low absorption can result in a rapid runoff of fluid and into surrounding low lying areas including excluded areas or result in overconcentration of waste fluid.

Exclusion zones E may also include other sensitive locations that should not be exposed to the sprayed fluid as specified in relevant government regulations and/or by landowner request. Examples of relevant government regulations include Directive-050 published by the Energy Resources Conservation Board (ERCB) of the Government of Alberta; the Saskatchewan Drilling Waste Management Guidelines (GL99-01) from the Saskatchewan Ministry of Energy and Resources (SMER); Landspraying While Drilling (LWD) Application and Approval Guidelines from the Manitoba Petroleum Branch; and the British Columbia Oil and Gas Handbook from the Government of British Columbia.

The computing device 124 thus outputs the annotated coordinate map 126 which is partitioned into exclusion zones E where no spraying should occur and, by difference, inclusion zones S where spraying may take place.

In one embodiment, the user of computing device 124 may account for safety buffers or margins when marking the exclusion zone E. For example, to protect a pond in the winter, the corresponding exclusion zone E may be drawn to encompass the pond, as well as any point within 200 m from the edge of the pond.

In an alternate embodiment, the user of computing device 124 may simply identify a feature, draw boundaries of the exclusion zones over each feature and let the control unit 106 add the appropriate safety margins prior to opening valve 115 during operation. Such features can include transient presence of equipment, storage of crops, rock piles, well heads and the like.

In one alternate embodiment, such as in cases of missing satellite data or failure of computing device 124, an operator can physically identify exclusion zones on the ground (e.g., using pylons) to outline the boundaries or perimeters of specific land features. The control unit 106 may then be set to a recording mode, where it records current position coordinates, and sprayed position, as provided by navigation unit 118 while the vehicle 102 is driven. The operator may then drive vehicle 102, along particular desired paths while remaining well outside the pylon marked exclusion zones, simulating a spraying dry run while the control unit 106 records coordinates of the paths followed. During the dry run, the valve 115 remains closed and the container 104 may preferably be empty. Thereafter, the container 104 may be filled with waste fluid and the control unit 106 may be used to help the operator of vehicle 102 retrace the recorded path, using automated controls including the steering-assist unit 110, while spraying fluid.

The annotated coordinate map 126 may contain additional data such as slope logs, roads, pipelines, contours, and other geographic information system (GIS) layers. The coordinate system used in coordinate map 126 may be the Latitude/Longitude coordinate system used in GPS devices, the Universal Transverse Mercator (UTM) coordinate system, or another coordinate system.

The annotated coordinate map 126 may be provided to the control unit 106 on the vehicle 102 by way of a USB device attached to a USB port in interface circuit 120 of the control unit 106. Of course other interfaces such as a Bluetooth interface, serial or parallel port interface, Wi-Fi interface, an Ethernet interface or the like may be used by interface circuit 120 of the control unit 106 for I/O purposes.

Calibration

Each vehicle and/or container has different characteristics that affect the spraying operation including frame height, container volume, discharge rate, pressure and the like. Thus, to prepare the vehicle 102 for landspraying, a number of calibration and testing steps may be performed to provide appropriate vehicle-specific parameters for use by control unit 106, to determine if and when spraying should be started, continued or stopped.

For example, depending on the type of valve 115 and actuator 114 used, the signal to open or close may be sent at different times to account for varying delays (e.g., air system delays in pneumatic-actuators) in opening or closing the valve 115 as the vehicle 102 is in motion. Typical delay times of about 4 seconds from actuation have been noted for opening. When closing this time delay was approximately 2 seconds. As a result, a signal to open/close the valve 115 may be issued slightly before the moving vehicle 102 reaches a designated boundary at which it should start/stop spraying. Given a vehicle travelling at speed $V_T$, and a closing air system delay time of $T_C$, the signal to close the valve 115 may be issued at a distance of $D_{CLOSE}=V_T T_C$ before the actual boundary. Similarly, for an opening air delay time of $T_O$, the signal to open the valve may be issued at a distance of $D_{OPEN}=V_T T_O$ before the actual boundary is reached.

As noted above, hydrostatic pressure and applied air padding pressure may be used to expel fluid out of the container 104 through its duct 116. The padding pressure may be dependent on the vehicle 102 and may be set accordingly. For example, a padding pressure of about 12 psig to about 15 psig may be applied for a specific vehicle and container.

The amount of fluid volume $F_v$ discharged per unit time t, out of the duct 116 of the container 104, gives the flow rate C. The instantaneous flow rate may thus be expressed as $C=dF_v/dt$.

An average fluid flow rate may be computed by filling the container 104 with test fluid (e.g., waste fluid, water etc.) of predetermined volume $F_{V1}$ and measuring the time $t_1$ required to discharge it though the duct 116. The applied pressure during calibration should be the same pressure as that which would be used in operation. The average flow rate may then be computed as $C=F_{V1}/t_1$. Alternately, as will be discussed later, a real-time measure for the instantaneous flow rate $C=dF_V/dt$ may be determined during operation.

Referring also to FIGS. 7A-7H, the spray plate 117 of nozzle 200 disperses the fluid in a fan-like shaped manner onto the land surface below with a particular spray width W. The actual spray width W, $W_1$-$W_4$ is affected by different factors including the height of the spray nozzle 200 from the ground, the dimension of the duct 116 and spray plate 117, and the applied pressure in container 104. The spray width W of the test fluid can be obtained by measuring the width of a sprayed path as the vehicle 102 traverses a path while spraying.

The pressure switch 112 may be tested and calibrated by inspecting its pressure reading just before and just after the container 104 empties its fluid contents under combined hydrostatic and applied pressure. In some embodiments, a pressure reading below 7 psig may indicate an empty or nearly empty tank or a potentially unacceptable variability in spray rate.

The navigation unit 118 provides current location coordinates for its antenna or the antenna coordinates. The antenna is typically in a front of the vehicle, adjacent the operator. However, the location of interest for spraying operations is the target or current position on the surface below and typically well-behind the vehicle. To determine the position coordinates for the target position of the spray, the relative location of the target position with respect to the antenna, which may be called the spray-to-antenna offset or spray-to-antenna setback, may be measured. The position coordinates of the target position can thus be obtained by offsetting the antenna coordinates, by the spray-to-antenna offset. A total-antenna-offset parameter may be determined as the greater of the measured spray-to-antenna offset, and the distance travelled during the delay involved in actuating the valve 115 (i.e., $D_{OPEN}$ or $D_{CLOSE}$).

A maximum fluid areal spray rate $R_{MAX}$ may be specified in units of fluid volume per sprayed surface area (e.g., in $m^3/m^2$ or in $m^3/ha$) by a technician, after analyzing applicable regulations, agreements with the land owner, the fluid chemistry and the soil chemistry. The areal spray rate R is the rate of fluid volume $F_v$ sprayed per unit area A of the sprayed surface. The instantaneous areal spray rate may thus be expressed as $R=dF_v/dA$.

Examples of parameters which may be determined during calibration are shown in TABLE I. The measured values listed are of course only exemplary and vary from one vehicle and/or components to another.

TABLE I

| Parameter | Value | Unit |
|---|---|---|
| Volume of container 104 | 19.1 | $m^3$ |
| Spray Width W | 13 | m |
| Time t to empty container | 213.6 | s |
| Delay to open valve 115, DOPEN | 4 | s |
| Delay to close valve 115, DCLOSE | 2 | s |
| Spray-to-Antenna offset | 21 | m |
| Total-Antenna-setback | 21 | m |
| RMAX | 15 | $m^3$/ha |

To ensure that the areal spray rate R does not exceed the maximum areal spray rate $R_{MAX}$, a minimum speed for vehicle 102 can be computed, below which one cannot spray. For a vehicle travelling at speed V (in m/s), with a container having a fluid flow rate C (in $m^3$/s) and a spray width W (in m), the instantaneous areal spray rate R (in $m^3/m^2$) is:

$$R=dF_v/dA=Cdt/(WVdt)=C/(WV).$$

Thus, ensuring that $R<R_{MAX}$ requires that $V>C/(WR_{MAX}) \equiv V_{min}$. The vehicle 102 must maintain a minimum speed of $V_{min}=C/(WR_{MAX})$ before spraying can start or resume, in order to ensure that the spray rate does not exceed the maximum (i.e., $R<R_{MAX}$).

Accordingly, TABLE II depicts an exemplary concordance of spray rates (or fluid application rates) and corresponding minimum vehicle velocities required, for a uniform spray width W=13 m and a fluid flow rate of C=0.09 $m^3$/s. TABLE II further includes offset distances to compensate for delays in closing the valve 115.

TABLE II

| Fluid Areal Spray Rate R ($m^3$/ha) | Speed (km/h) | Doffset to close valve (m) |
|---|---|---|
| 10 | 24.76 | 14 |
| 15 | 16.51 | 9 |
| 20 | 12.38 | 7 |
| 25 | 9.91 | 6 |
| 30 | 8.25 | 5 |
| 35 | 7.07 | 4 |
| 40 | 6.19 | 4 |
| 50 | 4.95 | 3 |
| 60 | 4.13 | 3 |
| 70 | 3.54 | 2 |
| 80 | 3.1 | 2 |

Operations

After calibration, the container 104 may be filled with drilling waste fluid. Vacuum pumps may be used. Other, low cost methods of pumping fluid waste such as the use of impeller pumps are often not suitable due to debris found in drilling waste known as cuttings or shale. Impeller pumps often wear out quickly when used for pumping drilling waste.

The annotated coordinate map 126 is provided to the control unit 106, which may be accomplished via its interface circuit 120 using a USB flash memory, wired or wireless network transmission or the like.

Upon receiving the annotated coordinate map 126, the control unit 106 reads the map or otherwise obtain a digital representation of the surface to be sprayed containing coordinate data (e.g., GPS coordinates). Included therewith or in a separate data file are boundary coordinates identifying exclusion zones E in the surface which are not to be sprayed. The boundary coordinates can be vector data including polygons and the like which are geo-referenced to the geo-coordinates of the image of the surface.

The control unit 106 is used to open and close valve 115 to discharge fluid onto the target surface below, based on a set of conditions, rules, or criteria designed to avoid non-compliance.

Several modes of operation can result in non-compliance. These include spraying into the exclusion zone; spraying too much waste fluid onto an area of the surface (areal spray rate R); spraying onto steep inclines; and spraying onto areas previously sprayed (overlap). The control unit 106 is thus used to avoid non-compliance by automatically preventing any spraying at all unless all rules or criteria for spraying have been met.

Figure 4:
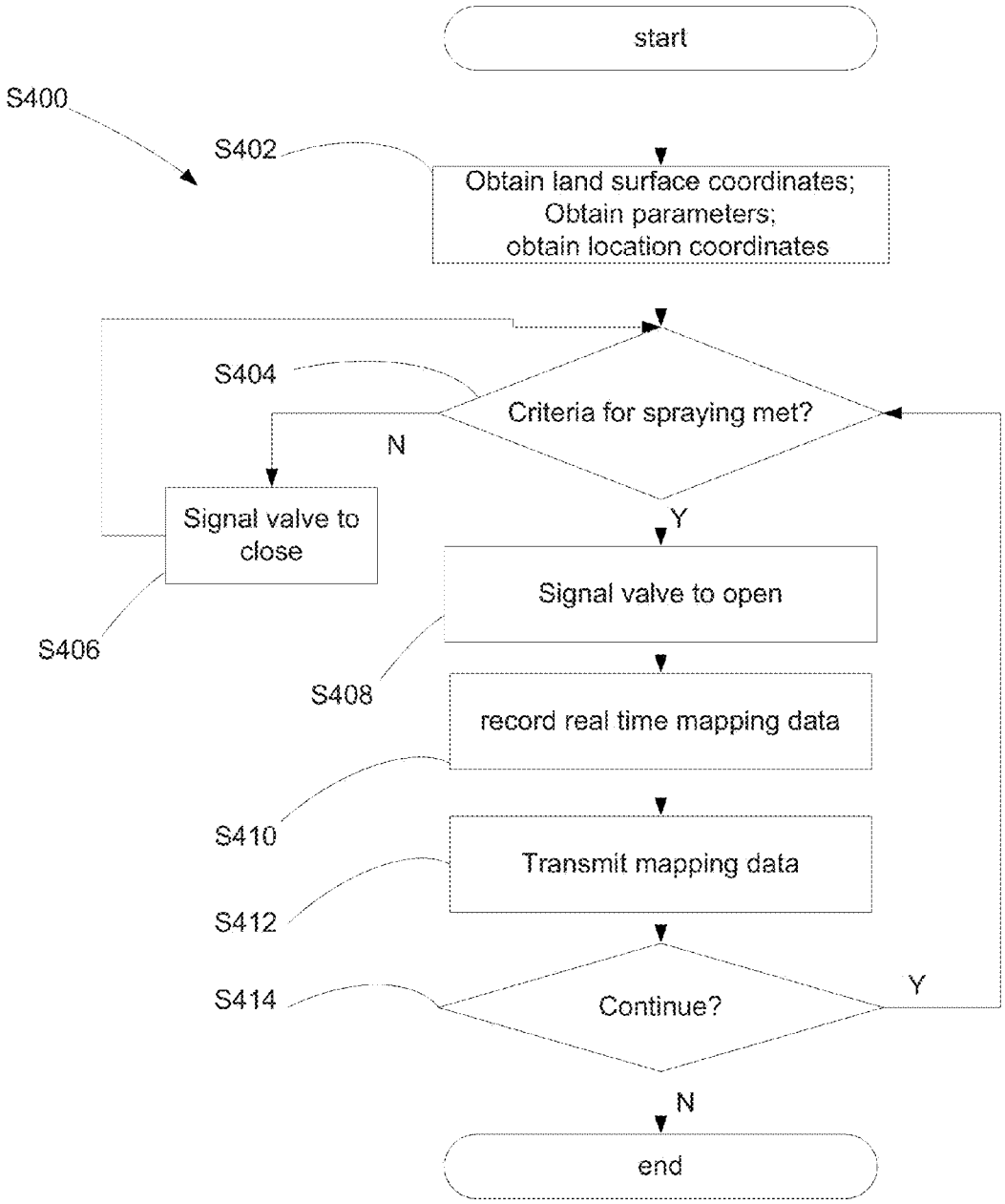

FIG. 4 depicts a flowchart of the basic steps performed by the control unit 106. Initially (step S402) the control unit 106 reads the coordinate map 126 to obtain spatial coordinates defining the land surface to be sprayed, including or accompanied by boundary coordinates identifying and defining one or more exclusion zones E.

The operator of vehicle 102 traverses at least a portion of the surface to be sprayed along a path P. As shown in FIG. 6, the path P, taking the spray width W into account, may be displayed onto the display 108 to assist the operator of the vehicle 102. Exclusion zones E, as well as the current location of the vehicle 102, may be displayed. As shown on FIG. 6, the exclusion zones E are shown as circular, or portions of circular boundaries. Additionally, the steering-assist unit 110 may be fed with corresponding data to provide assisted or automatic steering.

As the vehicle 102 traverses the surface, the control unit 106 obtains the GPS coordinates for its current position from the navigation unit 118 and further obtains threshold parameters determined during calibration to determine if the criteria for opening (or keeping open) the valve 115 are satisfied (step S404). If the conditions for opening the valve 115 are satisfied, such as avoiding exclusion zones, maintaining minimum speed to ensure are spray rates less than a maximum rate, and others including sustaining minimum pressure, the control unit 106 automatically signals the valve 115 to open (step S408).

Otherwise (i.e., if any one of the specified criteria is not met) then control unit 106 automatically signals the valve 115 to close or remain closed (step S406). Criteria determination loops, keeping the valve 115 closed until such time as the criteria are satisfied. No operator input is required to open or close the valve 115. Operator error is virtually eliminated.

Each time the criteria is satisfied and spraying commences, real-time mapping of the sprayed areas can be performed (step S410). The mapping data preferably includes a record of sprayed regions and the corresponding spray rate. The mapping data may also optionally include a record of the terrain (e.g., slope). The data may be optionally transmitted (step S412) to a recipient in real-time.

If the operation is completed (step S414), the process terminates, otherwise it starts back at S402. The conditions or rules or criteria can be varied that must be satisfied prior to opening the valve 115.

Figure 5:
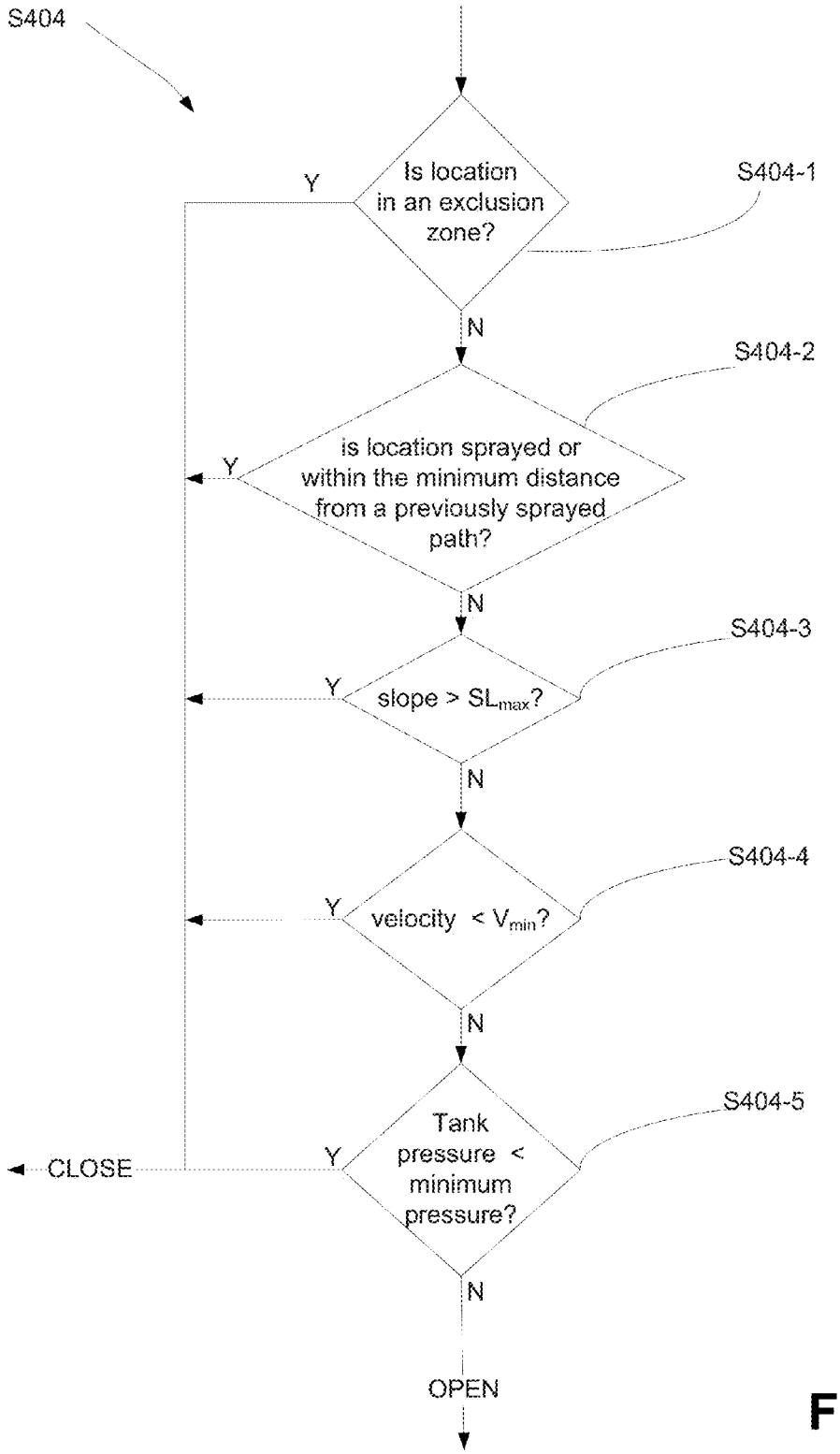

FIG. 5 is a more detailed depiction of various criteria (of step S404 of FIG. 4) according to one embodiment. Having obtained current position coordinates, the control unit 106 may initially check if the current target position to be sprayed is in an exclusion zone using the supplied annotated coordinate map (step S404-1). This may be determined by comparing the current GPS coordinates of the target position (determined from the current antenna coordinates offset by the antenna-to-spray offset), to the boundary coordinates of the exclusion zones obtained by the control unit 106. If the target position is in an exclusion zone, then the criteria for opening the valve 115 are deemed not to have been satisfied.

Further, the control unit 106 may determine if the current target position has been previously sprayed. Automatic spraying only occurs if the current position is not in the record of previously sprayed positions. If the target position has already been sprayed, known from identifying previously sprayed positions in the records, then overlap would occur, the maximum areal spray rate would be exceeded and thus the criteria for spraying would not be satisfied. The control unit 106 may ensure (via steering-assist unit 110) that the target position is at least a minimum distance away (e.g., 50 cm) from a previously sprayed path. This minimizes overlaps. If the current target position is closer than a predetermined minimum distance from a previously sprayed path, or is already sprayed (step S404-2), then the criteria for spraying are not satisfied.

Otherwise the control unit 106 may further determine if the slope (i.e., the pitch or the roll) at the current target position is greater than the maximum allowed (e.g., 5%) (step S404-3). If the slope is greater than the maximum limit, the criteria for spraying are not satisfied.

Otherwise, the control unit 106 may further determine if the speed of the vehicle 102 (indicating the rate of change of the target position for spraying), is above the prescribed minimum speed (step S404-4). If this speed is less than the predetermined minimum speed, then the areal spray rate (the same volume of fluid discharged onto a smaller traversed area) would exceed the maximum areal spray rate $R_{MAX}$, and thus the criteria are not satisfied. As noted above, the predetermined minimum speed is derived from to the maximum desired areal spray rate and other spray characteristics.

Otherwise the control unit 106 may further determine if the pressure in container 104 remains greater than the predetermined minimum pressure required (e.g., about 9 psi) (step S404-5) using the pressure switch 112. A pressure reading less than the predetermined minimum pressure required indicates that the tank is empty or approaching empty, and thus the criteria for spraying are not satisfied. A pressure reading less than the predetermined minimum pressure can also indicate that the spray pattern may no longer be equivalent to that which was used during calibration of minimum velocity, negatively affecting the spray rate.

If each of the required criteria are satisfied, including the pressure being above the prescribed minimum, the control unit 106 has determined that the criteria for opening the valve 115 are met and may signal the solenoid in actuator 114 to open the valve 115. Otherwise the control unit 106 has determined that the criteria for opening the valve 115 are not met and would signal the solenoid in actuator 114 to close valve 115.

Of course other embodiments may include more or less of the conditions outlined in FIG. 5. The set of conditions illustrated in FIG. 5 is only one example, of many possible permutations of criteria or rules may be evaluated by the control unit 106 to determine if the spraying should be started or stopped.

Maximum Areal Spray Rate

The actual spray rate should be monitored to ensure that it is within prescribed limits. Too high a spray rate may result in non-compliance and environmental harm. On the contrary, too low a spray rate would require a much larger land surface to be sprayed for a given amount of fluid resulting in increased disposal costs. The maximum areal spray rate $R_{MAX}$ may depend on seasonal weather conditions. For example the maximum allowed spray rate may be 40 $m^3$/ha in summer, but only 20 $m^3$/ha in winter. These again reflect relative fluid absorption rates of the ground under different seasonal conditions.

As above, a base or average flow rate C for a given container may be computed during calibration, obtained by dividing a known volume of fluid in the container $F_{V1}$ by amount of time $t_1$ required to discharge it. The use of an average flow rate may be adequate in operations where the flow rate C is roughly constant for the duration of the spraying operation. However, in embodiments where flow rate may vary substantially during operation, a real-time measure of the instantaneous flow rate C(t) might also be obtained.

A flow meter, such as an ultrasonic flow meter, may be used to measure the real-time flow rate C(t) as fluid is expelled through duct 116. One form of ultrasonic flow meter, also called an ultrasonic gauge, are known and some of which ultrasonic gauges use a pair of ultrasonic transducers placed outside and on opposing sides of the duct, and spaced axially. In a stationary fluid (i.e., flow rate C=0), the time taken by an ultrasonic pulse to travel diagonally from the first transducer to the second and vice versa should be the same. However, when fluid is flowing, the time taken by the ultrasonic pulse to travel diagonally along the direction of flow would be shorter than the time needed to travel diagonally against the fluid flow in the opposite direction. This difference can be used to determine the fluid flow rate (i.e., the flow rate C(t)). Unlike mechanical flow meters, ultrasonic gauges have the advantage of not interfering with the flow of fluid.

Once the real-time flow rate C(t) is known, the spray width W, the vehicle speed V(t) may be used to obtain the real-time areal spray rate $R(t)=C(t)/[WV(t)]$. The control unit 106 may thus limit the areal spray rate $R(t)<R_{MAX}$ by ensuring that the speed $V(t)>C(t)/[WR_{MAX}]$ while spraying.

The areal spray rate R may be mapped by the control system 106. Given a real-time logs (digital samples) of the flow rate $C_i$ (from the flow meter) and the vehicle speed $V_i$ (from the speed indicator 136) at small intervals of time $\Delta t_i$. The real-time spray rate may be logged as $R_i=[C_i]/[WV_i]$.

In addition to the flow rate C, the spray width W may also vary during operation depending on parameters including waste fluid and nozzle characteristics. Further, even once basic characteristics are set, additional variations can be introduced in operation due to: orientation of the spray plate 117, the height of nozzle or the spray plate 117 from the ground surface, and the tilt of container 104. The minimum speed may $V_{min}$ therefore change as the spray width W changes.

FIGS. 7A-7D depict schematic diagrams of a vehicle 102' with the nozzle for container 104', i.e., the duct 116' and spray plate 117', at its rear. The vehicle 102' may be substantially the same as the vehicle 102 of FIG. 1. FIGS. 7E-7H depict plan views of the spray from container 104' corresponding to the FIGS. 7A-7D respectively.

With reference to FIGS. 7A and 7E, in FIG. 7A the container 104' lies in a horizontal position on the vehicle's frame with its spray plate 117' oriented upwardly at a height of $H_1$ from the ground, forming an upward orientation angle $\alpha=\alpha_1$ with the horizontal plane. The arrangement in FIG. 7A corresponds to a spray width of $W_1$ depicted in FIG. 7E.

Figure 7B:
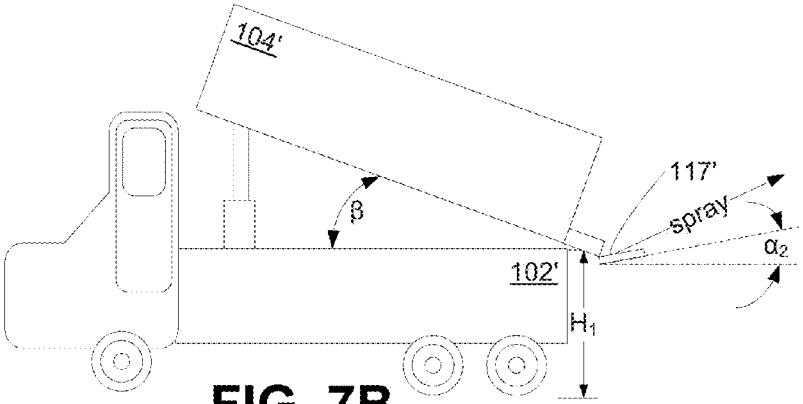
Figure 7F:
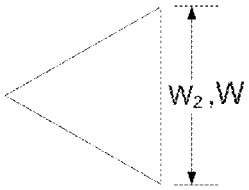

With reference to FIGS. 7B and 7F, in FIG. 7B, the container 104' is in a tilted position (indicated by the tilt angle β) with its spray plate 117' at a height of $H_1$ from the ground, tilting the spray plate 117' to form a shallower angle $\alpha_2<\alpha_1$ with the horizontal plane. The arrangement in FIG. 7B corresponds to a spray width of $W_2$ depicted in FIG. 7F.

Figure 7C:
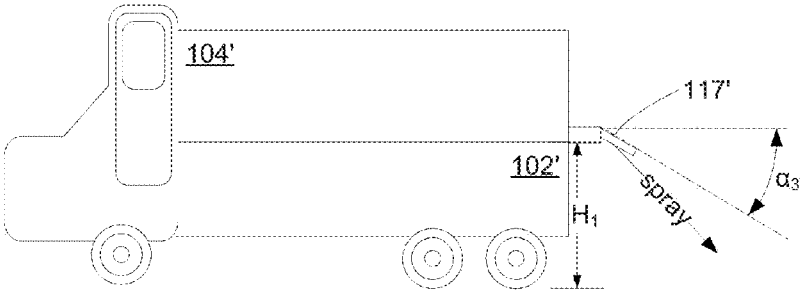
Figure 7G:
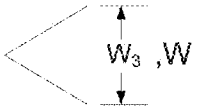

With reference to FIGS. 7C and 7G, in FIG. 7C, the container 104' is in a horizontal position as in FIG. 7A but the spray plate 117' is oriented downwardly to form an angle $\alpha_3$ below the horizontal plane. The arrangement in FIG. 7C corresponds to a smaller spray width of $W_3$ depicted in FIG. 7G.

Figure 7D:
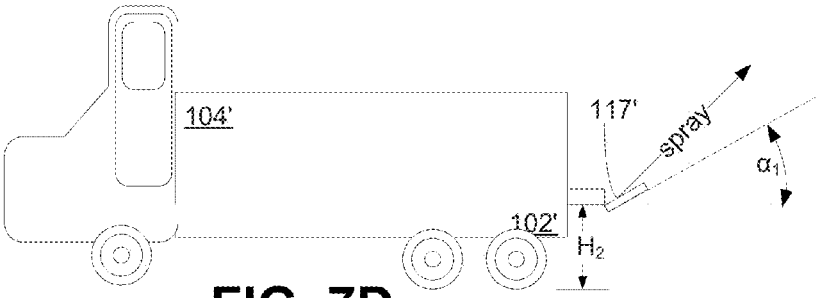
Figure 7H:
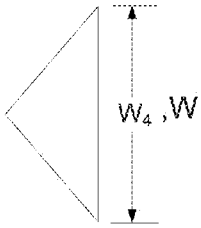

With reference to FIGS. 7D and 7H, in FIG. 7D, container 104' is again in a horizontal position as in FIG. 7A and is once again positioned to form an angle $\alpha_1$ with the horizontal plane. However, the container 104' is loaded on a lower truck frame, and the spray plate 117' is at a lower height of $H_2<H_1$. The arrangement in FIG. 7D may thus correspond to a spray width of $W_4$ depicted in FIG. 7H.

As shown in FIGS. 7E-7H, the spray width W may depend on the orientation angle α of the spray plate 117' and the height h of the spray plate 117' from the ground. Additionally the spray width may depend on the tilt angle β of container 104' as shown in FIG. 7B. The spray width may thus be described as a multivariable function $W=W(\alpha,h,\beta)$.

The spray width dependence on α, h, β may be described as a table of values determined during calibration. The calibrated values may be used to compute an accurate spray rate. For example, as the spray width is reduced from $W_1$ to $W_2$, it is necessary to increase the minimum speed $V_{min}$ of vehicle 102' (from $C/[W_1R_{MAX}]$ to $C/[W_2R_{MAX}]$), in order to ensure that maximum areal spray rate $R_{MAX}$ is not exceeded.

In alternate embodiments, it may be desirable to increase the efficiency of spraying—i.e., increase the areal spray rate R as close to the maximum rate $R_{MAX}$ as possible without exceeding $R_{MAX}$. Accordingly, the control 106 with possible use of steering-assist unit 110 may decrease the speed of vehicle 102, in response to either a reduced flow rate or an increased spray width, to boost spraying efficiency while maintaining a compliant spray rate below the maximum spray rate.

Overlap and Sloped Terrain

Discussion of overlap of spraying and spraying management on sloped surfaces or inclines, discussed in detail in Applicant's copending application, is omitted herein.

Remote Monitoring

The control unit 106 may record or map various data including vehicle location, vehicle speed, spray rate, and the like in mapping data file 128. A record actual spray rates and locations where fluids are applied can be used to demonstrate compliance with applicable regulations, and commercial agreements with landowners.

As noted above, upon receiving a signal from pressure switch 112, the control unit 106 determines that there is little or no fluid left to spray, regardless of the status of valve 115. This helps prevent areas from being erroneously logged as having been sprayed, when the container is empty even if the valve 115 may be open.

The control unit 106 may store its real-time mapping data file 128 locally, or provide it to a remote computing device for real-time monitoring (see S412 in FIG. 5).

Accordingly, one alternate embodiment of system 100 may include a wireless data communication antenna (e.g., Wi-Fi antenna, Bluetooth antenna) attached to a wireless port in interface circuit 120. The control unit 106 may thus transmit real-time mapping data to a remote computer located at a remote site using the data communication antenna. Real time mapping data may be encapsulated and transmitted as extensible mark-up language (XML) data, using web-services or using proprietary formats and network transport protocols. Further, alerts can be transmitted including that the system was bypassed alerting the need for system troubleshooting.

In one specific embodiment, a nearby gateway device such as a wireless router or a nearby computer, in wireless communication with control unit 106, may receive real-time mapping data and retransmit it to across a wide area network 130 such as the Internet, to a remote monitoring device, via a modem such as a cable modem, a DSL modem, ISDN modem, a dial-up modem, satellite modem or the like.

In a variation of the above embodiment, the control unit 106 may optionally receive control commands and data (e.g., in XML format) sent from a remote computer. Control unit 106 may interpret control commands and parameter data, and locally execute the commands (e.g., to stop spraying altogether, to change a particular threshold parameter value, update a map, etc). Such capabilities may be used to remotely override spraying operations in case of an emergency; or to update a few parameters on an already calibrated vehicle.

The system 100 may be used compile reports as required by applicable regulations. The mapping data file 128 may include graphical reports on sprayed surfaces as depicted in FIG. 8. In addition, a concordance of spray rates and slope data may be provided along with the graphical representation. A final map of activity depicting detailed information interspersed within the photographic map (e.g., satellite image) of the land surface sprayed may be produced by device 124 as depicted in FIG. 8B. The information may include, for example, waste generator licensee, unique drilling location identifier, surface location of the waste generating site, well license number, name of technician, the disposal location, the ground and/or soil condition, the type of land, landowner information, source water chemistry, source water location, soil sample data, GPS coordinates and drilling waste, soil and source water salinities/chemistry, owner information, various compliance flags, and the like.

In addition to the final map of activity, the computing device 124 may also compile detailed reports on fluid waste chemistry's, analyse loading rates, total analyse loads, calculated spray rates, and all other data applicable for regulatory compliance and good record keeping practices. Customized reports may be generated for internal purposes landowners, clients, regulatory agencies and the like.

Kit

In one alternative embodiment of the present invention, components for retrofitting a vehicle may be provided in kit form. A kit can be provided to reliably and conveniently retrofit a vacuum truck so that it can be used for landspraying. The vacuum truck may already have container with a pneumatically actuated discharge valve (similar to valve 115 coupled to cylinder 114B), or will be fitted with one as required herein.

A typical vacuum truck will have a remote-actuated on-off (open-closed) dump valve. A kit will interject into the on/off control for the existing dump valve, or it absent, provide a valve, duct and nozzle. Accordingly, a typical kit for retrofitting a vehicle for use in landspraying, may include provision of control unit 106, and navigation unit 118 and an automation or kit interface to enable both controlled landspraying pursuant to embodiments disclosed herein, and manual operation according to the original uses of the vehicle.

The control unit 106 can include the touch-screen display 108. The navigation unit 118 may include an antenna, an antenna cable for interconnecting the antenna to the unit, and an antenna mount (e.g., magnetic mount). The kit may also include various connection hardware including a plurality of pipes such as plastic air lines, and a variety of fittings or interconnects. The fittings may include push-in and/or threaded connects.

The kit may also include some or all of the actuator assembly 114 including the solenoid-piloted actuator 114A and the shuttle valve 114D. The kit may also include the fluid pressure switch 112 and relay 142. If not already supplied on the vehicle, or unsuitable for integration, the air toggle switch 114C is also provided.

The kit may additionally include a weather proof box for housing the assembled components; a breather vent; and a plurality of framing nuts. The kit may include relay 144, a relay cable, the lockable override switch 152, LED 148 and circuit breaker 154. The kit may also include a variety of electrical connection conveniences including a relay harness, a strain relief, a plurality of crimp and shrink ring connectors and a terminal block.

The kit may further include an adapter and actuator connector between the actuator 114 and valve 115.

The kit may further include a vehicle-specific steering-assist unit 110 and a cable for interconnecting steering-assist unit 110 to the control unit 106.

In some embodiments, a basic kit may be provided without control unit 106 and display 108. Accordingly, a vacuum truck retrofitted using the smaller kit without the control unit 106 and the display 108, may be operated in manners exemplary of the present invention by temporarily acquiring a tablet device, such as hardware unit 138 that includes both control unit 106 and display 108, by way of a lease or rental arrangement.

As noted, the retrofitted truck may contain a discharge valve like valve 115 with an actuating mechanism similar to double-acting cylinder 114B. If not, in some embodiments, the cylinder 114B and the valve 115 may be included in the kit, to adapt a container for landspraying use. A nozzle, such as in the form of a standardized duct 116 and spray plate 117, may also be included in the kit. Standardization can assist in simplifying calibration and range of control issues. Yet other embodiments may also provide the container 104, and air supply unit 150 to upgrade an ordinary truck for landspraying use.

The components in the kit may, of course, are only exemplary and in no way limiting. In alternate embodiments, the kit may use hydraulic actuators or electric actuators and/or pneumatic actuators to actuate the valve.

The memory 107 of the control unit 106 may be preloaded with processor-executable instructions adapting the control unit 106 to operate as described herein for automatic control of the spraying operation of system 100.

Alternately, the kit may include firmware on a processor readable medium such as a USB memory stick, for loading into memory 107.

In addition, the kit may include an application software program, provided on a processor readable medium such as a CD, DVD, flash memory, USB memory stick or the like. The application program contains a set of processor-executable instructions for loading to a generic computing device (such as device 124). The set of instructions adapt the computing device to accept an input map representative of a surface to be sprayed, and to outline exclusion zones on the input map, to form an annotated coordinate map for use by the control unit 106. Installation and use instructions for the software may also be provided on the CD or optionally as a booklet.

As may now be appreciated, embodiments disclosed herein provide a robust regulatory compliance management system and an accurate drill waste fluid disposal data collection. Powerful mapping functions and controls automate much of the process involved in landspraying and reporting, thereby reducing human error. Reliable data can be provided to various stakeholders including governments, residents, land owners and businesses in the extractive industries involved in the disposal of drilling waste.

Reducing human error may lead to significant economic benefit. The cost of non-compliance can range from about $5,000 CDN to more than $25,000 CDN per failure in follow up assessments, reclamation efforts and possible monetary fines. With about 20,000 qualifying wells drilled yearly in Alberta, Canada alone and, as applicant understands it, at an projected rate of 12% of disposals being at high risk, that is over 2000 potential case of non-compliance annually.

Further advantages include improvement to the health and safety of drivers and protection of communities where waste fluid is sprayed. Driving safety is improved due to the visual guidance provided in on display 108, which could greatly aid night time driving. Furthermore, steering-assist unit 110 provides additional assurance against potentially unsafe excursions, overlaps and non-compliance events.

As may be recalled, conventional methods involve physically marking exclusion and/or inclusion zones with pylons and instructing operators to remain outside of exclusion zones during the spraying operation. Preparation and subsequent operations under these conditions contributes to driver fatigue and generally increases stress associated with operating the vehicle.

In contrast, embodiments disclosed herein reduce fatigue and stress by allowing the operators of vehicle 102 to concentrate primarily on driving. The spraying operation is automatically controlled by the system and the operator is relieved from tasks associated with starting and stopping spraying operations, looking for pylons and other markers and the like. Moreover, steering-assist unit 110 may help avoid collisions and accidental incursions into excluded zones.

Although embodiments discussed above involve the use of land vehicles, other embodiments of the present invention may be adapted for use in aircraft and other traversing vehicles. An aircraft quipped with a navigation system, may carry a fluid filled container to spray a land surface at low altitudes. For example embodiments of the present invention may be used to dispense pesticides, or combat forest fires from helicopters. Embodiments of the present invention may also have maritime applications. The fluid container may be carried by a vessel. Examples of maritime application may include spraying oil dispersants into oceans after accidental oil spills during transport or offshore exploration. Further, municipalities may use it for mapping bio-solids application to farmland, application of oil, calcium chloride, or other amendments to public roads and so forth, tracking rates and mapping applied areas. Intensive livestock operations could also use the product to map the application of manure and so forth which, in the case of the hog industry, also use similar vacuum-type vehicles to convey and spray liquid manures.

Using embodiment herein result in fewer non-compliance events and any occasional events of non-compliance are recorded and documented for ease of identification and remedy. This reduces the amount of effort related to investigations of non-compliance.

In a variety of additional embodiments, one can find:

A kit for retrofitting a vehicle for use in spraying fluid onto a surface, said vehicle having a container mounted thereon, the container having a valve to control fluid discharge, said kit comprising: an actuator assembly; a navigation unit; a control unit comprising: a processor in communication with memory, an a control unit comprising a processor in communication with the navigation unit, the actuator; and memory storing processor-executable instructions adapting the control unit to: obtain a plurality of coordinates of the surface including boundary coordinates defining exclusion zones which are not to be sprayed; determine position coordinates for a spraying target position on the surface from the navigation unit; determine whether the target position is outside the exclusion zones by comparing the position coordinates with the boundary coordinates; obtain a spray width W, a flow rate C, and a predetermined maximum spray rate RMAX for fluid sprayed from the container, to determine a minimum speed Vmin=C/(WRMAX) for the vehicle; and automatically signal the actuator to open the valve only if the target position is outside the exclusion zone and V>Vmin; and otherwise signal the actuator to close the valve; and a plurality of interconnects for connecting the actuator to the valve; and for interconnecting the control unit to the actuator and the navigation unit.

In the kit, the actuator assembly comprises a solenoid-piloted pneumatic actuator for opening and closing the valve, the solenoid-piloted actuator electrically coupled to the control unit for receiving the signalling from the control unit to alternately open the valve, and close the valve. In the kit the actuator assembly further comprises: an air toggle switch having a first output connected to the valve to open the valve and a second output connected to the valve to close the valve; and a shuttle valve connected between the second output and the valve an connected between the solenoid-piloted pneumatic actuator and the valve; and wherein the solenoid-piloted pneumatic actuator receives the signalling from the control unit to alternately direct air to the air toggle switch for opening the valve, and direct air to the shuttle valve to close the valve. The kit further comprises a relief valve to maintain pressure in the container below a predetermined maximum pressure. A control unit for controlling spraying of fluid from a container to a surface, can comprises: a processor; an interface circuit coupled to the processor, providing interconnections to a navigation unit, and an actuator for a valve controlling spraying from the container; memory in communication with said processor, storing processor-executable instructions adapting said processor to: obtain a plurality of coordinates of the surface including boundary coordinates defining exclusion zones which are not to be sprayed; determine position coordinates for a spraying target position on the surface from the navigation unit; determine whether the target position is outside the exclusion zones by comparing the position coordinates with the boundary coordinates; obtain a spray width W, a flow rate C, and a predetermined maximum spray rate RMAX for fluid sprayed from the container, to determine a minimum speed Vmin=C/(WRMAX) for the vehicle; and automatically signal the actuator to open the valve only if the target position is outside the exclusion zone and V>Vmin; and otherwise signal the actuator to close the valve.

A computer readable medium is provided for storing processor-executable instructions for loading into a memory of a control unit, for use in spraying a surface with fluid from a container mounted on a vehicle, the control unit having a processor in communication with a navigation unit, an actuator actuating a discharge valve in the container and the memory, the instructions adapting the control unit to: obtain a plurality of coordinates of the surface including boundary coordinates for the exclusion zones; determine position coordinates for a spraying target position on the surface, from the navigation unit; determine whether the target position is outside the exclusion zones by comparing the position coordinates with the boundary coordinates; obtain a spray width W, a flow rate C, and a predetermined maximum spray rate RMAX for fluid sprayed from the container, to determine a minimum speed Vmin=C/(WRMAX) for the vehicle; and automatically signal the actuator to open the valve only if the target position is outside the exclusion zone and V>Vmin; and otherwise signal the actuator to close the valve.

Water and Sump Management

In this embodiment, the vehicle and associated container used for fluid loading and unloading typically has one or more transfer pumps for intake and discharge and has the fluid container mounted thereon.

Fluid intake capability includes gear pumps or vacuum pumps and the like adapted for the particular form of fluid or liquid. Drilling muds can contain various sizes of debris and appropriate pumps, such as waste or vacuum pumps are provided. A pumping unit can be provided to fill the container which is separate from that used to empty the container. No discharge pump is required when gravity is sufficient to ensure unloading, such vehicle using a discharge valve to control fluid discharge.

In a water embodiment, a versatile water pump, such as a gear pump, can be used for both intake and discharge, the operation of the water pump being controlled by the management system to ensure compliance. Many water trucks are already equipped with a gear pump for both intake and discharge, minimizing fabrication and retrofit. Discharge may be by spray bar such as for ice roads and dust suppression, or by bulk hose for filling tanks. Intake is typically screened, and may be required under a water use license.

As before, for landspraying operations, the vehicle includes an actuator for a fluid control device (such as a linear actuator for a valve, solenoid for a flow line, or electrical interlock); a navigation unit; a control unit comprising: a processor in communication with memory, and a control unit comprising a processor in communication with the navigation unit, the actuator; and memory storing processor-executable instructions adapting the control unit to: obtain a plurality of coordinates of the surface including geo-perimeters boundary coordinates defining inclusion or exclusion zones; determine position coordinates for a spraying target position on the surface from the navigation unit; determine whether the target position is inside or outside the appropriate inclusion or exclusion zones by comparing the position coordinates with the boundary coordinates. A plurality of interconnects or components connect the actuator to the valve and interconnecting the control unit to the actuator and the navigation unit.

One or more flow meters are provided for determining if a pre-determined volume of fluid has been received, or discharged according to the transfer scenario. Again, the control unit may record or map various data including vehicle location, zones visited, and volume of fluid drawn and discharged at respective zones. A communication system for each truck is in touch with a central database for recording cumulative volumes and other activity, ensuring that multiple trucks' activities, cumulatively, do not exceed the job parameters.

Having reference to FIGS. 9A through 9D, in a sump embodiment, drilling fluids, liquid and waste is typically stored temporarily on-site in pits or sumps. Sumps are earthen excavations on the well site or at a remote site and are subject to various restrictions. Restrictions include limiting content to non-hydrocarbon-based drilling wastes, drilling wastes that originate only from that site, sump construction requirements and limitations on reuse. Alberta regulations impose reporting obligation which can include post-disposal information identifying the drilling waste volumes generated, storage systems used, disposal methods used, and locations of disposals. On site operations are also concerned with fluid contamination, such as disposal of used mud into a clean mud pit.

In sump management, similar to water management embodiments, the control unit operates the intake and discharge control to manage location for loading fluids, permitted volumes and discharge locations being based on safety, environmental regulatory criteria and proper site control to avoid contamination. The control unit makes use of various parameters to evaluate if compliance criteria are met before and during sump fluid control. The system assists the operator of the vehicle by providing automated control, and can further provide visual guides (such as locations and running volumes), and steering guidance for the vehicle as needed.

As shown in FIGS. 9A through 9D, fluids are transferred within a lease, a first loading perimeter 90 being formed about the drill site shown as including a mud tank 92 and water tank 94 and a first unloading perimeter 96 about a specific use or destination.

Figure 9A:
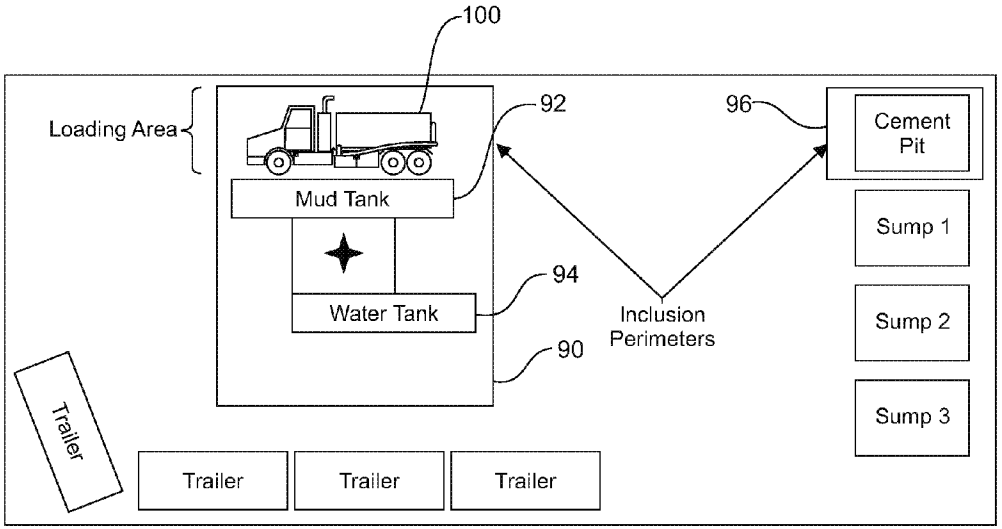
FIG. 9A is a schematic plan view of a site illustrating a first transfer scenario (Job 1) for the transfer of cement returns from an on-site source, such as the rig, to a specified on-site cement pit, other pits which are excluded and being outside the inclusion zone for the scenario including pits for gel chem mud, hydrocarbon impact Mud and polymer Mud.

In FIG. 9A, the first unloading perimeter 96 is a sump designated as a cement pit. In this scenario, three sumps are in exclusion zones, outside the inclusion perimeters 90,96. Accordingly, cement returns from a well completion job can be loaded in a truck 100 from the first loading perimeter 90, as restricted by the truck's navigator, and can only unload to the cement pit within the first unloading perimeter 96. There may be additional unloading perimeters designated for cement returns (not shown).

Figure 9B:
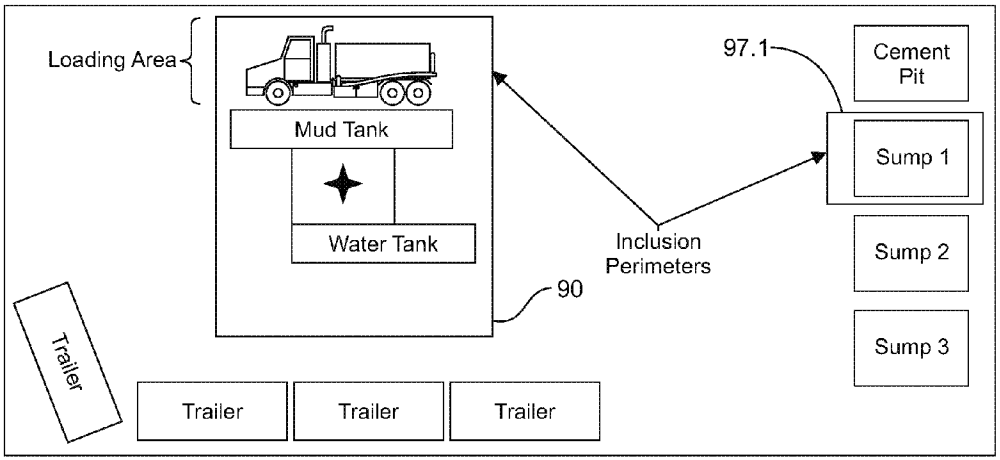
FIG. 9B is a schematic plan view of a site illustrating a second transfer scenario (Job 2) for the transfer of specified drilling fluids from an on-site source to a specified on-site pit, for example drilling mud to a drilling mud sump 1.
Figure 9C:
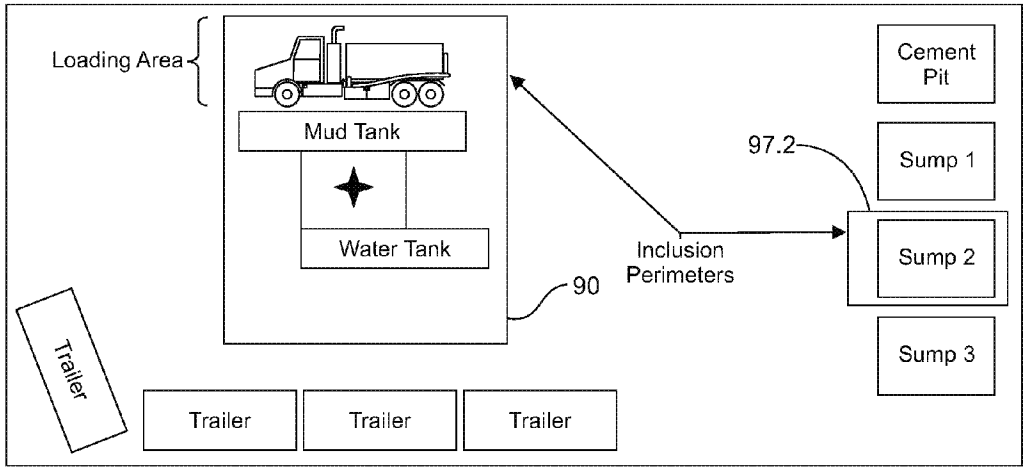
FIG. 9C is a schematic plan view of a site illustrating a third transfer scenario (Job 3) for the transfer of specified drilling fluids from an on-site source to a specified on-site pit, for example drilling mud to a drilling mud sump 2.
Figure 9D:
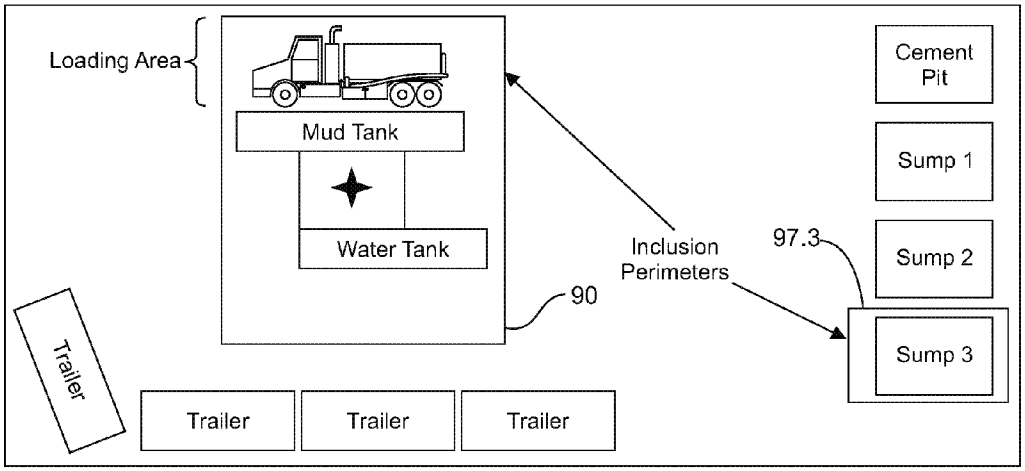
FIG. 9D is a schematic plan view of a site illustrating a fourth transfer scenario (Job 4) for the transfer of specified drilling fluids from an on-site source to a specified on-site pit, for example drilling mud to a drilling mud sump 3.

Similarly in FIGS. 9B, 9C and 9D respectively, unloading perimeters 97.1, 97.2, 97.3 are defined about sumps 1, 2 and 3. For example, specified drilling fluids, such as drilling mud, can be loaded from the first loading perimeter 90, from the mud tank 92, and unloaded at sump perimeter 97.1 of one or more of the three sumps. The navigator and control system would prevent unloading of drilling mud into the cement pit, as the cement pit is not within an inclusion zone or within unloading perimeter 96 for the specified fluid.

Figure 10A:
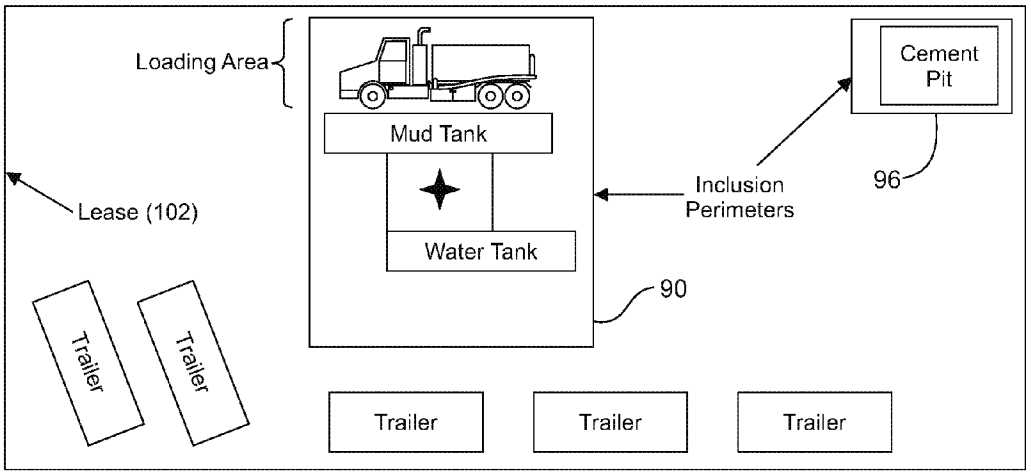
FIG. 10A is a schematic plan view of a lease or site illustrating a first transfer scenario (Job 1) for the transfer of cement returns from an on-site source, such as the rig, and transported to a specified on-site cement pit, other excluded pits or sumps being off-site or remote.

In FIG. 10A, the first loading perimeter 90 is about the drill site and, like that of FIG. 9A, the first unloading perimeter 96 is a sump designated as a cement pit. The cement pit is within the drill lease 102, but other unloading perimeters, if any, are located off-lease. It could be that sumps for drilling mud and the like are located off site.

Figure 10B:
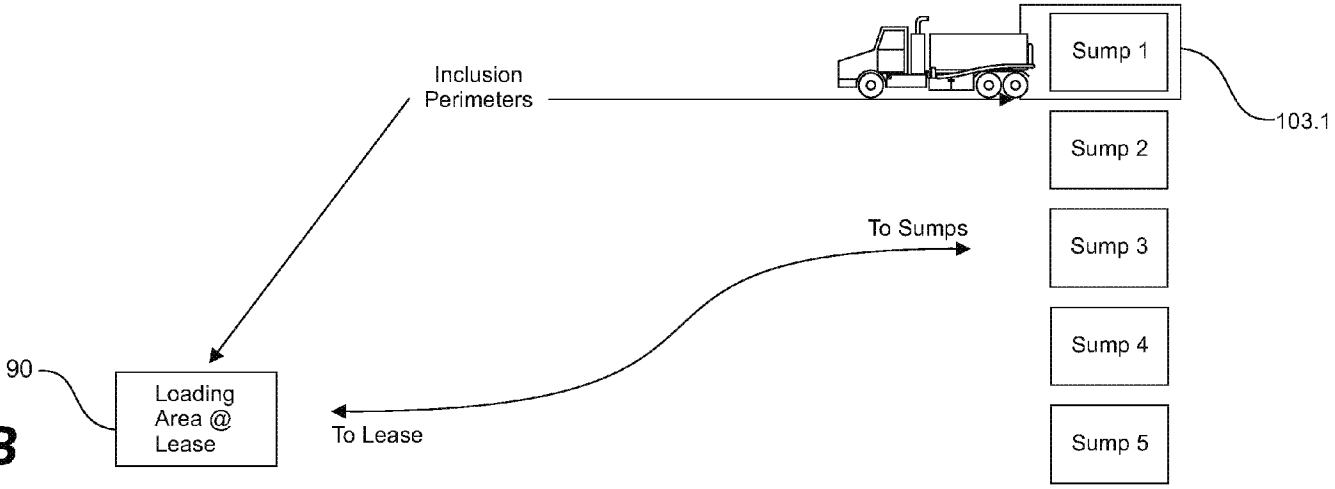
FIG. 10B is a schematic plan view of a lease or site illustrating a second transfer scenario (Job 2) for the transfer of specified drilling fluids from an on-site source to a remote, off-site sump 1.
Figure 10C:
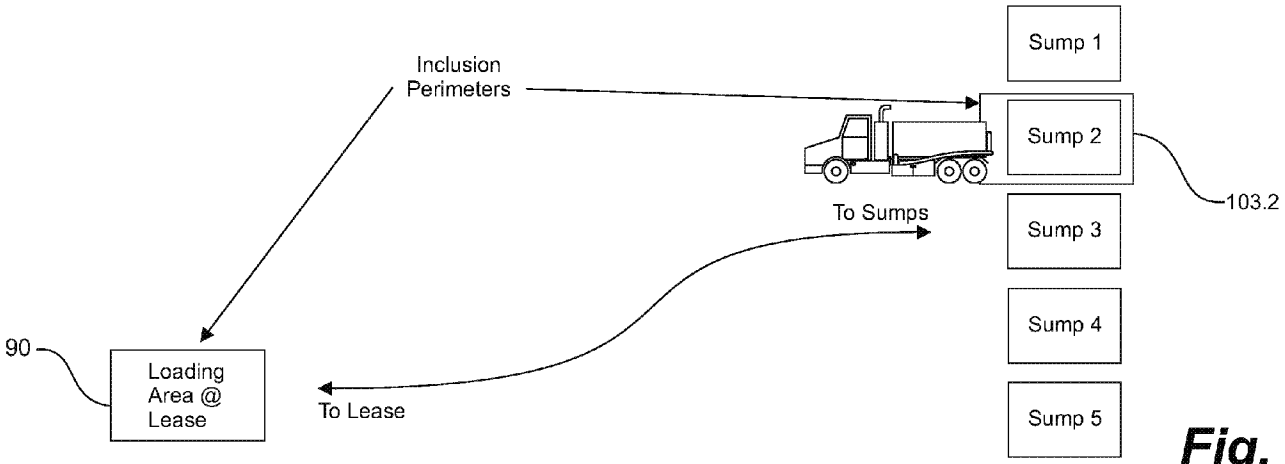
FIG. 10C is a schematic plan view of a lease or site illustrating a second transfer scenario (Job 3) for the transfer of specified drilling fluids from an on-site source to a remote, off-site sump 2.
Figure 10D:
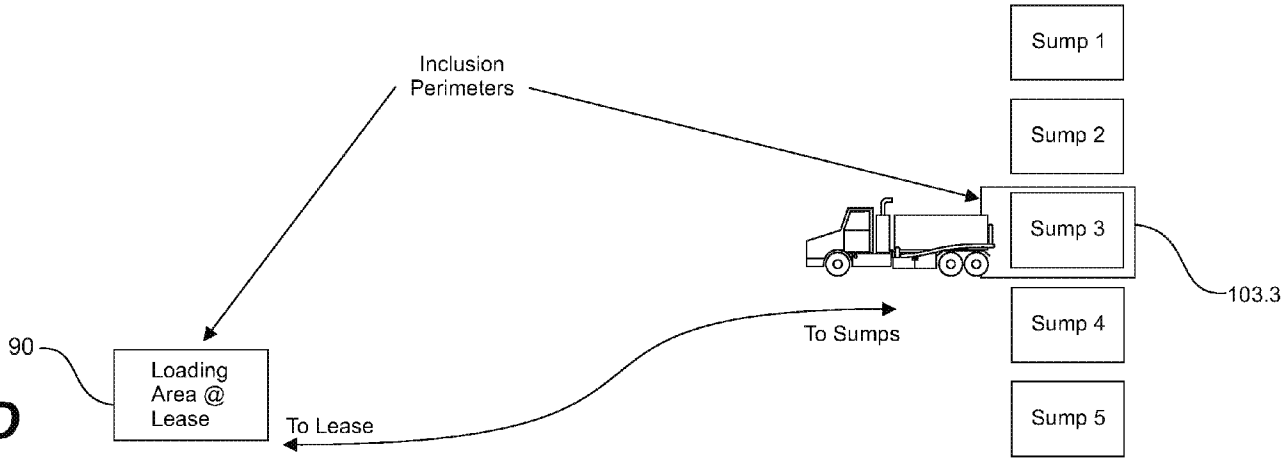
FIG. 10D is a schematic plan view of a lease or site illustrating a second transfer scenario (Job 4) for the transfer of specified drilling fluids from an on-site source to a remote, off-site sump 3.

For example, as shown in FIG. 10B, a first unloading perimeter 103.1 about a first sump, sump 1, located off lease. Similarly, as shown in FIGS. 10C and 10D, second and third sumps can be designated as including zones or unloading perimeters 103.2, 103.3, respectively. These additional sumps, sumps 2 and 3, could be alternate unloading perimeters used in parallel or successively as each preceding sump reaches capacity.

As shown in an example report of FIG. 11, a record of actual locations where fluids are drawn and discharged can be used to demonstrate compliance with applicable regulations and commercial agreements with landowners, and in the case of error, confirm the circumstances of the error for determining a proper resolution.

Figure 12:
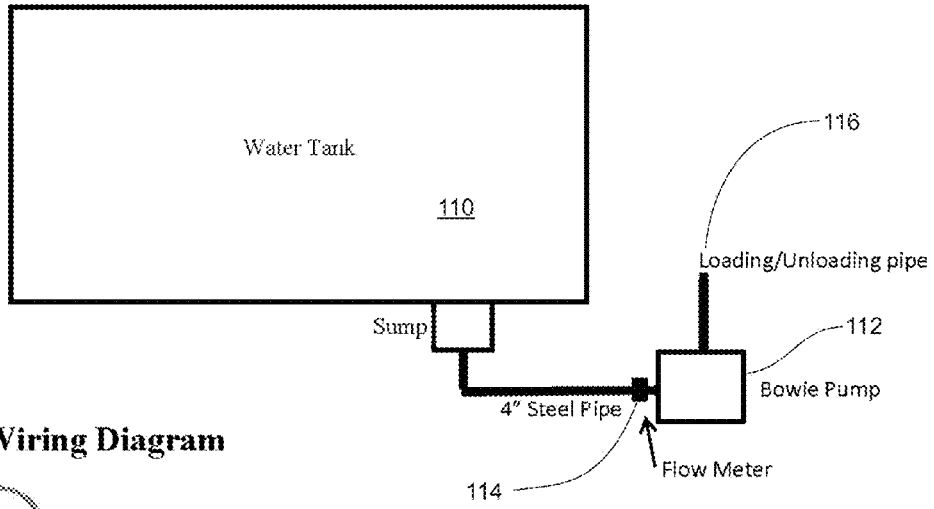
FIG. 12 is a schematic which illustrates a water container fit with a gear-type or similar pump for both loading and unloading and a flow meter.

With reference to FIG. 12 a water tank or container 110 on a water truck is typically fit with a transfer pump 112 for both loading and unloading. One suitable transfer pump 112 is a gear pump, such as a Bowie™ pump (Bowie Industries, Bowie, Tex.). A flow meter 114 is provided in the pipe or conduit between the container 110 and the pump 112, or between the pump 112 and an exterior port 116, be it an inlet or outlet for loading and unloading respectively, depending on the operation. The flow meter 114 is connected to the management system for volume and rate supervision.

Figure 13:
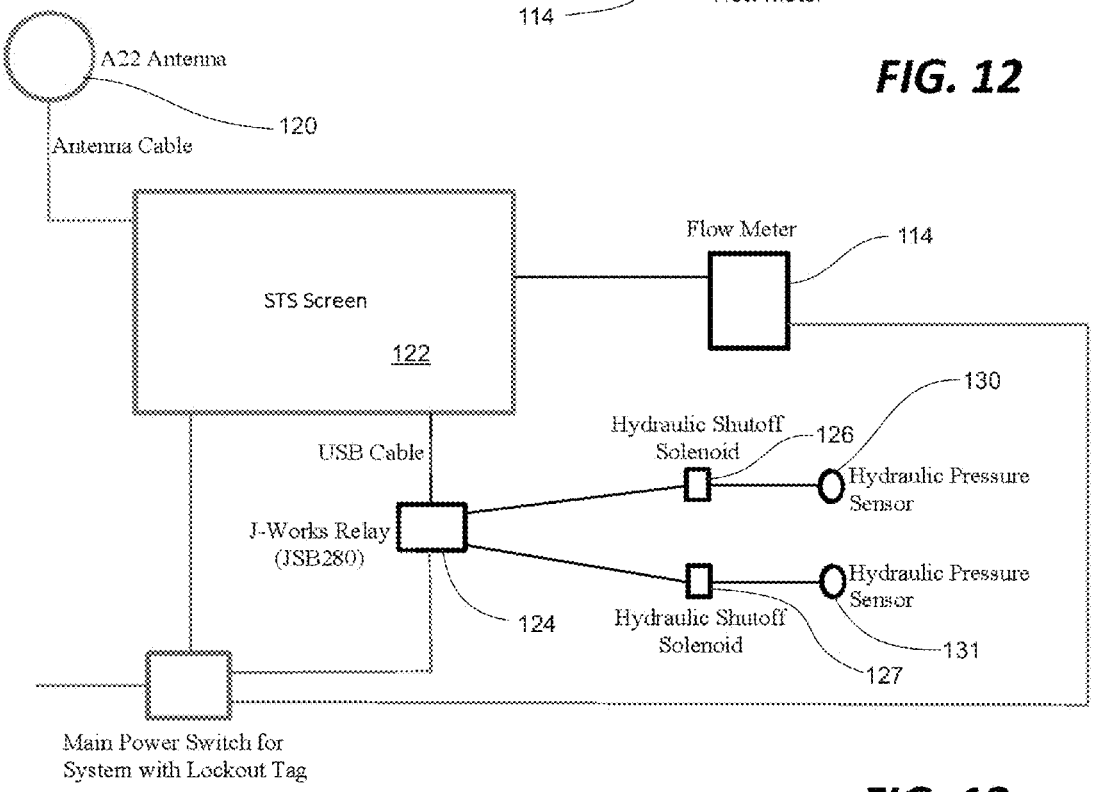
FIG. 13 illustrates the management system for control of the pump for loading and unloading.

With reference to FIG. 13 the management system, as applied to transfer pump management, includes the GPS and antenna 120 and the user interface screen and controller 122. The controller 122 operates a relay 124 to ensure loading and unloading is only in accordance with the programmed scenario, loading only from the appropriate water source and discharging only to the appropriate unloading zone. Where the transfer pump 112 is hydraulically driven, the relay 124 can maintain hydraulic lines in an operating of open state while transfer is in compliance with diversion conditions, or be closed, such as by shutoff solenoids 126, 127, when out of compliance. Solenoids 126,127 can fail closed to ensure no transfer occurs without control unit authorization.

Figure 19A:
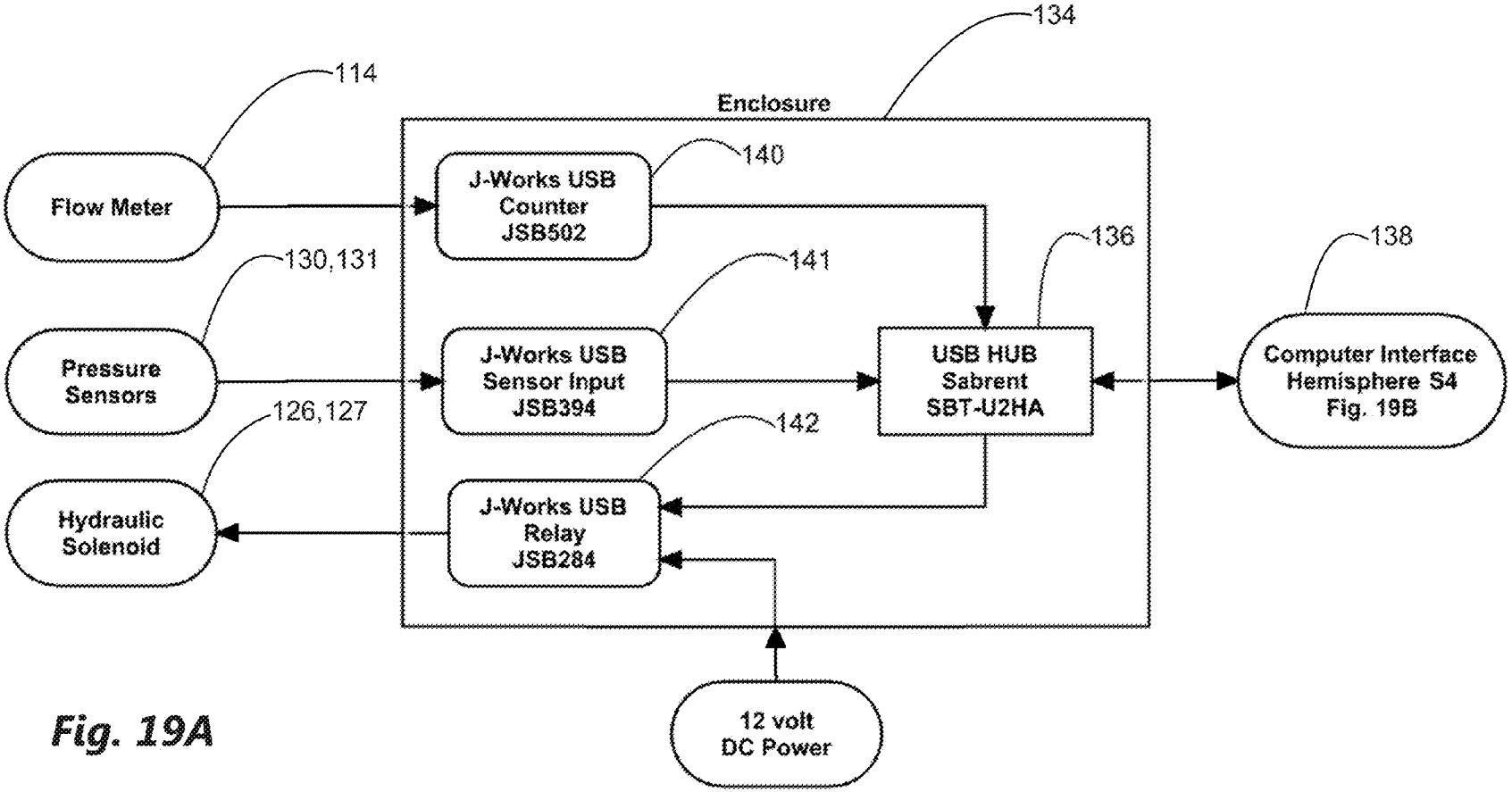
FIGS. 19A through 19C are more detailed schematics of components of the system introduced in FIGS. 12 and 13, and more particularly in FIG. 19A, the interconnection harness for various sensors and interlock devices, in FIG. 19B, the navigation, transfer pump interlocks and container, and in FIG. 19C, the GPS and wireless communications systems are presented.

With reference to FIGS. 13 and 19A, sensors 130,131 related to compliance parameters are connected to the system, such as through specialized universal bus USB enclosure 134 including a hub 136 for multiport connections. In turn the USB enclosure 134 is connected to the control system interface and controller 138 of FIG. 19B. In FIG. 19A, flow meter 114 and pressure sensors 130,131 are connected as part of the data inputs provided and solenoid control as part of the data output.

The USB enclosure 134 can implement J-Works™ Inc. USB devices (Granada Hills, Calif.) such as a J-Works event counter 140 model JSB502, for flow meter pulse monitoring such as those from a Seametrics TB82 turbine meter, JSB394 4/8 channel Switch/Digital Input Module 141 for at least two pressure sensor signals, and a JSB284 high amperage SPST relay module 142 for solenoid on/off control.

Figure 19B:
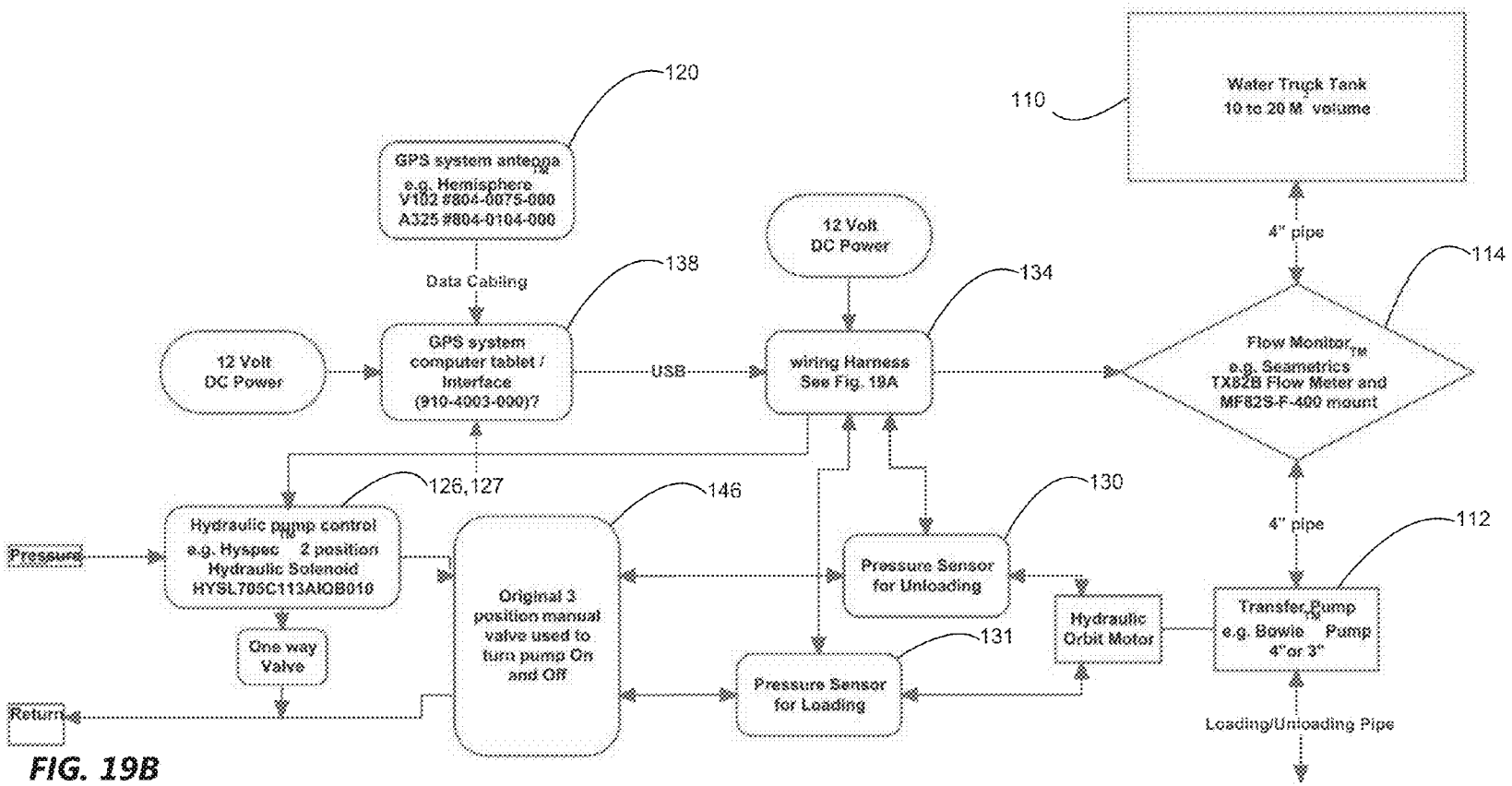
Figure 19C:
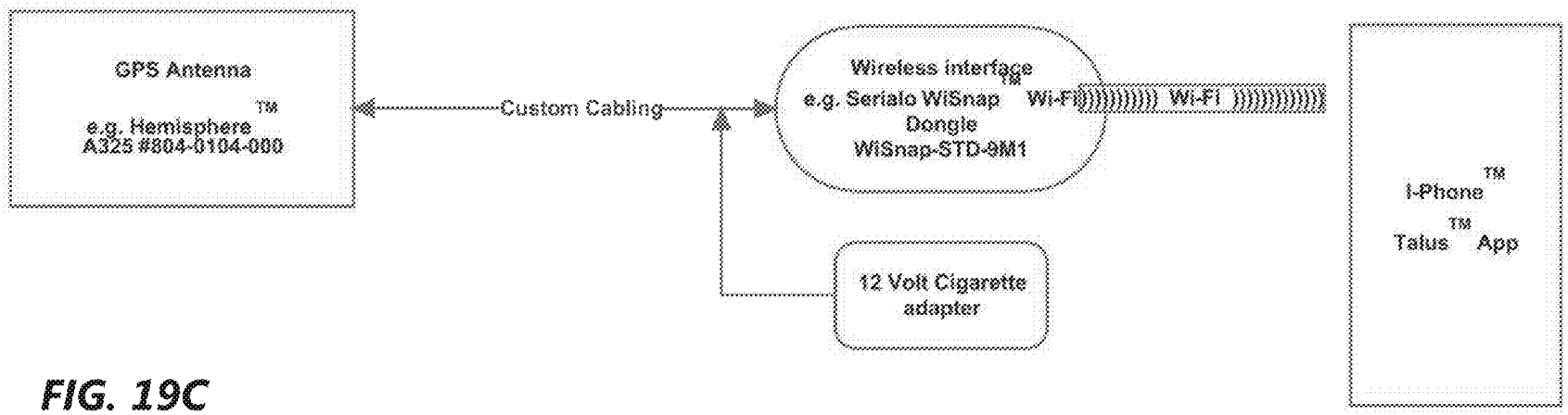

In FIG. 19B, The USB enclosure is part of the management system comprising a GPS system antenna 120 coupled with the navigator computer interface 138. The computer interface 138, such as systems available from Hemisphere GPS or AgJunction Inc., Canada, is connected through the USB enclosure 134 to the pressure sensors 130,131 for sensing loading and unloading operations, the flow meter 114 for cumulative volumes and rates and solenoids 126,127 for hydraulic pump control. The automated hydraulic flow line for pump operation can be plumbed through a manual three position valve 146 for loading, unloading and neutral pump operation. Also included in the management system is accommodation for technician communications for cellular communications. As shown in FIG. 19C, a suitable wireless interface can be a WiSnap™ WiFi wireless radio dongle, from Serialio.com, providing connectivity for serial devices to the internet including smartphones. Satellite communications and location can be achieved using a Hemisphere GPS, model A325, satellite tracking technology, available from Hemisphere GPS, Hiawatha, Kans.

With reference to FIGS. 14A-14D, the management system is integrated into the water truck's hydraulic system to stop loading/unloading in an inappropriate area, zone or perimeter. A hydraulically driven water pump, such as a Bowie gear pump (not shown), is used to both effect intake and discharge of water depending upon direction of rotation. A hydraulic motor 150, such as a hydraulically driven orbit motor, drives the pump. Orbit hydraulic motors are small volume, economical hydraulic motors which are compact, provide high power, and are lightweight.

As shown in FIG. 14A, the orbit motor 150 is supplied by an onboard hydraulic supply, such as that provided by the truck power takeoff (PTO). First and second hydraulic lines 152,153 alternately feed hydraulic fluid to the motor and return the flow to the hydraulic reservoir. The use of either the first line 152 or second line 153 as the supply line dictates the direction of the rotation of the motor 150 and attached pump. The system monitors which way the water pump is turning by sensing direction of hydraulic flow. Shown in FIG. 14A and also in FIG. 19B, the system has the ability to shut down the pump with a two-position solenoid valve 126,127 in the supply line from an onboard pump to the orbit motor 150. Indeed, as shown, the control has determined that neither loading nor unloading is appropriate as the truck is not located at an inclusion zone.

As shown in the system detects that loading or unloading is taking place in an inappropriate area (outside the job's specified inclusion zone) the solenoid 126,127 will be activated. An example of compliance control would be when the driver tries to load anywhere other than a loading only perimeter or a loading/unloading perimeter inclusion zone. When activated, oil flow is diverted back to the hydraulic reservoir before reaching the manual valve 146, bypassing the hydraulic motor 150, shutting down the motor 150 and driven pump. The system can be set to reset after 10 seconds giving the operator enough time to put the manual valve 146 into the neutral position (See FIG. 14D), isolating the motor 150. The pressure sensors 130,131 in the first and second hydraulic lines are used to tell the computer which way the pump is being turned.

With reference to FIG. 14B, the control permits operation for unloading to an appropriate inclusion zone. With reference to FIG. 14C, the control permits operation for loading from an appropriate inclusion zone or source. With reference to FIG. 14D, the manual valve 146 can render the pump inoperative for neither loading nor unloading.

Figure 15A:
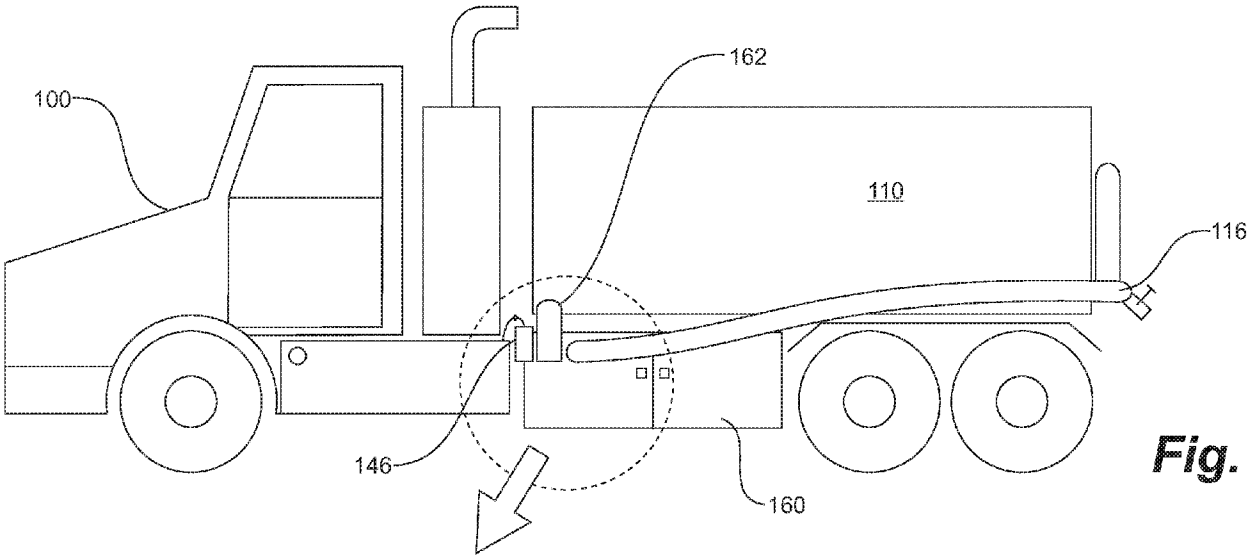
FIGS. 15A and 15B illustrate a water truck fit with a pump and controls suitable for compliance water diversion, more particularly
Figure 15B:
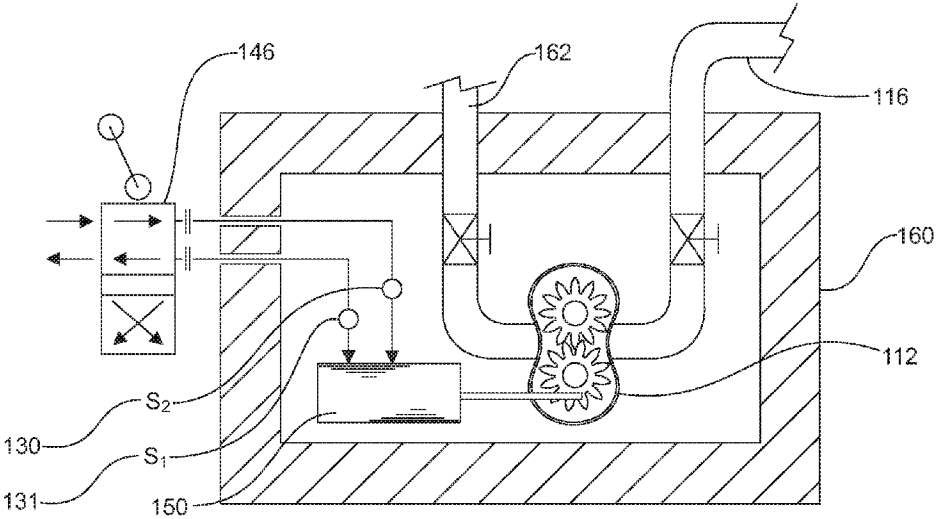

As shown in FIGS. 15A and 15B, a pump and pump control is provided for fitting to a water truck 110 for compliance water diversion. As shown in FIG. 15B, the pump 112 is housed in a heated box 160 of the water truck of FIG. 15A. The heated pump box 160 is shown on the driver's side behind the fuel tank. A flexible pipe coming out of the top of the heated box is the loading/unloading transfer pipe or line 116. The hydraulic, three-position manual valve 146 is at the left of the transfer line, used to manually turn the pump on and off (neutral).

As shown in FIG. 15B, the pump 112 is shown inside the heated and insulated cabinet or box 160 with an intermediate rigid pipe 162 directing water to and from the containers 110 through a quick connect at the top of the box 160.

Figure 16A:
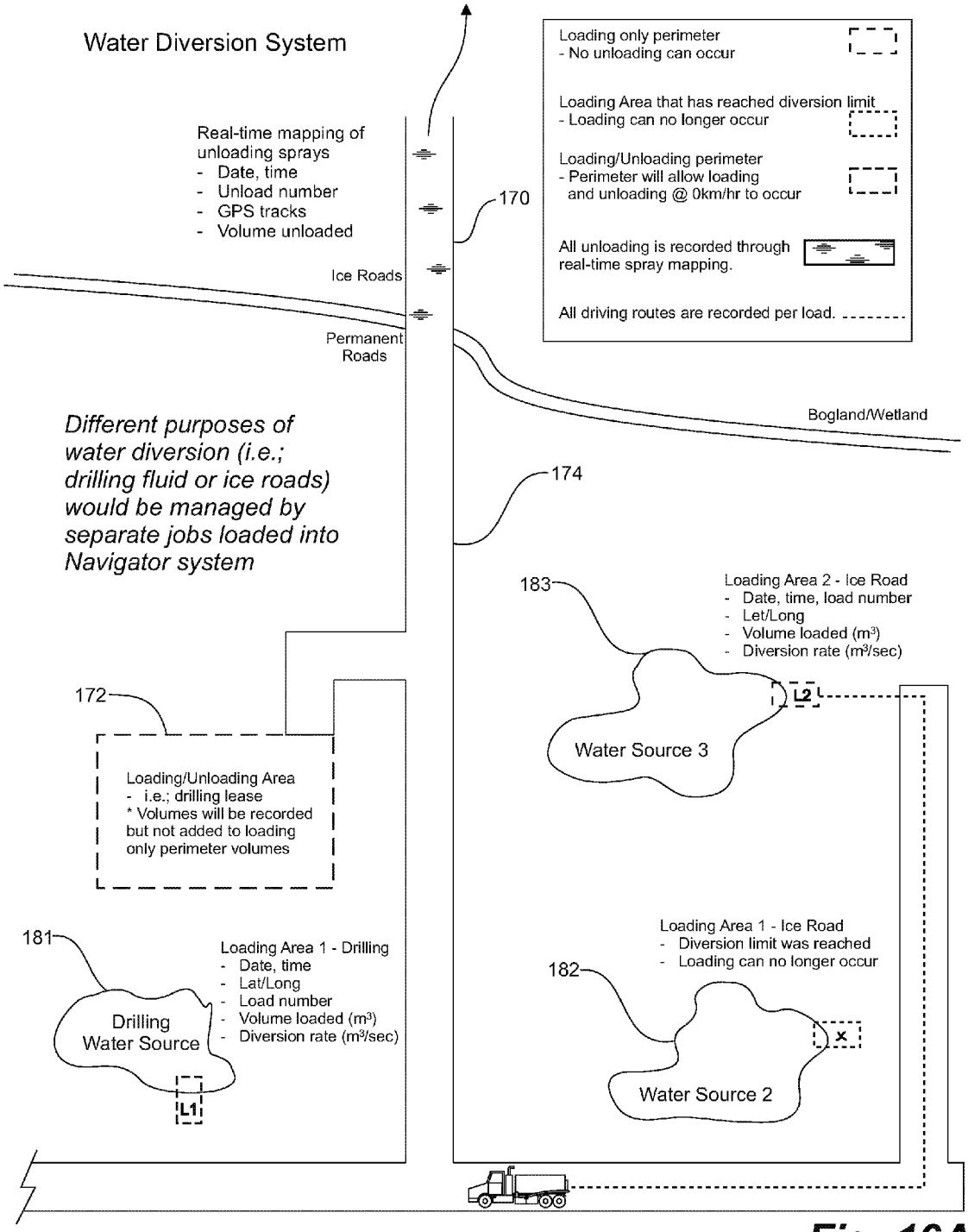
FIG. 16A illustrates one example of a typical layout about an oil or gas well site including off-site water sources licensed for a water diversion transfer scenario, such diversion including for ice road formation and on-site unloading for well site purposes.

In examples of operations for managed water diversion, and with reference to FIG. 16A, water can be required for drilling operations and off-site preparation including ice roads 170. Drilling operations are located within a loading/unloading area 172. Access to the drilling site is by roads, both permanent 174 and seasonal. Seasonal roads include those over bogland and marshland, being limited to winter, and often fortified by conditioning as ice roads 170. Truck mapping can ensure effective use of truck and water resources. In advance, local water sources are located and licenses applied for and acquired. Water drawn for such purposes is referred to as water diversion. Diversion from water sources is restricted for a variety of reasons including low flow, restricted replenishment, and pre-existing allocations.

As shown, one first drilling water source area 181 was identified for drilling site usage and two additional water sources, water source 2 and 3 (182, 183) were identified as suitable for an ice road 170. Loading areas or geo-fence perimeters were defined. A loading area L1 defines the permitted access point for loading from the drilling water source 180. A loading area 1 (183)—ice road, for water source 2 (182) is indicated as closed with an X. Loading area 2 (183)—ice road, has an open loading area L2. Trucks attending each source can only draw water or load if they are within the defined loading perimeter. GPS data and the management system will lockout any vehicle outside the perimeter 172, L1, L2, even if permitted to draw from the source 180,182,183. Perimeters are usually defined with practical access considerations and in consultation land owners or districts. Truck movements are mapped and corroboration of use and location is available.

As illustrated for ice road use, the first water resource or lower water source, labeled water source 2 (182), was limited to ice road water diversion and was subsequently exhausted, such as by reaching or exceeding maximum volumes or rates for that limited source, and any water truck attending there is now locked out. A second or successive water source, water source 3 (183), is still available, the cumulative volume of water loaded therefrom still being within compliance of the diversion conditions. Data logged includes date, time and load identification of each load. Further data includes truck location (latitude/longitude), volume loaded, and diversion rate, such as to ensure source self-replenishment.

Further, for drilling purposes, usual water source restrictions apply for licensed sources. Further, on-site usage can be tracked including surplus water unloaded onsite but not used. Rather than dispose of excess water which was unloaded, stored on-site and ultimately not used, loading and movement of excess water to other sites can be tracked as to volumes and locations. A truck can load water from one site and unload at another adjacent site. All uses, volumes and locations are tracked, netting-out the permitted amounts under diversion permits. Hence a drilling operator can ensure that the water was used effectively and responsibly.

Figure 16B:
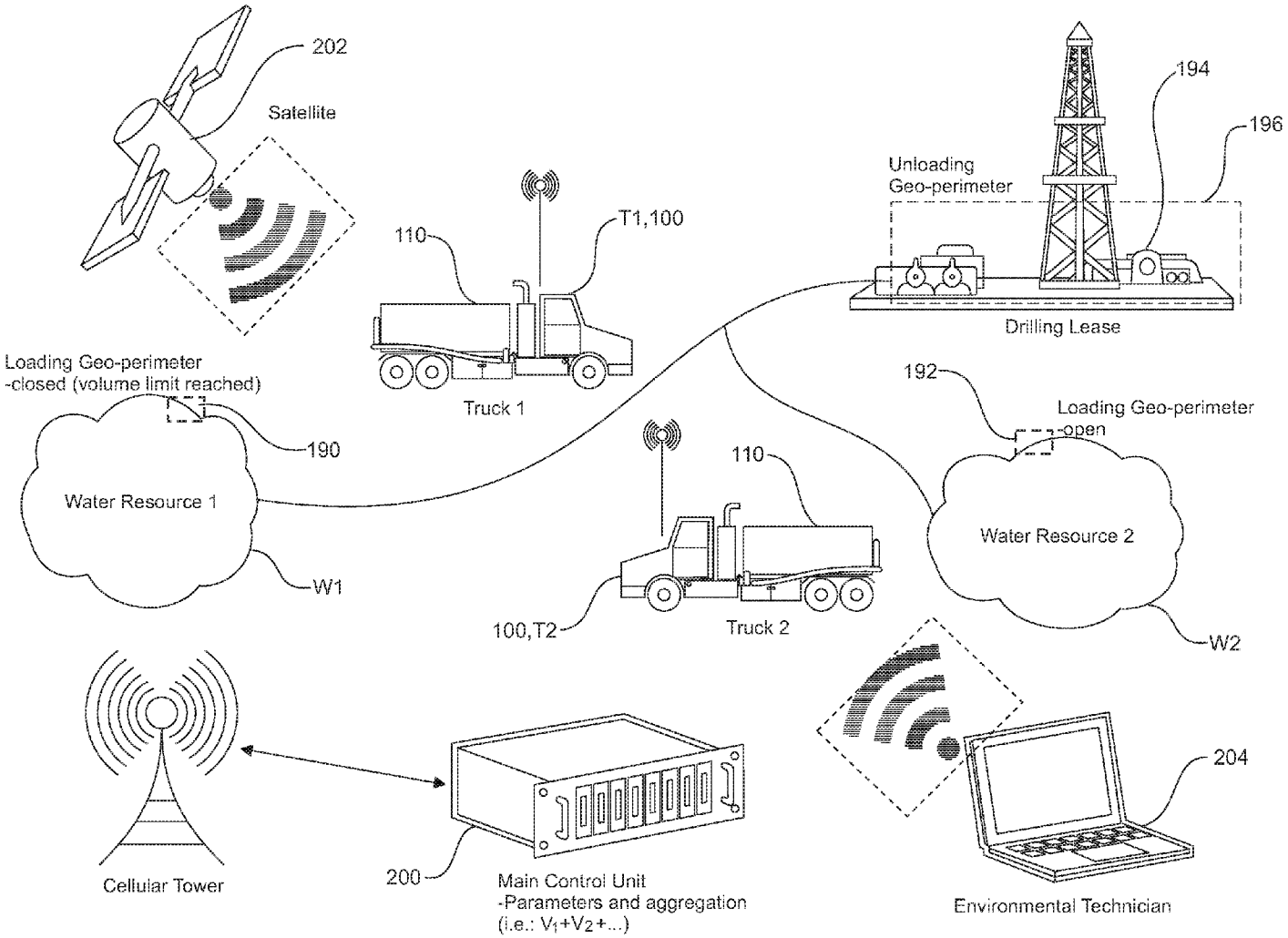
FIG. 16B illustrates another example of a multi-truck operation, having two or more containers for coordinated management of a water diversion transfer scenario, each truck in communication with a control unit for the aggregation of monitored parameters, comparison with permitted diversion conditions and permission communications sufficient to discontinue diversion or to shift diversion to a successive water resource.

In another example, and with reference to FIG. 16B, two or more containers 110 are provided on two or more vehicles T1,T2. In many situations, such as operations related to oil and gas leases, there can be tens of water hauling trucks and a similar magnitude of potential water resources or source which are licensed for diversion. Each source can have different set of diversion conditions, for example, depending whether the resource is a dugout, a creek, river, lake or slough. Each truck driver is generally autonomous and a real opportunity for a specific source to be overwhelmed and diversion conditions exceeded if there is no means for coordination.

Accordingly, a management system is provided for two or more containers 110. Further, the management system can also accommodate two or more sources W1, such as a first liquid resource, and a successive liquid resource W2. The successive liquid resource is available when the first liquid resource is exhausted, namely when the diversion conditions are reached or exceeded. Each liquid resource is associated with establishing boundary coordinates within the spatial coordinates. A second successive liquid resource defining at least a second loading geo-perimeter and will have second diversion conditions. Third and fourth and additional liquid resources form a successive resource, each accessed after exhaustion of the preceding resource. It is also contemplated that more than one liquid resource may be in play at any time, however, each can be deemed to be a first liquid resource, managed as one liquid resource having first diversion conditions and when exhausted, a further successive resource must be used.

When the monitored diversion parameters for the first liquid resource are no longer capable of compliance with the first diversion conditions for the first liquid resource, the truck or trucks bearing the container or containers are prohibited from further intake from the first or preceding resource and must move or another successive resource.

The process then repeats except as now applied to the successive liquid resource, by obtaining current position coordinates of the container, determining if the container is at the second or successive loading geo-perimeter; and if so, then transferring liquids from the successive liquid resource to the container. Again, the control unit monitors diversion parameters and only authorizes continuing transfer or diversion while the monitored diversion parameters for the successive liquid resource are in compliance with the second diversion conditions. Specifically with reference to FIG. 16B, first and second containers 110 are borne on first and second trucks T1 and T2. Each truck T1,T2 is fit with GPS and satellite communications. Each truck T1,T2 records parameters such as location, whether liquid transfer is loading or unloading, and volume and rate of liquid loading and unloading. Two water resources W1,W2 are identified. Water resources W1,W2 have loading perimeters 190,192 The trucks have been diverting water for use at a drilling lease 194 including building ice roads, making drilling mud, dust suppression and soil stabilization. The lease 194 is associated with unloading perimeter 196. The illustrated scenario is a snapshot in time at about the time the first water resource W1 is exhausted.

Each truck T1,T2 has been uploading diversion parameters to the main control unit 200. In this example, communications are via satellite from the trucks T1,T2 to a satellite 202. The satellite 202 and control unit 200 are also in communication. The control unit 200 receives the parameters and aggregates the parameters received from both trucks. At some point, the diversion conditions for water resource W1 were reached. The control unit signals a cessation and prohibition of further diversion from resource W1. As the first resource, water resource W1, is closed, the trucks T1,T2 are permitted to divert from the loading perimeter 192 to an open successive water resource, in this case water resource W2.

The process can be monitored by a technician equipped with a computer, such as a laptop 204, also connecting to the main control unit by cellular network or satellite.

The data upload from the trucks T1,T2 . . . can be periodic, the frequency of which is dictated by communications criteria including service cost, data rates and communication bandwidth. Typically a data upload could occur at the conclusion of each container loading cycle. Accordingly, one truck T1 might have just loaded 1500 liters, and uploaded its parameters to the control unit. The control unit aggregates with any other truck information including cumulative volume. In this example, the maximum volume for water resource W1 has exceeded the first diversion conditions and the control unit closed the first water resource W1, locking out any further diversion from W1 for any of the trucks T2 . . . in service. The second water resource is already open, the diversion conditions not yet being reached. The individual truck mapping systems can illustrate open and closed liquid resources with on-screen coding or textual indicators. Here, the first geo-perimeter 190 can be illustrated at water resource W1, but is marked in red as being closed while the second geo-perimeter 192 for the successive water resource W2 can be marked in green as being open.

Figure 17A:
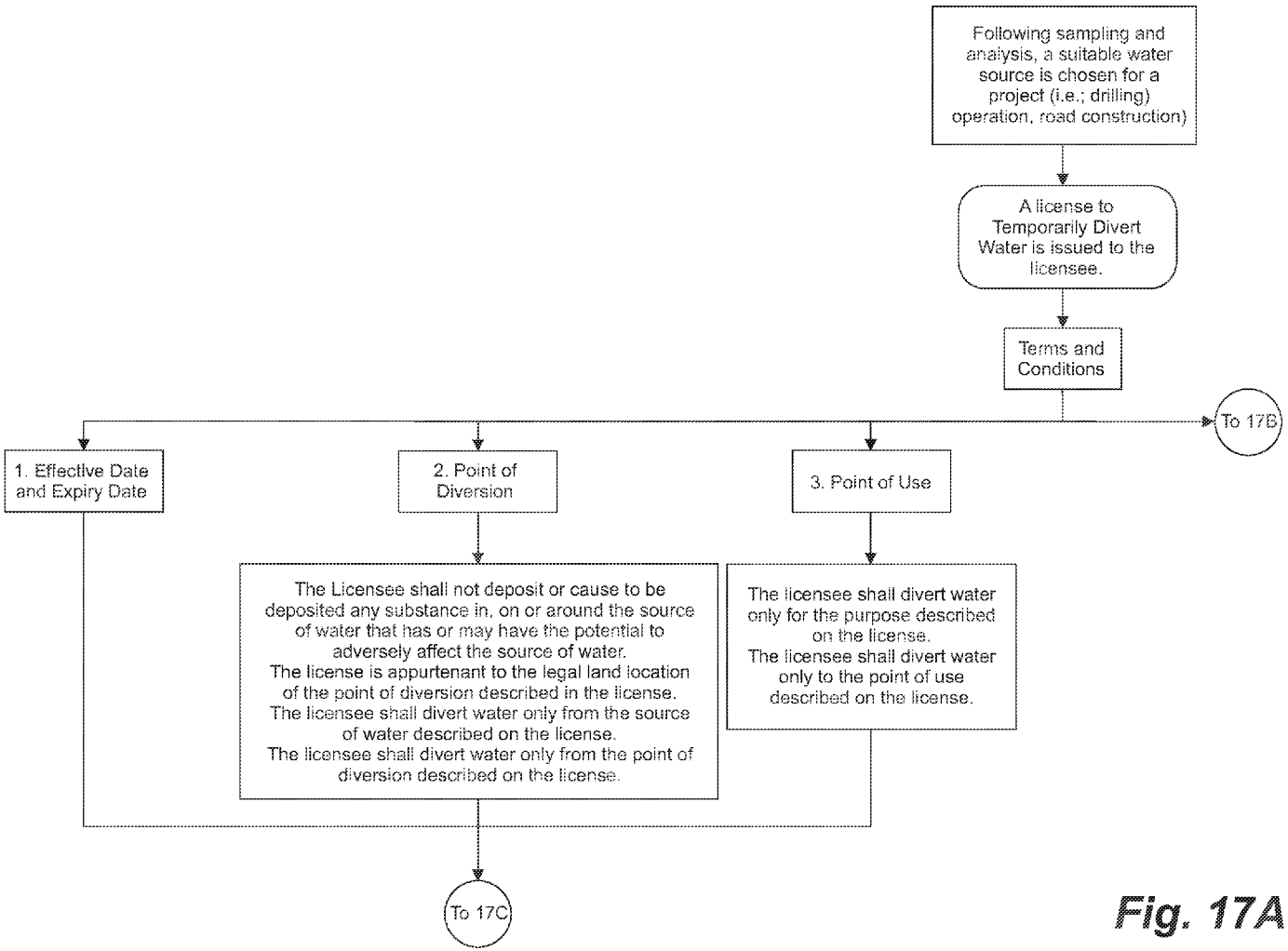
FIGS. 17A, 17B and 17C are parts of a high-level flow chart for a water diversion system, management of diversion conditions and for reporting same.
Figure 17B:
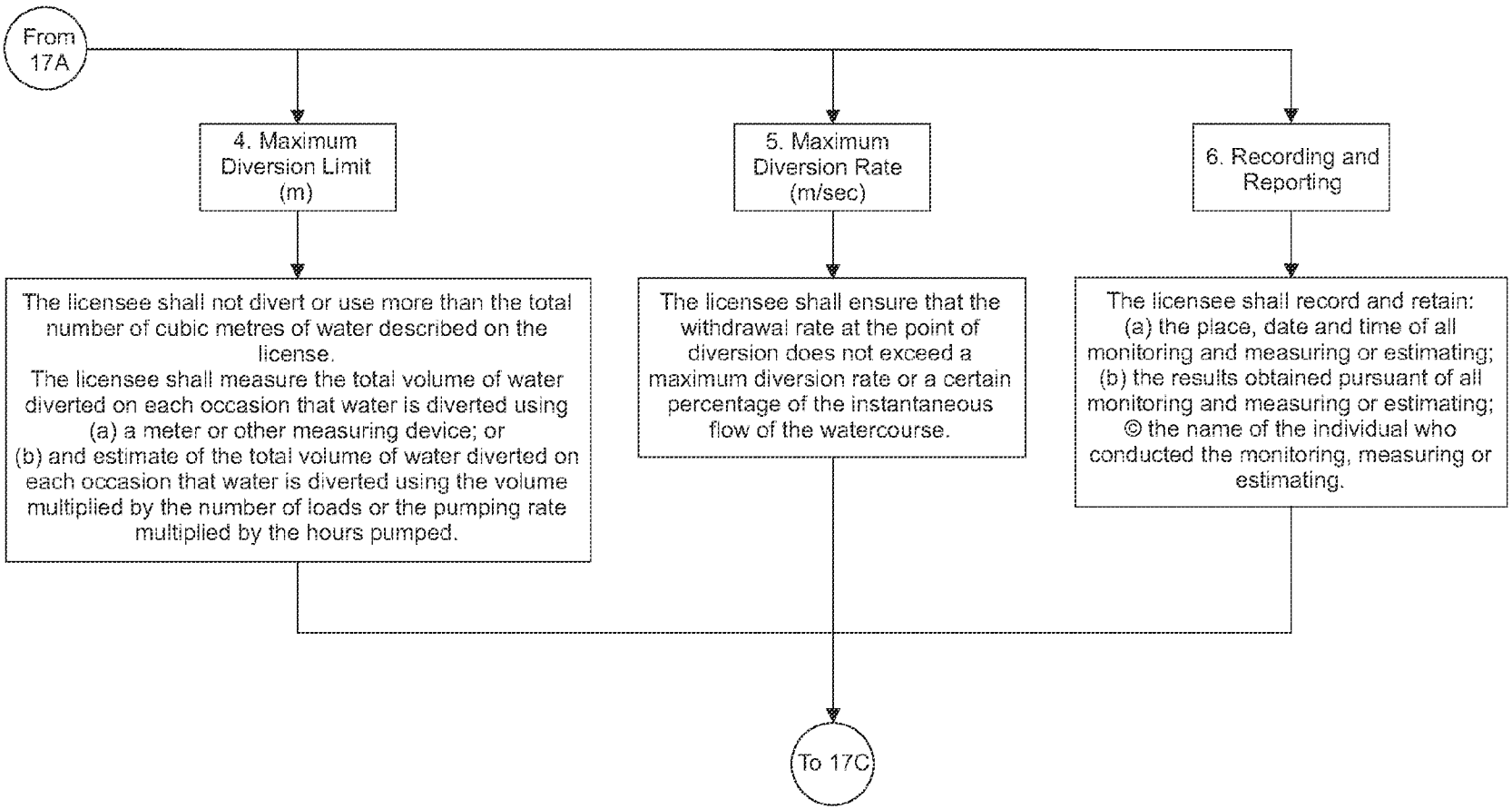
Figure 17C:
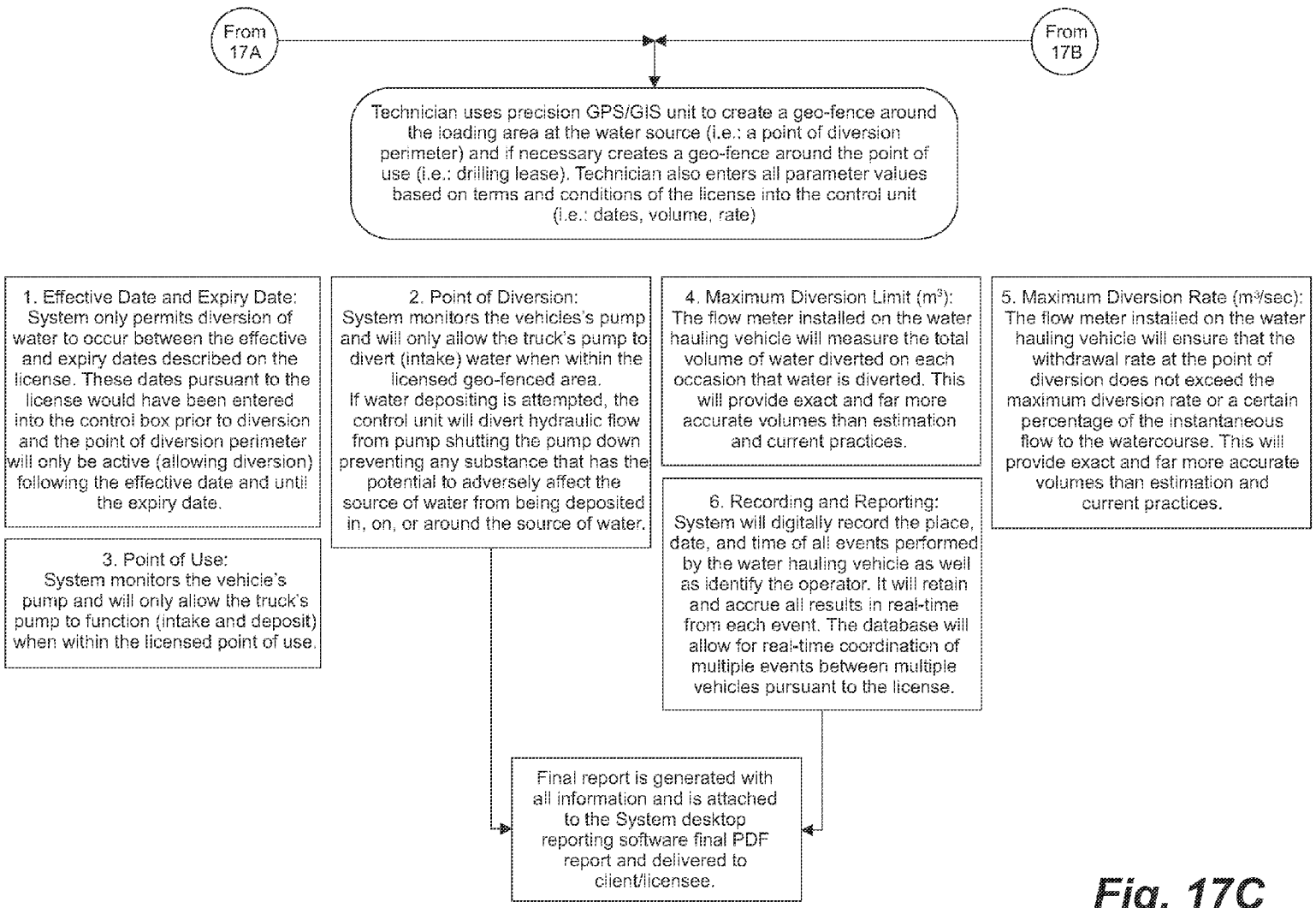

As shown in FIGS. 17A, 17B and 17C, a flowchart is provided illustrating an example of the parameters chosen for water diversion management. At block 300, following sampling and analysis, a suitable water source is chosen for a project, for example a drilling operation or road construction. At Block 302, a license is issued to the licensee to temporarily divert water. At Block 304, license conditions are determined applicable for the temporary water source, including: at Block 306 effective date and license expiry date; at Block 308 the point, purpose or location of the diversion source; at Block 310 the point, purpose or location of the diverted water; at Block 312 the maximum permitted diversion limit; at Block 314 the maximum permitted diversion rate; and at Block 316 the recording and reporting requirements. At Block 320, a technician both determined a geo-perimeter about the water source and enters all license conditions or parameters in the system, such as at the control unit directly or memory stick. For example, the technician can use precision a GPS/GIS unit to create a geo-perimeter around the loading area at the water source, for example about a perimeter of the point of diversion and, if necessary, creates a geo-perimeter around the point of use such as a drilling lease. The technician also enters all parameter values based on the terms and conditions of the license into the control unit including dates, volumes, and rates.

In more detail, at Block 308, and based on the Province of Alberta legislation, it is conventional to impose upon the Licensee that they shall not deposit or cause to be deposited any substance in, on or around the source of water that has or may have the potential to adversely affect the source of water. The license is appurtenant to the legal land location of the point of diversion described on the license. The licensee shall divert water only from the source of water described on the license and only from the point of diversion described on the license.

At Block 310 it is conventional to impose upon the Licensee that they shall divert water only for the purpose described on the license, namely only to the point of use described thereon.

At Block 312 the licensee shall not divert or use more than the total number of cubic metres of water described on the license. The licensee shall measure the total volume of water diverted on each occasion that water is diverted using: (a) a meter or other measuring device; or (b) an estimate of the total volume of water diverted on each occasion that water is diverted using the volume multiplied by the number of loads or the pumping rate multiplied by hours pumped.

At Block 314, the licensee shall ensure that the withdrawal rate at the point of diversion does not exceed a maximum diversion rate or a certain percentage of the instantaneous flow of the watercourse.

At Block 316, the licensee shall record and retain: (a) the place, date and time of all monitoring and measuring or estimating; (b) the results obtained pursuant of all monitoring and measuring or estimating and (c) the name of the individual who conducted the monitoring, measuring or estimating.

According in operation, at Block 320, the control unit monitors the control parameters. In summary, monitored parameter are compared against pre-determined conditions including:

- diversion of water is only permitted to occur between the effective and expiry dates describe on the license, the license being the particular conditions for this example. These dates pursuant to the license would have been entered into the control unit prior to diversion and the point of diversion loading geo-perimeter will only be active to allowing diversion following the effective date and until the expiry date.
- Monitoring of the vehicle's pump and only allowing the truck's pump to divert (intake) water when within the licensed geo-perimeter area. If any fluid discharge or depositing is attempted, the control unit locks out the pump, diverting hydraulic flow from pump and effectively shutting the pump down preventing any substance that has the potential to adversely affect the source of water from being deposited in, on or around the source of water.
- monitoring the vehicle's pump and only allowing the truck's pump to function (intake and deposit) when within the licensed point of use.
- Measuring the total volume of water diverted on each occasion that water is diverted, such as using a flow meter installed on the water hauling vehicle, This will provide exact and far more accurate volumes than estimation and current practices.
- Measuring the withdrawal rate at the point of diversion so as to ensure that the does not exceed the maximum diversion rate or a certain percentage of the instantaneous flow of the watercourse. This is also measured using the flow meter installed on the water hauling vehicle. This will provide exact and far more accurate volumes than estimation and current practices.
- digitally recording the place, date and time of all events performed by the water hauling vehicle as well as identify the operator. All monitored parameters are retained and all results accrue or otherwise aggregated in real-time from each event. The database will allow for real-time coordination of multiple events between multiple vehicles pursuant to the license.

At Block 330, a final report is generated with all information and is attached to desktop reporting software final PDF report and delivered to client/licensee.

Figure 18A:
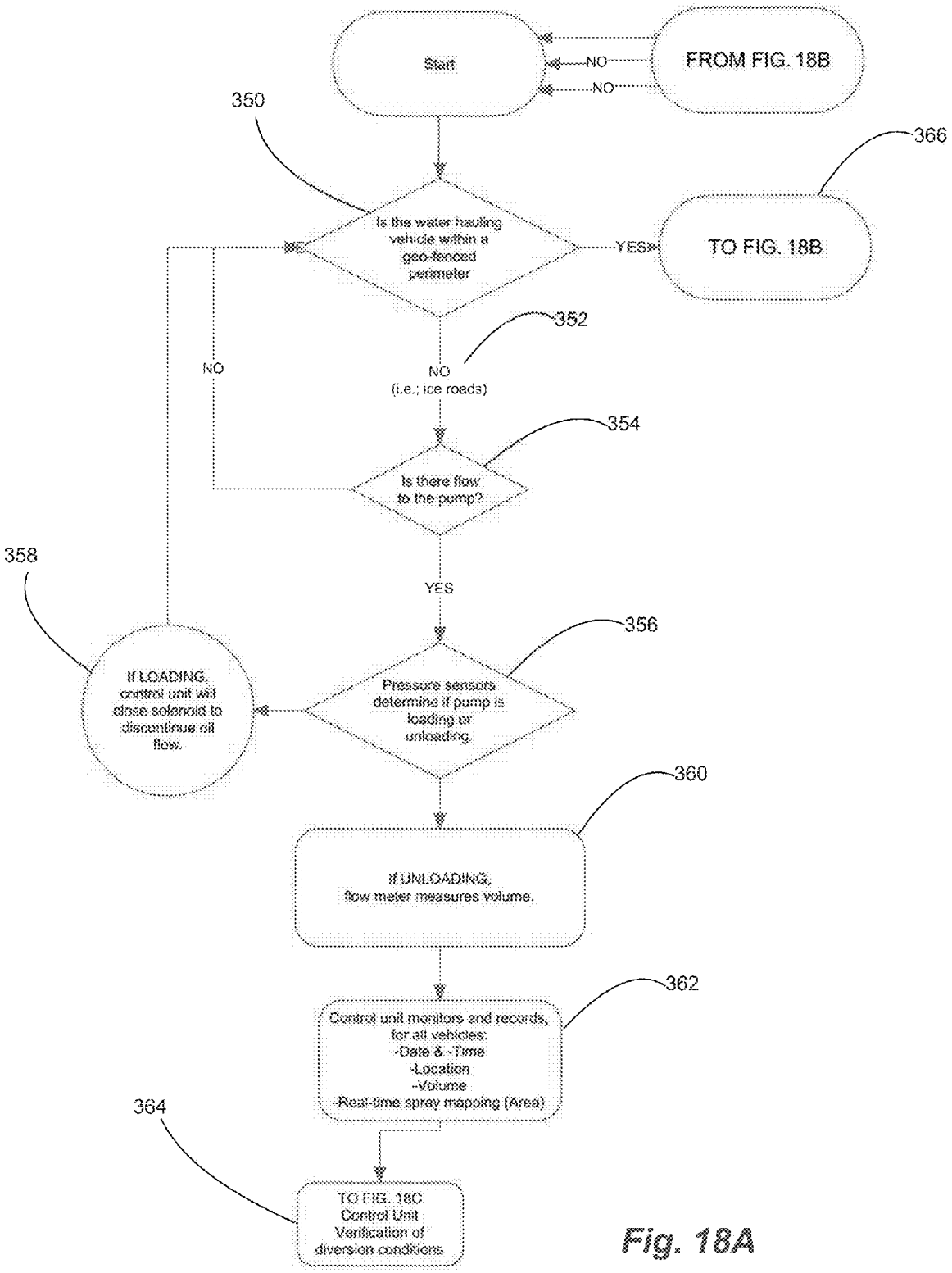
FIGS. 18A through 18C represent a flow charts, in three sections, of the logic for transfer pump operation.
Figure 18B:
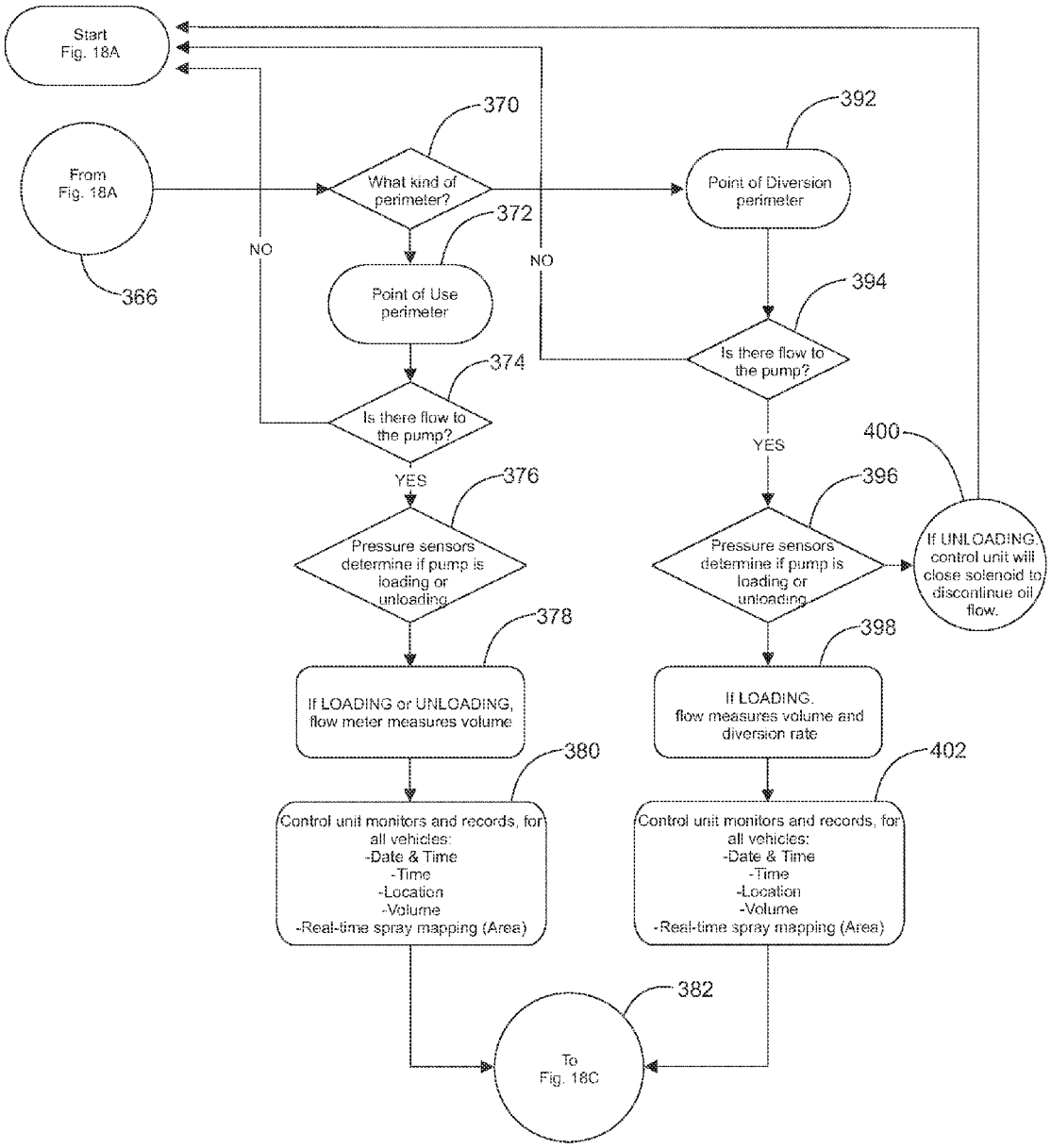
Figure 18C:
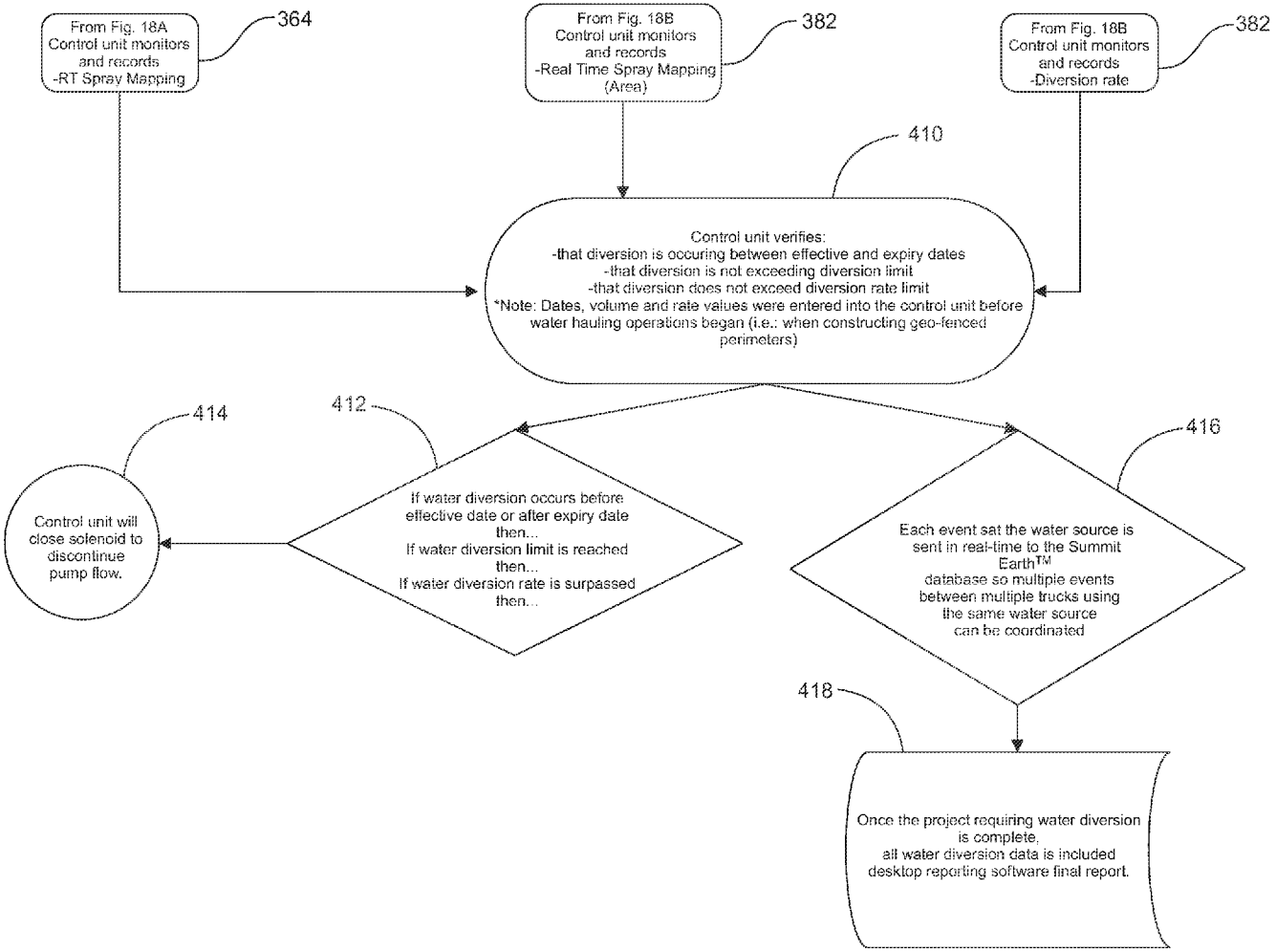

With reference to FIGS. 18A through 18C, a compliance management flow logic is illustrated, namely for water diversion and dependent on whether the vehicle is within a geo-perimeter, and if so, whether liquid is being loaded or unloaded.

In more detail, and with reference to FIG. 18A, one can first determine if the vehicle is outside a permitted geo-perimeter at 350. If so, at 352, then the unloading is subject to few conditions, namely a restriction on loading. An example is spraying for forming ice-roads, but never is it permitted to load while outside a designated geo-perimeter. Next, at 354, the system determines if the transfer pump is operating, such as through flow to the hydraulic drive motor. If not, then there is nothing to monitor and the system loops to await some transfer operation. If there is hydraulic flow, at 356, the direction is sensed for determining if the flow is for loading or unloading. If loading is sensed, at 358, then the system closes the solenoids, arresting any loading transfer, avoiding unlicensed diversion. If unloading is sensed, at 360, then recording is made of the date and time, location, and volume dispensed. A real-time spray mapping is recorded at 362. The monitored parameters are sent to the control unit for verification of diversion conditions, at 364, as shown in FIG. 18C.

If the vehicle is within a geo-perimeter at 366, then one moves to FIG. 18B, to assess if the perimeter is a point of diversion (loading) or use (unloading)

With reference to FIG. 18B, when the vehicle is located within a geo-fenced perimeter, then the system ascertains at 370 whether the perimeter is a point of diversion or of use. If the control system determines the vehicle's container location is within a permitted unloading perimeter at 372, then a check is made for flow conditions at 374. If there is transfer occurring, then the hydraulic line pressure sensors are interrogated for direction at 376, and if loading or unloading, the volume and rate is measured at 378. At 380 parameters are monitored and recorded including date and time, location, volume and diversion rates. The monitored parameters are sent to the control unit for verification of diversion conditions, at 382, and as shown in FIG. 18C.

If the control system determines at 370 that the vehicle's container location is within a permitted loading perimeter at 392, then a check is made for flow conditions. If there is transfer occurring at 394, then the hydraulic line pressure sensors are interrogated for direction at 396, and if loading, the volume and rate is measured at 398. If unloading at 400, the solenoid arrests transfer and returns to the initial start position. If permitted loading is underway at 398, then parameters are monitored and recorded at 402 including date and time, location, volume and diversion rates. Again, at 382, the monitored parameters are sent to the control unit for verification of diversion conditions as shown in FIG. 18C.

Turning to FIG. 18C, the control unit receives the monitored parameters for verification of diversion conditions at 410, including that the operations are occurring in the effective date and time range, the volume is not exceeding a diversion limit and the rate is not exceeding diversion rate. If any condition is exceeded, at 412, the control unit signals the solenoids to close, at 414, and the system loops back to the start of FIG. 18A. If the parameters are still within the diversion conditions, the control unit records the data in a database and accumulates data, at 416, including data from multiple trucks and containers from the same water source. Operations and successive exhaustion and use of successive water sources continues until the project is complete, at 418. Once complete all monitored water diversion data is included in a final report, suitable for regulatory audit, performance and archival purposes.

The invention claimed is:

1. A method for transfer of a liquid from a managed liquid resource comprising:

- obtaining a plurality of spatial coordinates for a liquid resource;
- establishing boundary coordinates within the spatial coordinates defining at least a first loading geo-perimeter and first diversion conditions for the liquid resource;
- locating two or more containers for accessing the liquid resource, each of the two or more containers having a pump;
- obtaining current position coordinates of the two or more containers container;
- determining if the two or more containers are at the first loading geo-perimeter; and
  - if within the first loading geo-perimeter, actuating the pumps for transferring liquids from the liquid resource to the two or more containers, monitoring diversion parameters for the two or more containers accessing the liquid resource, aggregating the monitored diversion parameters, and only continuing transfer liquids while the aggregated monitored diversion parameters are in compliance with the first diversion conditions, and if outside the first loading geo-perimeter, inhibiting actuation of the pumps thereby inhibiting liquid transfer.

2. The method for managed liquid transfer of claim 1 further comprising, for each of the two or more containers:

obtaining a plurality of spatial coordinates for a liquid unloading area;

establishing boundary coordinates within the spatial coordinates defining at least a first unloading geo-perimeter;

locating the container at the unloading area;

obtaining current position coordinates of the container, determining if the container is at the first unloading geo-perimeter; and if the container is within the first unloading geo-perimeter, transferring liquids from the container to the unloading area.

3. The method for managed liquid transfer of claim 1 wherein the first diversion conditions include at least a maximum volume of liquid transferred therefrom.

4. The method for managed liquid transfer of claim 3 further comprising, during the transferring of liquids from the liquid resource:

measuring the rate of liquid transferred from the liquid resource;

determining the volume of liquid transferred; and comparing the transferred volume to the maximum volume, and when the transferred volume is reaches the maximum volume, preventing further transfer therefrom.

5. The method for managed liquid transfer of claim 1 wherein the first diversion conditions include at least a maximum rate of liquid transferred therefrom.

6. The method for managed liquid transfer of claim 5 further comprising, during the transferring of liquids from the liquid resource:

measuring the rate of liquid transferred from the liquid resource;

comparing the transferred rate of liquid to the maximum rate, and if the transferred rate meets or exceed the maximum rate volume, discontinuing further transfer therefrom.

7. The method for managed liquid transfer of claim 1 wherein each of the two or more containers is a mobile container, the method further comprising, during the transferring of liquids from the liquid resource, for each of the two or more containers:

while the monitored diversion parameters are in compliance with the first diversion conditions, operating the pumps to effect transfer; and if the monitored diversion parameters are not in compliance with the first diversion conditions, stopping the pumps.

8. The method for managed liquid transfer of claim 2 wherein each of the two or more containers is a mobile container and each pump is a bidirectional pump; the method further comprising, during the transferring of liquids from the liquid resource, for each of the two or more containers:

while the monitored diversion parameters are in compliance with the first diversion conditions, operating the bidirectional pumps; in a first flow direction to effect transfer into the container;

relocating the mobile container to the first unloading area; and operating the bidirectional pumps in a second flow direction to effect transfer for unloading of the container while the container is at the first unloading geo-perimeter.

9. The method for managed liquid transfer of claim 8 wherein each bidirectional pump is driven by a hydraulic motor having first and second hydraulic lines, the method further comprising:

sensing first and second pressures in the first and second lines, a higher of the first and second pressures establishing the direction of the motor and driven pump.

10. The method for managed liquid transfer of claim 1 wherein a flow of liquid is measured during transfer further comprising, during the transferring of liquids from the liquid resource, for each of the two or more containers:

determining a direction of flow of the liquid, and if liquid is flowing to the liquid resource, stopping the transfer, and if the liquid is flowing to the container, continuing transfer while the monitored diversion parameters are in compliance with the first diversion conditions.

11. The method for managed liquid transfer of claim 1 further comprising:

managing the monitoring of the diversion parameters for the two or more containers at a master control unit, communicating transfer, or cessation of transfer, operational signals to each of the two or more containers; and at the master control unit collecting all monitored parameters for each of the two or more containers;

aggregating the monitored parameters; and only while the aggregate monitored diversion parameters are in compliance with the first diversion conditions, communicating operational signals to each of the two or more containers to transfer liquid.

12. The method for managed liquid transfer of claim 11 wherein:

the collecting of all monitored parameters for each of the two or more containers is periodic and upon completion of the loading of the container from the liquid resource.

13. The method for managed liquid transfer of claim 1 wherein the diversion parameters are selected from the group consisting of location, date and time, loading or unloading, rates of liquid transferred, and volumes of liquid transferred.

14. The method for managed liquid transfer of claim 13 wherein the diversion parameters are compared to diversion conditions selected from the group consisting of geo-perimeter location, permitted date and time for transfer, direction of flow, maximum rates of liquid transferred, and maximum volumes of liquid transferred.

15. The method for managed liquid transfer of claim 1 wherein the liquid resource is at least a first water source for diversion.

16. The method for managed liquid transfer of claim 2 wherein the liquid resource is at least a first water source for diversion; and the unloading area is selected from the group consisting of an oil and gas field site, road construction site, and terrain stabilization.

17. The method for managed liquid transfer of claim 16 wherein each of the two or more containers is carried by a water truck for transporting the container between the first water source and unloading area.

18. The method for managed liquid transfer of claim 1 wherein the liquid resource is at least a first liquid resource and a successive liquid resource, further comprising:

establishing boundary coordinates within the spatial coordinates defining at least a second loading geo-perimeter and second diversion conditions for the successive liquid resource; and when the monitored diversion parameters for the first liquid resource are no longer capable of compliance with the first diversion conditions for the first liquid resource, moving the two or more containers to the successive liquid resource;

obtaining current position coordinates of the two or more containers, for each of the two or more containers, determining if the container is at the second loading geo-perimeter; and if within the second loading geo-perimeter, transferring liquids from the successive liquid resource to the container, monitoring diversion parameters and continuing transfer while the monitored diversion parameters for the successive liquid resource are in compliance with the second diversion conditions.

19. The method for managed liquid transfer of claim 1 further comprising storing and preparing a compliance report for at least the monitored diversion parameters.

* * * * *